US012569099B2

(12) United States Patent
Conrad

(10) Patent No.: US 12,569,099 B2
(45) Date of Patent: Mar. 10, 2026

(54) SURFACE CLEANING APPARATUS

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton (CA)

( * ) Notice: Subject to any disclaimer, the term of this patent is extended or adjusted under 35 U.S.C. 154(b) by 957 days.

(21) Appl. No.: 17/230,732

(22) Filed: Apr. 14, 2021

(65) Prior Publication Data

US 2021/0228032 A1 Jul. 29, 2021

Related U.S. Application Data

(63) Continuation-in-part of application No. 16/281,210, filed on Feb. 21, 2019, now abandoned, which is a (Continued)

(51) Int. Cl.
*A47L 9/28* (2006.01)
*A47L 5/22* (2006.01)
(Continued)

(52) U.S. Cl.
CPC ..... *A47L 9/2884* (2013.01); *A47L 5/24* (2013.01); *A47L 5/365* (2013.01); *A47L 5/225* (2013.01);
(Continued)

(58) Field of Classification Search
CPC .. H01M 50/207; H01M 50/247; A47L 9/2884
See application file for complete search history.

(56) References Cited

U.S. PATENT DOCUMENTS 5,267,371 A 12/1993 Soler et al.
5,358,290 A 10/1994 Fleet et al.
(Continued)

FOREIGN PATENT DOCUMENTS

CA 2275675 A1 12/1999
CA 2288544 A1 5/2000
(Continued)

OTHER PUBLICATIONS

Operating Manual: Dyson Stick V10 absolute vacuum user guide, copyright at least as early as Mar. 2018.
(Continued)

*Primary Examiner* — Bryan R Muller
(74) *Attorney, Agent, or Firm* — Philip C. Mendes da Costa; SMART & BIGGAR LP

(57) ABSTRACT

A hand vacuum cleaner has an airflow path from an air inlet to a clean air outlet with an air treatment member and a fan and motor assembly in the air flow path. The hand vacuum cleaner has a cleaner body and a handle having a hand grip portion. The hand vacuum cleaner also includes a plurality of batteries. A portion of the motor and fan assembly and/or a portion of a filter component can be positioned beside and/or between at least some of the batteries. The batteries may be contained in a removable storage chamber. The storage chamber may be removably mounted to the hand vacuum cleaner beside and/or around at least a portion of a filter and/or fan and motor assembly. The batteries may be at a lower part of the hand vacuum cleaner, such as below a handle.

19 Claims, 50 Drawing Sheets

Related U.S. Application Data continuation-in-part of application No. 16/199,777, filed on Nov. 26, 2018, now Pat. No. 11,819,178.

(51) Int. Cl.

| | |
|---|---|
| ***A47L 5/24*** | (2006.01) |
| ***A47L 5/36*** | (2006.01) |
| ***A47L 9/16*** | (2006.01) |
| *A47L 5/28* | (2006.01) |
| *A47L 5/32* | (2006.01) |

(52) U.S. Cl.

CPC . *A47L 5/28* (2013.01); *A47L 5/32* (2013.01); *A47L 9/1608* (2013.01); *A47L 9/165* (2013.01)

(56) References Cited

U.S. PATENT DOCUMENTS 5,974,625 A 11/1999 Garner
6,098,244 A 8/2000 Conrad et al.
6,099,661 A 8/2000 Conrad
6,101,672 A 8/2000 Conrad et al.
6,123,779 A 9/2000 Conrad et al.
6,129,775 A 10/2000 Conrad et al.
6,135,708 A 10/2000 Conrad et al.
6,168,716 B1 1/2001 Conrad et al.
6,170,119 B1 1/2001 Conrad et al.
6,173,474 B1 1/2001 Conrad
6,174,127 B1 1/2001 Conrad et al.
6,183,641 B1 2/2001 Conrad et al.
6,224,325 B1 5/2001 Conrad et al.
6,231,645 B1 5/2001 Conrad et al.
6,238,177 B1 5/2001 Conrad et al.
6,243,917 B1 6/2001 Conrad
6,251,296 B1 6/2001 Conrad et al.
6,261,052 B1 7/2001 Conrad et al.
6,261,379 B1 7/2001 Conrad et al.
6,280,143 B1 8/2001 Parker et al.
6,307,358 B1 10/2001 Conrad
6,312,594 B1 11/2001 Conrad et al.
6,328,527 B1 12/2001 Conrad et al.
6,334,234 B1 1/2002 Conrad et al.
6,344,064 B1 2/2002 Conrad
6,440,197 B1 8/2002 Conrad et al.
6,457,205 B1 10/2002 Conrad
6,533,834 B2 3/2003 Conrad et al.
6,599,340 B2 7/2003 Conrad et al.
6,782,585 B1 8/2004 Conrad et al.
7,329,294 B2 2/2008 Conrad
7,507,269 B2 3/2009 Murphy et al.
7,740,675 B2 6/2010 Conrad
7,749,293 B2 7/2010 Conrad
7,776,120 B2 8/2010 Conrad
7,803,207 B2 9/2010 Conrad
7,811,345 B2 10/2010 Conrad
7,867,308 B2 1/2011 Conrad
7,882,593 B2 2/2011 Beskow et al.
7,941,895 B2 5/2011 Conrad
7,958,597 B2 6/2011 Frantzen et al.
8,069,529 B2 12/2011 Groff et al.
8,127,398 B2 3/2012 Conrad
8,146,201 B2 4/2012 Conrad
8,151,407 B2 4/2012 Conrad
8,156,609 B2 4/2012 Milne et al.
8,176,596 B2 5/2012 Conrad
8,192,515 B2 6/2012 Conrad
8,292,979 B2 10/2012 Conrad
8,296,900 B2 10/2012 Conrad
8,302,250 B2 11/2012 Dyson et al.
8,347,455 B2 1/2013 Dyson et al.
8,349,428 B2 1/2013 Conrad
8,370,993 B2 2/2013 Conrad
8,375,508 B2 2/2013 Conrad
8,424,154 B2 4/2013 Beskow et al.
8,448,291 B2 5/2013 Conrad
8,479,358 B2 7/2013 Conrad
8,486,170 B2 7/2013 Conrad et al.
8,510,907 B2 8/2013 Conrad
8,533,904 B2 9/2013 Conrad
8,549,704 B2 10/2013 Milligan et al.
8,561,257 B2 10/2013 Conrad
8,567,005 B2 10/2013 Conrad
8,578,550 B2 11/2013 Conrad
8,578,553 B2 11/2013 Conrad
8,590,102 B2 11/2013 Conrad
8,607,406 B2 12/2013 Miefalk et al.
8,607,407 B2 12/2013 Conrad
8,621,709 B2 1/2014 Conrad
8,640,304 B2 2/2014 Conrad
8,646,147 B2 2/2014 Conrad
8,659,184 B2 2/2014 Conrad
8,677,554 B2 3/2014 Conrad
8,677,558 B2 3/2014 Conrad
8,713,751 B2 5/2014 Conrad
8,769,764 B2 7/2014 Crouch et al.
8,806,702 B2 * 8/2014 Wolfe, Jr. ..... A47L 5/24 15/DIG. 1
8,813,305 B2 8/2014 Conrad
8,834,209 B2 9/2014 Conrad
8,869,344 B2 10/2014 Conrad
8,869,345 B2 10/2014 Conrad
8,869,348 B2 10/2014 Conrad
8,875,340 B2 11/2014 Conrad
8,875,342 B2 11/2014 Conrad
9,027,198 B2 5/2015 Conrad
9,027,203 B2 5/2015 Conrad et al.
9,066,642 B2 6/2015 Conrad
9,119,513 B2 9/2015 Conrad
9,161,666 B2 10/2015 Conrad
9,161,669 B2 10/2015 Conrad
9,167,944 B2 10/2015 Conrad
9,204,769 B2 12/2015 Conrad
9,204,773 B2 12/2015 Conrad
9,215,960 B2 12/2015 Conrad
9,226,633 B2 1/2016 Conrad et al.
9,227,151 B2 1/2016 Conrad
9,227,201 B2 1/2016 Conrad
9,232,881 B2 1/2016 Conrad
9,238,235 B2 1/2016 Conrad
9,295,995 B2 3/2016 Conrad
9,314,138 B2 4/2016 Conrad
9,314,139 B2 4/2016 Conrad et al.
9,320,401 B2 4/2016 Conrad
9,326,652 B2 5/2016 Conrad
9,364,127 B2 6/2016 Conrad
9,427,122 B2 8/2016 Conrad et al.
9,427,126 B2 8/2016 Conrad
9,433,332 B2 9/2016 Conrad
9,451,852 B2 9/2016 Conrad
9,451,855 B2 9/2016 Conrad
9,456,721 B2 10/2016 Conrad
9,492,045 B2 11/2016 Conrad
9,526,394 B2 12/2016 Conrad
9,572,463 B2 2/2017 Conrad
9,591,952 B2 3/2017 Conrad
9,591,958 B2 3/2017 Conrad
9,757,001 B2 9/2017 Hwang et al.
9,775,484 B2 10/2017 Conrad
9,801,513 B2 10/2017 Conrad et al.
9,820,621 B2 11/2017 Conrad et al.
9,888,817 B2 2/2018 Conrad
9,962,048 B2 5/2018 Conrad et al.
9,986,880 B2 6/2018 Conrad
10,076,183 B2 9/2018 Conrad et al.
10,117,550 B1 11/2018 Conrad
10,149,587 B2 12/2018 Conrad et al.
10,159,393 B2 12/2018 Conrad
10,201,260 B2 2/2019 Conrad et al.
10,214,349 B2 2/2019 Conrad
10,251,519 B2 4/2019 Conrad
10,357,136 B2 7/2019 Conrad
10,537,216 B2 1/2020 Conrad
10,537,219 B2 1/2020 Conrad et al.
10,568,477 B2 * 2/2020 Conrad ..... A47L 9/22
10,575,693 B2 3/2020 Conrad

(56) References Cited

U.S. PATENT DOCUMENTS

| | | | |
|---|---|---|---|
| 10,667,663 | B2 | 6/2020 | Conrad |
| 10,687,679 | B2 | 6/2020 | Conrad et al. |
| 10,729,294 | B2 | 8/2020 | Conrad et al. |
| 10,765,278 | B2 | 9/2020 | Conrad et al. |
| 10,791,890 | B2 | 10/2020 | Conrad |
| 10,791,896 | B2 | 10/2020 | Conrad |
| 10,888,205 | B2 | 1/2021 | Conrad et al. |
| 10,932,634 | B2 | 3/2021 | Conrad |
| 10,959,588 | B2 | 3/2021 | Conrad et al. |
| 11,013,378 | B2 | 5/2021 | Conrad |
| 11,108,254 | B2 | 8/2021 | Conrad |
| 11,135,602 | B2 | 10/2021 | Conrad |
| 11,154,169 | B2 | 10/2021 | Conrad |
| 11,198,085 | B2 | 12/2021 | Conrad et al. |
| 11,213,179 | B2 | 1/2022 | Conrad |
| 11,246,462 | B2 | 2/2022 | Conrad |
| 11,285,495 | B2 | 3/2022 | Conrad |
| 11,318,482 | B2 | 5/2022 | Conrad |
| 11,478,116 | B2 | 10/2022 | Conrad |
| 11,478,117 | B2 | 10/2022 | Conrad et al. |
| 11,529,034 | B2 | 12/2022 | Conrad |
| 11,534,041 | B2 | 12/2022 | Conrad |
| 11,534,043 | B2 | 12/2022 | Conrad |
| 11,534,702 | B2 | 12/2022 | Conrad |
| 11,547,258 | B2 | 1/2023 | Conrad |
| 11,571,097 | B2 | 2/2023 | Conrad |
| 11,612,290 | B2 | 3/2023 | Conrad |
| 11,737,625 | B2 | 8/2023 | Conrad |
| 11,745,131 | B2 | 9/2023 | Conrad |
| 11,793,374 | B2 | 10/2023 | Conrad |
| 11,839,343 | B2 | 12/2023 | Conrad et al. |
| 11,841,024 | B2 | 12/2023 | Conrad |
| 11,857,142 | B2 | 1/2024 | Conrad |
| 11,950,745 | B2 | 4/2024 | Conrad et al. |
| 12,053,143 | B2 | 8/2024 | Conrad |
| 2001/0027587 | A1 | 10/2001 | Conrad et al. |
| 2002/0162188 | A1 | 11/2002 | Harmen |
| 2003/0201754 | A1 | 10/2003 | Conrad |
| 2004/0216266 | A1 | 11/2004 | Conrad |
| 2006/0090290 | A1 | 5/2006 | Lau |
| 2006/0196004 | A1 | 9/2006 | Conrad |
| 2008/0040883 | A1 | 2/2008 | Beskow et al. |
| 2008/0172992 | A1 | 7/2008 | Conrad |
| 2008/0178416 | A1 | 7/2008 | Conrad |
| 2008/0178418 | A1 | 7/2008 | Conrad |
| 2008/0179133 | A1 | 7/2008 | Conrad |
| 2008/0196366 | A1 | 8/2008 | Conrad |
| 2008/0216281 | A1 | 9/2008 | Conrad |
| 2010/0175217 | A1 | 7/2010 | Conrad |
| 2010/0229323 | A1 | 9/2010 | Conrad |
| 2010/0229325 | A1 | 9/2010 | Conrad |
| 2010/0229326 | A1 | 9/2010 | Conrad |
| 2010/0229334 | A1 | 9/2010 | Conrad |
| 2010/0229335 | A1 | 9/2010 | Conrad |
| 2010/0251507 | A1 | 10/2010 | Conrad |
| 2011/0219567 | A1 | 9/2011 | Conrad |
| 2011/0219579 | A1 | 9/2011 | Conrad |
| 2011/0289720 | A1 | 12/2011 | Han et al. |
| 2013/0091815 | A1 | 4/2013 | Smith |
| 2014/0237757 | A1 | 8/2014 | Conrad |
| 2014/0237768 | A1 | 8/2014 | Conrad |
| 2017/0196426 | A1 | 7/2017 | Brown et al. |
| 2017/0209014 | A1 | 7/2017 | Stickney |
| 2017/0215663 | A1 | 8/2017 | Conrad et al. |
| 2017/0290480 | A1 | 10/2017 | Conrad |
| 2018/0177352 | A1 | 6/2018 | Conrad |
| 2019/0008338 | A1 | 1/2019 | Conrad |
| 2020/0077855 | A1* | 3/2020 | Brown ..... A47L 9/2842 |
| 2020/0129028 | A1 | 4/2020 | Pougher et al. |
| 2020/0154962 | A1 | 5/2020 | Fie et al. |
| 2020/0305671 | A1 | 10/2020 | Conrad |
| 2021/0228032 | A1 | 7/2021 | Conrad |
| 2021/0330157 | A1 | 10/2021 | Conrad |
| 2021/0386258 | A1 | 12/2021 | Conrad |
| 2022/0142440 | A1 | 5/2022 | Conrad |
| 2022/0151446 | A1 | 5/2022 | Conrad et al. |
| 2023/0098664 | A1 | 3/2023 | Conrad |
| 2023/0263350 | A1 | 8/2023 | Conrad et al. |
| 2023/0348169 | A1 | 11/2023 | Conrad |
| 2024/0016351 | A1 | 1/2024 | Conrad |
| 2024/0138634 | A1 | 5/2024 | Conrad |
| 2024/0180373 | A1 | 6/2024 | Conrad et al. |
| 2024/0358212 | A1 | 10/2024 | Conrad |

FOREIGN PATENT DOCUMENTS

| | | | |
|---|---|---|---|
| CA | 2258416 | A1 | 7/2000 |
| CA | 2258419 | A1 | 7/2000 |
| CA | 2258421 | A1 | 7/2000 |
| CA | 2258422 | A1 | 7/2000 |
| CA | 2258423 | A1 | 7/2000 |
| CA | 2258426 | A1 | 7/2000 |
| CA | 2330801 | A1 | 7/2001 |
| CA | 2338193 | A1 | 7/2002 |
| CA | 2339514 | A1 | 9/2002 |
| CA | 2342673 | A1 | 9/2002 |
| CA | 2342993 | A1 | 9/2002 |
| CA | 2658014 | A1 | 9/2010 |
| CA | 2658022 | A1 | 9/2010 |
| CA | 2658160 | A1 | 9/2010 |
| CA | 2658366 | A1 | 9/2010 |
| CA | 2658397 | A1 | 9/2010 |
| CA | 2658497 | A1 | 9/2010 |
| CA | 2658643 | A1 | 9/2010 |
| CA | 2658644 | A1 | 9/2010 |
| EP | 3108788 | A1 | 12/2016 |
| WO | 0010718 | A1 | 3/2000 |
| WO | 2017046557 | A1 | 3/2017 |
| WO | 2017046559 | A1 | 3/2017 |
| WO | 2017046560 | A1 | 3/2017 |
| WO | 2019/030479 | A1 | 2/2019 |

OTHER PUBLICATIONS

English machine translation of EP3108788, published on Dec. 28, 2016.

U.S. Appl. No. 09/343,479, filed Jun. 30, 1999.

* cited by examiner

SURFACE CLEANING APPARATUS

CROSS-REFERENCE TO RELATED APPLICATION

This application is a continuation-in-part of co-pending U.S. patent application Ser. No. 16/281,210 filed on Feb. 21, 2019, which is a continuation-in-part of co-pending U.S. patent application Ser. No. 16/199,777 filed on Nov. 26, 2018, the disclosure of each of which is incorporated herein by reference.

FIELD

This disclosure relates generally to surface cleaning apparatus such as hand vacuum cleaners, upright vacuum cleansers, stick vacuum cleaners or canister vacuum cleaners, and in particular portable surface cleaning apparatus, such as hand vacuum cleaners, with components nested with an onboard energy source.

INTRODUCTION

The following is not an admission that anything discussed below is part of the prior art or part of the common general knowledge of a person skilled in the art.

Various types of surface cleaning apparatus are known, including upright surface cleaning apparatus, canister surface cleaning apparatus, stick surface cleaning apparatus, central vacuum systems, and hand carriable surface cleaning apparatus such as hand vacuum cleaners. Further, various designs for cyclonic surface cleaning apparatus, including battery operated cyclonic hand vacuum cleaners are known in the art.

SUMMARY

The following introduction is provided to introduce the reader to the more detailed discussion to follow. The introduction is not intended to limit or define any claimed or as yet unclaimed invention. One or more inventions may reside in any combination or sub-combination of the elements or process steps disclosed in any part of this document including its claims and figures.

In accordance with one aspect of this disclosure, which may be used alone or in combination with any other aspect, it may be desirable for a hand vacuum cleaner to have a compact overall form, for example so it can be maneuvered around and/or between objects when being carried by a user while cleaning one or more surfaces. A compact form may also improve the ergonomics of the hand vacuum cleaner (e.g., the perceived balance or 'hand feel' when carried by a user) and well as permit the hand vacuum cleaner to be stored in a smaller place.

A hand vacuum cleaner may be powered by an onboard energy source comprising a plurality of energy storage members, such as one or more batteries provided in one or more battery packs, that allows the hand vacuum cleaner to be used more freely without a tether (an electric cord) limiting the range or maneuverability.

Nesting some or all of the fan and motor assembly and/or a pre-motor filter and/or a post-motor filter between onboard energy storage members may promote a compact design and reduce the overall size of the hand vacuum cleaner. This may provide increased maneuverability and accessibility for a user of the hand vacuum cleaner.

In accordance with this broad aspect, there is provided a hand vacuum cleaner having a front end, a rear end, an upper end and a lower end, the hand vacuum cleaner comprising:

(a) an air flow path from an air inlet to a clean air outlet with an air treatment member and a fan and motor assembly in the air flow path, the motor and fan assembly having a motor axis of rotation;

(b) a hand vacuum cleaner body;

(c) a handle having a hand grip portion; and, (d) a plurality of batteries wherein at least a portion of the motor and fan assembly is located between at least some of the batteries.

In some embodiments, a filter may be provided in the air flow path, wherein at least a portion of the filter is located between at least some of the batteries.

In some embodiments, an open volume may be provided between as least some of the batteries and at least the portion of the motor and fan assembly is located in the open volume.

In some embodiments, a filter may be provided in the air flow path, wherein at least a portion of the filter is located in the open volume.

In some embodiments, the motor and fan assembly has first and second lateral sides which are spaced apart in a lateral direction on opposite sides of the axis of rotation, where at least first and second axially extending rows of batteries may be provided on one lateral side and at least a first axially extending row of batteries may be provided on the other lateral side, where the first axially extending row may be spaced from the second axially extending row in a transverse direction that is perpendicular to both the axis of rotation and the lateral direction.

In some embodiments, the motor and fan assembly has first and second lateral sides which are spaced apart in a lateral direction on opposite sides of the axis of rotation, at least first and second axially extending rows of batteries may be provided on each lateral side of the motor and fan assembly, where the first axially extending row may be spaced from the second axially extending row in a transverse direction that is perpendicular to both the axis of rotation and the lateral direction.

In some embodiments, the second lateral row of batteries may be longer than the first lateral row of batteries.

In some embodiments, the batteries may be provided in an array having first and second lateral array sides, first and second transverse array sides and first and second axially spaced apart array sides, where the first row of batteries may be located at the first transverse array side and the second row may be located at the second transverse array side, where a filter is provided in the air flow path and a first portion of the filter may be positioned between the second transverse array side and the first row of batteries.

In some embodiments, a filter may be provided in the air flow path and the filter may be transversely positioned overlying at least one of the first rows of batteries.

In some embodiments, a filter may be provided in the air flow path and the filter may be a pre-motor filter and the axis of rotation may extend through a volume defined by a perimeter of the pre-motor filter.

In some embodiments, the filter may be a pre-motor filter, the axis of rotation may extend through a volume defined by a perimeter of the pre-motor filter and a second portion of the filter may be positioned between the first rows of batteries.

In some embodiments, a post-motor filter may be provided and the axis of rotation may extend through a volume defined by a perimeter of the post-motor filter.

In some embodiments, an axis of at least one of the first rows of batteries may extend through the volume defined by a perimeter of the post-motor filter.

In some embodiments, an axis of at least one of the second rows of batteries may extend through the volume defined by a perimeter of the post-motor filter.

In some embodiments, the plurality of batteries are located in a battery housing and the plurality of batteries may be positioned exterior to the air flow path.

In some embodiments, the handle may be located at the rear end of the hand vacuum cleaner, the handle may have a handle axis extending between upper and lower ends of the handle and the plurality of batteries and the motor and fan assembly may be positioned at the lower end of the handle.

In some embodiments, the handle may be located at the rear end of the hand vacuum cleaner, the handle may have a handle axis extending between upper and lower ends of the handle and the plurality of batteries and the motor and fan assembly may be positioned at the upper end of the handle.

In some embodiments, the plurality of batteries may be located in a removable battery housing.

In accordance with this broad aspect, there is also provided a hand vacuum cleaner having a front end, a rear end, an upper end and a lower end, the hand vacuum cleaner comprising:

(e) an air flow path from an air inlet to a clean air outlet with an air treatment member, a filter and a fan and motor assembly in the air flow path, the motor and fan assembly having a motor axis of rotation;

(f) a hand vacuum cleaner body;

(g) a handle having a hand grip portion; and, (h) a plurality of batteries wherein at least a portion of the filter is located between at least some of the batteries.

In some embodiments, an open volume is provided between as least some of the batteries and at least the portion of the filter may be located in the open volume.

In accordance with another broad aspect of this invention, which may be used alone or in combination with any other aspect, a portable surface cleaning apparatus, such as a hand vacuum cleaner, has a horizontally disposed air treatment member, such as a cyclone, wherein a dirt collection chamber or region is exterior to the dirt separation region of the air treatment member (e.g., the cyclone). The dirt collection chamber is in communication with the cyclone by a dirt outlet wherein the dirt outlet for larger dirt particles (e.g., popcorn) or all of the dirt outlet is provided in an upper portion of the cyclone. An advantage of this design is that the tendency for dirt to re-enter the cyclone from the dirt collection chamber is reduced.

In accordance with this aspect, there is provided a hand vacuum cleaner having a front end, a rear end, an upper end and a lower end, the hand vacuum cleaner comprising:

(a) an air flow path extending from a dirty air inlet to a clean air outlet;

(b) a cyclone provided in the air flow path, the cyclone comprising a cyclone chamber, a cyclone air inlet, a cyclone air outlet, a dirt outlet, a central longitudinally extending axis, the cyclone chamber having front and rear axially opposed ends, wherein when the upper end of the hand vacuum cleaner is positioned above the lower end of the hand vacuum cleaner the central longitudinally extending axis is oriented generally horizontal;

(c) a dirt collection chamber external to the cyclone chamber;

(d) a plate positioned at the front end of the cyclone chamber, the plate having a cyclone chamber face facing the cyclone chamber, an opposed dirt collection chamber face facing the dirt collection chamber and a perimeter;

(e) a suction motor positioned in the air flow path; and, (f) a handle wherein, when the upper end of the hand vacuum cleaner is positioned above the lower end of the hand vacuum cleaner, a gap between the upper portion of the plate and the cyclone defines the dirt outlet of the cyclone chamber.

In some embodiments, the gap may extend around all of the perimeter of the plate, and, when the upper end of the hand vacuum cleaner is positioned above the lower end of the hand vacuum cleaner, the gap may comprise an upper gap located between the upper end of the plate and the cyclone and a lower gap located between a lower end of the plate and the cyclone, and the radial width of the upper gap is larger than a radial width of the lower gap.

In some embodiments, the gap has a radial distance between the plate and the cyclone and the radial distance may be larger at an upper end of the plate when the upper end of the hand vacuum cleaner is positioned above the lower end of the hand vacuum cleaner.

In some embodiments, the plate has a perimeter and the perimeter may have two discontinuities.

In some embodiments, when the upper end of the hand vacuum cleaner is positioned above the lower end of the hand vacuum cleaner, an upper end of the plate may have a segment removed.

In some embodiments, the cyclone may have a generally axially extending sidewall and the gap may be provided between the perimeter of the plate and the sidewall.

In some embodiments, the cyclone air inlet and the cyclone air outlet may be provided at the rear end of the cyclone chamber.

In some embodiments, the plate may be moveably mounted between a closed position, in which the plate is positioned for operation of the cyclone and an open position wherein the plate is moved to provide access to the cyclone chamber.

In some embodiments, the dirt collection region may have a front wall facing the plate and the front wall may be openable.

In some embodiments, the plate may be supported by the front wall and may be moveable with the front wall.

In some embodiments, the hand vacuum cleaner may further comprise a plurality of individual support members extending between the front wall and the plate wherein the support members are spaced around the plate.

In some embodiments, the support members may comprise planar axially extending members.

In some embodiments, the support members may have planar axially extending sidewalls.

In some embodiments, the support members may be recessed inwardly from the perimeter.

In some embodiments, the support members may be spaced around a central axially extending region of the dirt collection chamber In accordance with another broad aspect, which may be used alone or in combination with any other aspect, a plate is positioned between an air treatment member, such as a cyclone, and a dirt collection chamber or region that is exterior to the dirt separation region. The air treatment member may be horizontally disposed and is in communication with the air treatment member by a dirt outlet. The dirt chamber has members that extend outwardly, e.g., radially outwardly, from the radial center of the dirt collection chamber. The support members may be provided on a dirt collection chamber face of the plate. An advantage of this design is that the tendency for dirt to re-enter the cyclone from the dirt collection chamber is reduced.

In accordance with this aspect, there is provide a surface cleaning apparatus comprising:

(a) an air flow path extending from a dirty air inlet to a clean air outlet;

(b) a cyclone provided in the air flow path, the cyclone comprising a cyclone chamber, a cyclone air inlet, a cyclone air outlet, a dirt outlet, a central longitudinally extending axis, the cyclone chamber having front and rear axially opposed ends;

(c) a dirt collection chamber external to the cyclone chamber;

(d) a plate positioned between the cyclone chamber and the dirt collection chamber, the plate having a cyclone chamber face facing the cyclone chamber, an opposed dirt collection chamber face facing the dirt collection chamber and a perimeter;

(e) a suction motor positioned in the air flow path; and, (f) a plurality of individual support members located between an end wall of the dirt collection chamber that faces the plate and the plate wherein the support members are spaced around the plate and extend outwardly towards an outer wall of the dirt collection chamber.

In some embodiments, the end wall of the dirt collection chamber may be openable and the plate may be moveable with the end wall.

In some embodiments, the support members may comprise planar axially extending members.

In some embodiments, the support members may be recessed inwardly from the perimeter.

In some embodiments, the support members may be spaced around a central axially extending region of the dirt collection chamber.

In accordance with another broad aspect, which may be used alone or in combination with any other aspect, nesting some or all of the fan and motor assembly and/or a pre-motor filter and/or a post-motor filter beside and/or between onboard energy storage members, and with the onboard energy storage members, pre-motor filter, and/or post motor filter at a lower part of the hand vacuum cleaner (e.g., below a handle of the hand vacuum cleaner and/or below a central longitudinal axis of an air treatment member) may promote a compact design and reduce the overall size of the hand vacuum cleaner. This may provide increased maneuverability and accessibility for a user of the hand vacuum cleaner.

In accordance with this broad aspect, there is provided a hand vacuum cleaner having a front end, a rear end, an upper end and a lower end, the hand vacuum cleaner comprising:

(a) a main body;

(b) an air flow path from an air inlet to a clean air outlet with an air treatment member provided in the air flow path, wherein, optionally, the air inlet is provided at the upper end of the hand vacuum cleaner;

(c) a fan and motor assembly provided in the main body, the fan and motor assembly is positioned in the air flow path downstream of the air treatment member, the fan and motor assembly having a motor axis of rotation, the fan and motor assembly having a first lateral side that is laterally spaced in a first direction from the motor axis of rotation and a second lateral side that is laterally spaced in a second direction from the motor axis of rotation wherein the second direction is opposite to the first direction;

(d) a pistol grip handle having a hand grip portion, a lower end of the pistol grip handle is mounted to the main body at a location above the fan and motor assembly; and, (e) a first plurality of energy storage members is provided on the first lateral side of the fan and motor assembly and a second plurality of energy storage members is provided on the second lateral side of the fan and motor assembly, wherein each of the first and second plurality of energy storage members has a lower end and the lower end of the first and second plurality of energy storage members has an absence of energy storage members located therebetween.

In some embodiments, the first plurality of energy storage members may be provided in a first lateral energy storage member housing section, the second plurality of energy storage members may be provided in a second lateral energy storage member housing section and the first and second lateral energy storage member housing sections are separated by a laterally extending web.

In some embodiments, a lower surface of the hand vacuum cleaner may comprise the laterally extending web.

In some embodiments, the air flow path may comprise an inlet passage extending longitudinally rearwardly from the air inlet to the air treatment member, the air inlet may be provided at the upper end of the hand vacuum cleaner and may have a longitudinally extending axis and the longitudinally extending axis intersects an upper end of the handle.

In some embodiments, the air treatment member may comprise a cyclone having a cyclone axis of rotation, the cyclone axis of rotation extends in a forward/rearward direction and, when the hand vacuum cleaner is oriented with the upper end of the hand vacuum cleaner above the lower end of the hand vacuum cleaner, an upper end of the first plurality of energy storage members may be positioned below the cyclone axis of rotation.

In some embodiments, the air treatment member may comprise a cyclone having a cyclone axis of rotation, the cyclone axis of rotation extends in a forward/rearward direction and, when the hand vacuum cleaner is oriented with the upper end of the hand vacuum cleaner above the lower end of the hand vacuum cleaner, an upper end of the fan and motor assembly may be positioned below the cyclone axis of rotation.

In some embodiments, the air treatment member may comprise a cyclone having a cyclone axis of rotation, the cyclone axis of rotation extends in a forward/rearward direction and, when the hand vacuum cleaner is oriented with the upper end of the hand vacuum cleaner above the lower end of the hand vacuum cleaner, the motor axis of rotation may be positioned below the cyclone axis of rotation.

In some embodiments, the hand vacuum cleaner may further comprise a pre-motor filter, wherein a front end of the first plurality of energy storage members is positioned rearward of a front end of the pre-motor filter.

In some embodiments, the hand vacuum cleaner may further comprise a pre-motor filter wherein a finger receiving area is provided between the hand grip portion and the pre-motor filter.

In accordance with this broad aspect, there is also provided a hand vacuum cleaner having a front end, a rear end, an upper end and a lower end, the hand vacuum cleaner comprising:

(a) a main body;

(b) an air flow path from an air inlet to a clean air outlet with an air treatment member provided in the air flow path, wherein, optionally, the air inlet is provided at the upper end of the hand vacuum cleaner, wherein the air treatment member has a central longitudinal axis extending in a forward/rearward direction that is horizontal when the upper end is above the lower end;

(c) a fan and motor assembly provided in the main body, the fan and motor assembly is positioned in the air flow path downstream of the air treatment member, the fan and motor assembly having a motor axis of rotation, the fan and motor assembly having a first lateral side that is laterally spaced in a first direction from the motor axis of rotation and a second lateral side that is laterally spaced in a second direction from the motor axis of rotation wherein the second direction is opposite to the first direction;

(d) a pistol grip handle having a hand grip portion, a lower end of the pistol grip handle is mounted to the main body at a location above the fan and motor assembly; and, (e) a first plurality of energy storage members is provided on the first lateral side of the fan and motor assembly, wherein, when the hand vacuum cleaner is oriented with the upper end of the hand vacuum cleaner above the lower end of the hand vacuum cleaner, an upper end of the first plurality of energy storage members is positioned below the central longitudinal axis.

In some embodiments, the hand vacuum cleaner may further comprise a second plurality of energy storage members that is provided on the second lateral side of the fan and motor assembly wherein the first plurality of energy storage members is provided in a first lateral energy storage member housing section, the second plurality of energy storage members is provided in a second lateral energy storage member housing section and the first and second lateral energy storage member housing sections are separated by a laterally extending web that has an absence of energy storage members.

In some embodiments, a lower surface of the hand vacuum cleaner may comprise the laterally extending web.

In some embodiments, the air flow path may comprise an inlet passage extending longitudinally rearwardly from the air inlet to the air treatment member, the air inlet is provided at the upper end of the hand vacuum cleaner and has a longitudinally extending axis and the longitudinally extending axis intersects an upper end of the handle.

In some embodiments, when the hand vacuum cleaner is oriented with the upper end of the hand vacuum cleaner above the lower end of the hand vacuum cleaner, an upper end of the fan and motor assembly may be positioned below the central longitudinal axis.

In some embodiments, when the hand vacuum cleaner is oriented with the upper end of the hand vacuum cleaner above the lower end of the hand vacuum cleaner, the motor axis of rotation may be positioned below the central longitudinal axis.

In some embodiments, the hand vacuum cleaner may further comprise a pre-motor filter, wherein a front end of the first plurality of energy storage members is positioned rearward of a front end of the pre-motor filter.

In some embodiments, the first plurality of energy storage members may be provided on a first lateral side of the hand vacuum cleaner and the fan and motor assembly may be provided on a second lateral side of the hand vacuum cleaner.

In accordance with this broad aspect, there is also provided a hand vacuum cleaner having a front end, a rear end, an upper end and a lower end, the hand vacuum cleaner comprising:

(a) a main body;

(b) an air flow path from an air inlet to a clean air outlet with an air treatment member provided in the air flow path, wherein, optionally, the air inlet is provided at the upper end of the hand vacuum cleaner, wherein the air treatment member has a central longitudinal axis extending in a forward/rearward direction that is horizontal when the upper end is above the lower end;

(c) a fan and motor assembly provided in the main body, the fan and motor assembly is positioned in the air flow path downstream of the air treatment member, the fan and motor assembly having a motor axis of rotation, the fan and motor assembly having a first lateral side that is laterally spaced in a first direction from the motor axis of rotation and a second lateral side that is laterally spaced in a second direction from the motor axis of rotation wherein the second direction is opposite to the first direction;

(d) a pistol grip handle having a hand grip portion, a lower end of the pistol grip handle is mounted to the main body at a location above the fan and motor assembly; and, (e) a first plurality of energy storage members is provided on the first lateral side of the fan and motor assembly, wherein, when the hand vacuum cleaner is oriented with the upper end of the hand vacuum cleaner above the lower end of the hand vacuum cleaner, the motor axis of rotation is positioned below the central longitudinal axis.

In some embodiments, the hand vacuum cleaner may further comprise a second plurality of energy storage members that is provided on the second lateral side of the fan and motor assembly wherein the first plurality of energy storage members is provided in a first lateral energy storage member housing, the second plurality of energy storage members is provided in a second lateral energy storage member housing, and the first and second lateral energy storage member housings are separated by a laterally extending web that has an absence of energy storage members.

In some embodiments, when the hand vacuum cleaner is oriented with the upper end of the hand vacuum cleaner above the lower end of the hand vacuum cleaner, the motor axis of rotation may be positioned below the central longitudinal axis.

In some embodiments, when the hand vacuum cleaner is oriented with the upper end of the hand vacuum cleaner above the lower end of the hand vacuum cleaner, an upper end of the first plurality of energy storage members may be positioned below the central longitudinal axis. In some embodiments, the first plurality of energy storage members may be provided on a first lateral side of the hand vacuum cleaner and the fan and motor assembly may be provided on a second lateral side of the hand vacuum cleaner.

It will be appreciated by a person skilled in the art that an apparatus or method disclosed herein may embody any one or more of the features contained herein and that the features may be used in any particular combination or sub-combination.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which.

Figure 1:
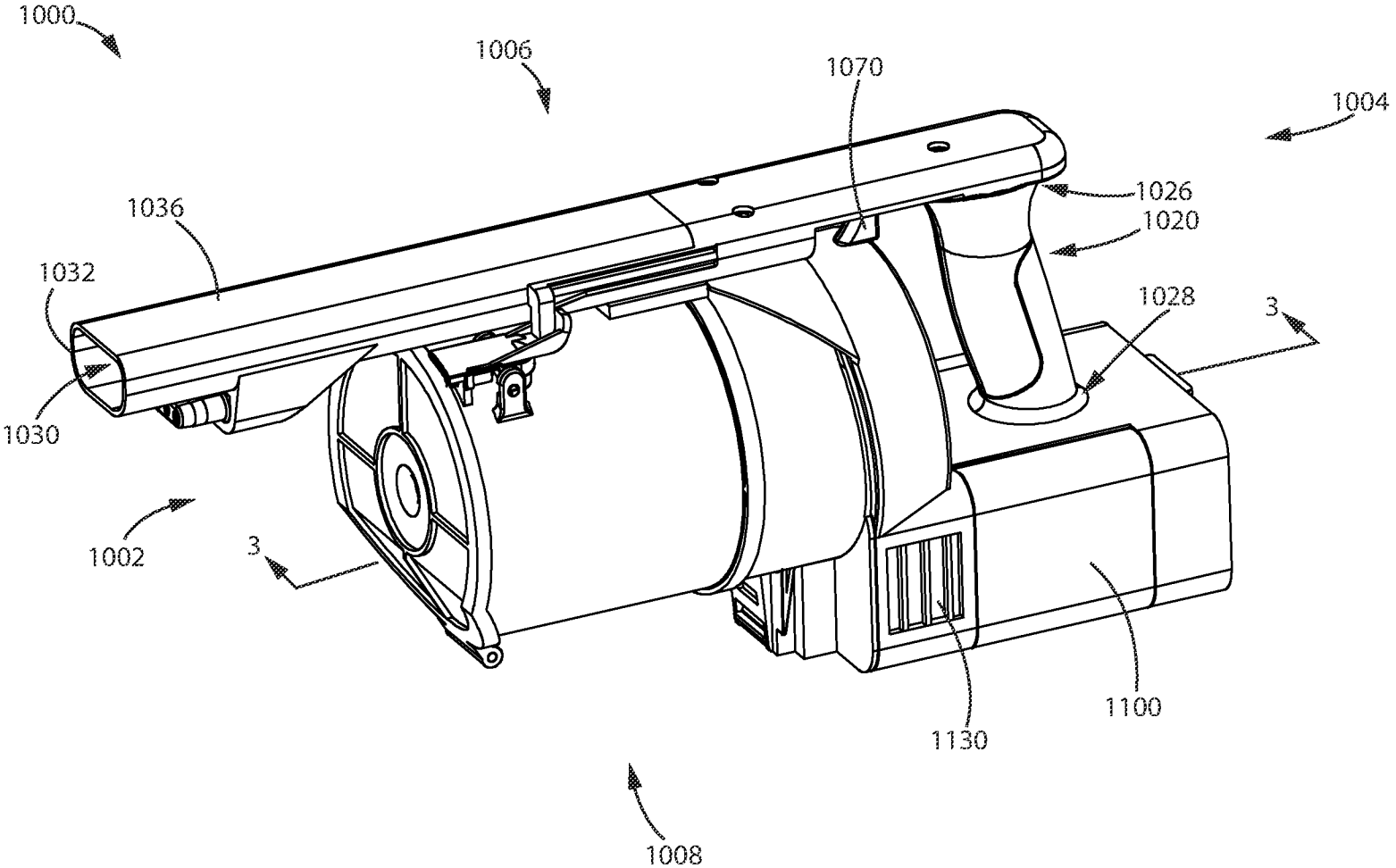
FIG. 1 is a top front perspective view of a hand vacuum cleaner in accordance with an embodiment.
Figure 2:
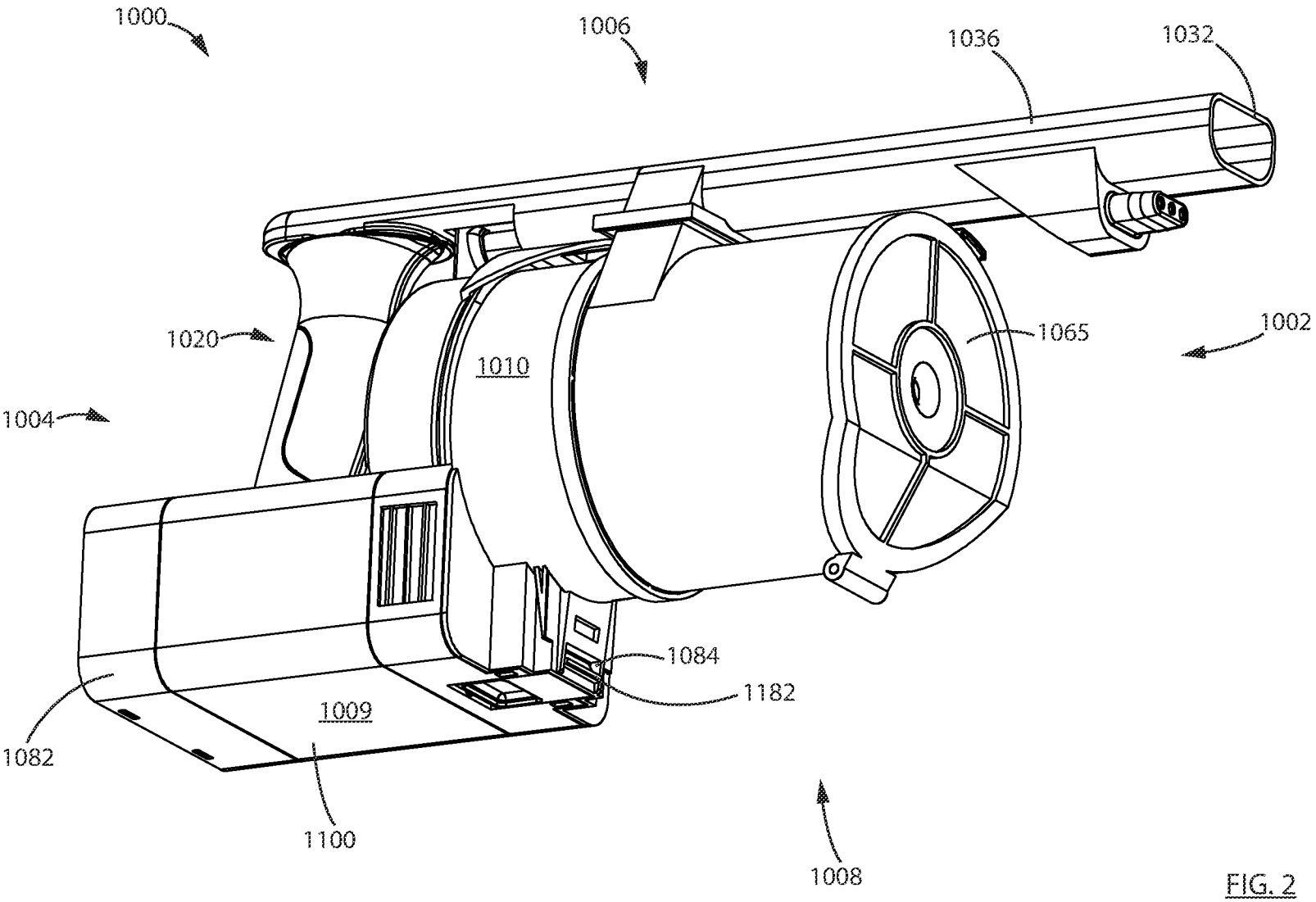
FIG. 2 is a bottom front perspective view of the hand vacuum cleaner of FIG. 1.

The drawings included herewith are for illustrating various examples of articles, methods, and apparatuses of the teaching of the present specification and are not intended to limit the scope of what is taught in any way.

DESCRIPTION OF EXAMPLE EMBODIMENTS

Various apparatuses, methods and compositions are described below to provide an example of an embodiment of each claimed invention. No embodiment described below limits any claimed invention and any claimed invention may cover apparatuses and methods that differ from those described below. The claimed inventions are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected in physical contact with each other. None of the terms "coupled", "connected", "attached", and "fastened" distinguish the manner in which two or more parts are joined together.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

General Description of a Surface Cleaning Apparatus

Referring to FIGS. 1 to 5, an exemplary embodiment of a surface cleaning apparatus is shown generally as 1000. The surface cleaning apparatus 1000 shown includes an energy storage chamber 1100 that is shaped so that one or more of the suction motor 1050, pre-motor filter 1090 and post-motor filter 1080 can be nested between onboard energy storage members 1150.

In the illustrated embodiment, the surface cleaning apparatus is a hand vacuum cleaner, which may also be referred to as a "handvac" or "hand-held vacuum cleaner". As used herein, a hand vacuum cleaner is a vacuum cleaner that can be operated to clean a surface generally one-handedly. That is, the entire weight of the vacuum may be held by the same one hand used to direct a dirty air inlet of the vacuum cleaner with respect to a surface to be cleaned. For example, the handle and a clean air inlet may be rigidly coupled to each other (directly or indirectly) so as to move as one while maintaining a constant orientation relative to each other. This is to be contrasted with canister and upright vacuum cleaners, whose weight is typically supported by a surface (e.g., a floor) during use. It will be appreciated that surface cleaning apparatus 1000 may alternately be any surface cleaning apparatus, such as an upright surface cleaning apparatus, a stick vac, a canister surface cleaning apparatus, an extractor or the like. It will also be appreciated that the surface cleaning apparatus may use any configuration of the operating components and the airflow paths exemplified herein.

As exemplified in FIGS. 1 to 5, surface cleaning apparatus 1000 includes a main body 1010 having a housing, a handle 1020, an air treatment member 1060 connected to the main body 1010, a dirty air inlet 1030, a clean air outlet 1040, and an air flow path 1031 extending between the dirty air inlet 1030 and the clean air outlet 1040, which may be referred to as a first or primary air flow path.

Surface cleaning apparatus 1000 (an example of which is also shown in FIGS. 46 to 50) has a front end 1002, a rear end 1004, an upper end or top 1006, and a lower end or bottom 1008. In the embodiment shown, dirty air inlet 1030 is at an upper portion of the front end 1002 and clean air outlet 1040 is at a lower portion of the rear end 1004. It will be appreciated that the dirty air inlet 1030 and the clean air outlet 1040 may be provided in different locations.

A motor and fan assembly is provided to generate vacuum suction through the first air flow path 1031. In the example shown, the motor and fan assembly 1049 (FIG. 3) includes a suction motor 1050. The suction motor 1050 is contained within a suction motor housing 1052. The suction motor 1050 is positioned downstream from the air treatment member 1060 although it may be positioned upstream of the air treatment member 1060 (e.g., a dirty air motor) in alternative embodiments. The suction motor 1050 can rotate about a central axis of rotation 1054.

As exemplified in FIGS. 10, 11, 47, and 48, the motor and fan assembly 1049 has a first lateral side 1051 that is laterally spaced in a first direction 1059 from the motor axis of rotation 1054, and a second lateral side 1053 that is laterally spaced in a second direction 1061 opposite to the first direction 1059 from the motor axis of rotation 1054.

As exemplified in FIG. 3, an upper end 1055 of the fan and motor assembly is positioned below a central longitudinal axis of the air treatment member (e.g., the cyclone axis of rotation 1063) when the upper end 1006 of the cleaner 1000 is above the lower end 1008. In some examples, the motor axis of rotation 1054 is positioned below a central longitudinal axis of the air treatment member (e.g., the cyclone axis of rotation 1063) when the upper end 1006 of the cleaner 1000 is above the lower end 1008.

The air treatment member 1060 is configured to remove particles of dirt and other debris from the airflow and/or otherwise treat the airflow. Any air treatment member or members known in the art may be used. For example, the surface cleaning apparatus may use one or more cyclones, bags, screens, physical filter media (e.g., foam, felt, HEPA) or the like.

As exemplified, the air treatment member 1060 has a central longitudinal axis 1063. As exemplified in FIGS. 33 to 43, the air treatment member 1060 may include a cyclone assembly having a single cyclonic cleaning stage 1184 with a single cyclone chamber 1062 with a cyclone axis of rotation 1063. The cyclone chamber 1062 and dirt collection region 1064 may be of any configuration suitable for separating dirt from an air stream and collecting the separated dirt, respectively. The cyclone chamber 1062 may be oriented in any direction. Optionally, as exemplified, the cyclone chamber 1062 may include an openable front door 1065.

The cyclone chamber 1062 may have a front end 1192*a* and a rear end 1192*b*, and a longitudinal cyclone axis 1226 extending from the front end 1192*a* to the rear end 1192*b*. Preferably, when the upper end 1006, of the hand vacuum cleaner 1000, is positioned above the lower end 1008, the cyclone axis 1226 is oriented generally horizontal. In other cases, however, the cyclone axis 1226 may extend at an angle to the horizontal, or may extend vertically. Accordingly, the cyclone chamber 1062 may be oriented in any direction.

In alternative embodiments, the cyclone assembly may include two or more cyclonic cleaning stages arranged in series with each other. Each cyclonic cleaning stage may include one or more cyclone chambers that may be arranged in parallel with each other and one or more dirt collection chambers, of any suitable configuration. The dirt collection chamber or chambers may be external to the cyclone chambers, or may be internal the cyclone chambers and configured as a dirt collection area or region within the cyclone chambers.

As exemplified, the rear end 1192*b* of the cyclone chamber 1062 may comprise a rear wall, while the front end 1192*a* may comprise an open end. The open end or the dirt outlet end 1192*a* may be in communication with a dirt collection region 1064 via a dirt outlet 1196. In the example shown, the dirt collection region 1064 is provided external to the cyclone chamber 1062, although in alternative embodiments the dirt collection region 1064 may be, e.g., a lower portion of the cyclone chamber 1062. The cyclone chamber 1062 and dirt collection region 1064 may be of any configuration suitable for separating dirt from an air stream and collecting the separated dirt, respectively.

As further exemplified, the cyclone stage 1184 may have a sidewall 1186, which may extend axially in the direction of the cyclone axis 1226. The cyclone chamber 1062 may be provided within the sidewall 1186. The sidewall 1186 may have any suitable shape or configuration. Optionally, as shown, the sidewall 1186 may have a cylindrical configuration defined by a constant diameter along the axial length of cyclone chamber 1062. Alternatively, the sidewall 1186 may have, for example, a frusto-conical shape wherein the diameter of the sidewall 1186 may increase along the axial length (e.g., sidewall 1186 may have a diameter which tapers from the rear end 1192*b* to the front end 1192*a*, along axis 1226).

Cyclone 1184 may also comprise a cyclone air inlet 1188, and a cyclone air outlet 1190. The cyclone air inlet 1188 and the cyclone air outlet 1190 may be any configuration known in the art and at any location known in the art. In the exemplified embodiments, the cyclone air inlet 1188 is defined by an aperture (e.g., a tangential air inlet) on the sidewall 1186, and is located near the rear end 1192*b* of the cyclone 1184. The air outlet 1190 is similarly defined by an aperture in the wall forming the rear end 1192*b* of the cyclone 1184 (e.g., a vortex finder, which may be part of a screen forming an outlet of the cyclone chamber 1062). It will be appreciated, however, that the air inlet 1188 and the air outlet 1190 may be provided at different locations along the cyclone 1184 and may be of different configurations.

Figure 3:
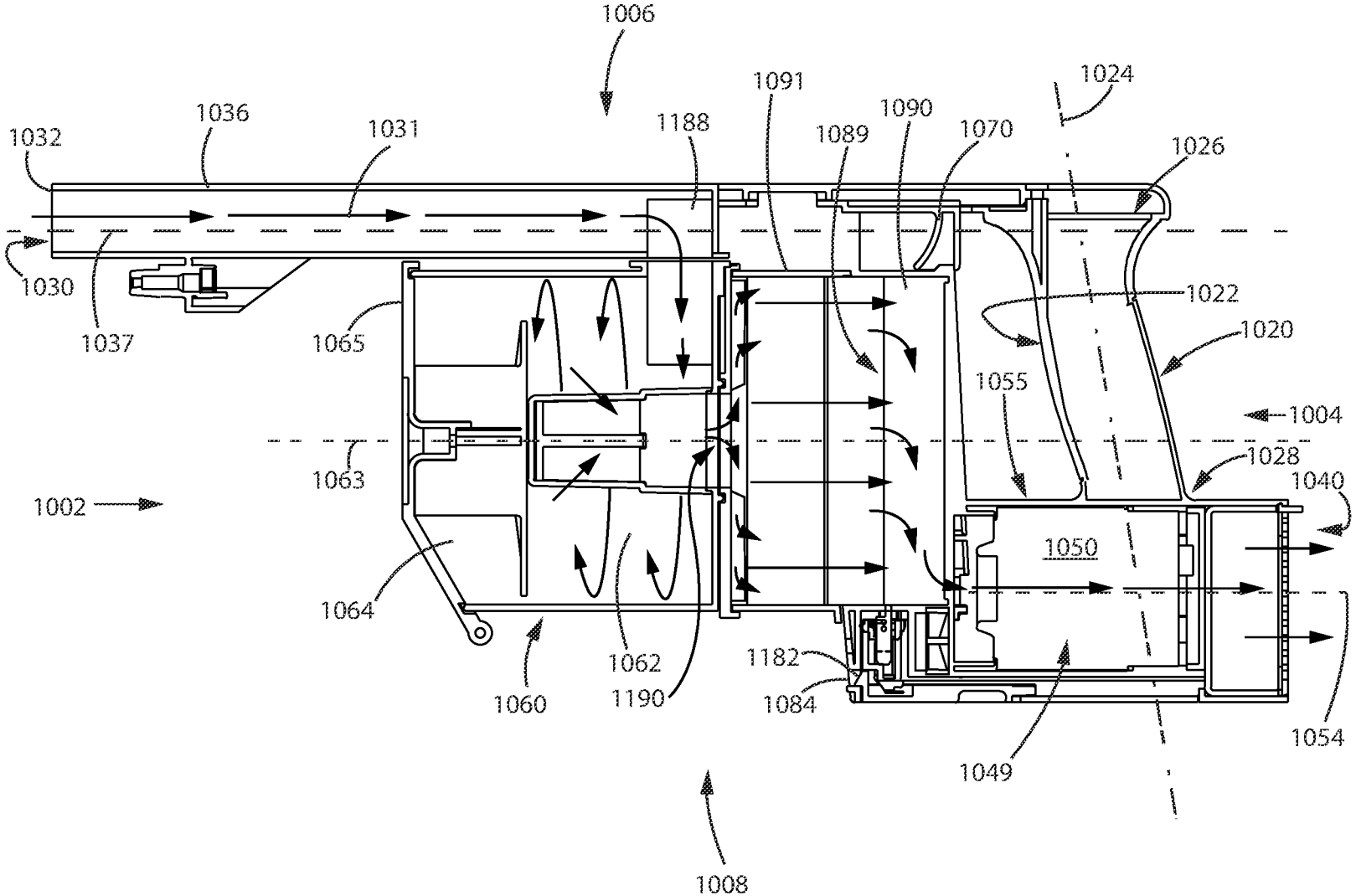
FIG. 3 is a cross-sectional view of the hand vacuum cleaner of FIG. 1 along line 3-3.

As exemplified by FIG. 3, the air inlet 1188 may be configured such that air flow, from the primary flow path 1031, may enter the cyclone chamber 1062 in a downward direction. Alternatively, the air inlet 1188 may be configured such that air may enter the cyclone chamber 1062 in any other suitable direction. Air received inside cyclone chamber 1062 may swirl there within, and in some cases, may swirl cyclonically about the cyclone axis 1226 such that dirt is dis-entrained from the air flow. Clean air may then exit the cyclone 1062 via an outlet passage 1194, which is in communication with the outlet 1190.

Referring again to FIGS. 33 to 43, as exemplified, a porous physical member 1198 may be provided adjacent the outlet passage 1194, and may be spaced from and face an inlet 1202 to the passage 1194. Preferably, the porous physical member 1198 may be mounted to the cyclone 1184 via legs 1204. In some examples, a screen may be mounted around the legs 1204. The porous physical member 1198 may be of any design configuration, and may be mounted to the cyclone 1184 using any support mounting configuration.

As further exemplified, the air treatment apparatus 1060 may also include a plate 1208 located at the front end 1192*a* of the cyclone chamber 1062. The plate 1208 may be defined by an outer plate perimeter 1218. When the upper end 1006, of the hand vacuum cleaner 1000, is positioned above the lower end 1008, the plate 1208 may include an upper end 1208*a* and a lower end 1208*b*. Preferably, as shown, the plate 1208 may also include a cyclone chamber facing face 1210 at the front end 1192*a* of the cyclone chamber 1062 and facing the rear end 1192*b* of the cyclone chamber, and an opposed dirt collection chamber face 1212, facing the dirt collection chamber 1064. Optionally, the cyclone face 1210 and the dirt face 1212 are planar. As exemplified, the cyclone face 1210 and the dirt face 1212 may be oriented perpendicular to the cyclone axis 1226.

As shown in the exemplified embodiments, the cyclone face 1210, of plate 1208 may abut or be in a near abutting relationship with the porous physical member 1198. In other cases, the cyclone face 1210 may be axially spaced from the porous physical member 1198, along the longitudinal axis 1226, by any variable distance.

As further exemplified in FIGS. 1 to 5, hand vacuum cleaner 1000 may also include a pre-motor filter 1090 that may be provided in a pre-motor filter housing 1091. Pre-motor filter housing 1091 may be provided in the air flow path downstream of the air treatment member 1060 and upstream of the suction motor 1050. Pre-motor filter housing 1091 may be of any suitable construction, including any of those exemplified herein. Pre-motor filter 1090 may be formed from any suitable physical, porous filter media and may have any suitable shape, including the examples disclosed herein with respect to a removable pre-motor filter assembly. For example, the pre-motor filter may be one or more of a foam filter, felt filter, HEPA filter, other physical filter media, electrostatic filter, and the like. Optionally, the pre-motor filter housing may be openable to allow the pre-motor filter to be cleaned and/or replaced.

The axis 1054 of the suction motor 1050 may extend through a volume defined by the outer perimeter of the pre-motor filter (e.g., if the pre-motor filter is in the shape of a longitudinally extending cylinder having an open interior volume such that the pre-motor filter is annular in a plane transverse to the longitudinal direction) and may extend through a portion of the pre-motor filter 1090 (e.g., if the pre-motor filter has a solid interior as exemplified). Accordingly, as exemplified in FIG. 20, the axis 1054 of the suction motor 3050 extends through a volume defined by the outer perimeter of the pre-motor filter and through a portion of the pre-motor filter 3090. After passing through the pre-motor filter 1090, air may travel, e.g., generally rearwardly from the pre-motor filter 1090 to an inlet end of the suction motor 1050. An advantage of this arrangement is that, by promoting air to travel in this manner, the need for air flow direction changes between an air outlet of the pre-motor filter 1090 and the suction motor 1050 may be reduced or eliminated, thereby reducing backpressure and/or air flow losses through this portion of the hand vacuum cleaner. It will be appreciated that, in some embodiment, the pre-motor filter may be positioned above or below the axis 1054 of the suction motor 1050.

As exemplified, hand vacuum cleaner 1000 may also include a post-motor filter 1080. The post-motor filter 1080 may be contained within a post-motor filter housing 1082. Optionally, the post-motor filter housing 1082 may be openable to allow the post-motor filter 1080 to be cleaned and/or replaced.

The post-motor filter 1080 can be provided in the air flow path downstream of the suction motor 1050 and upstream of the clean air outlet 1040. Post-motor filter 1080 may be formed from any suitable physical, porous filter media and having any suitable shape, including the examples disclosed herein. In alternative embodiments, the post-motor filter may be any suitable type of filter such as one or more of a foam filter, felt filter, HEPA filter, other physical filter media, electrostatic filter, and the like.

As with the pre-motor filter 1090, the axis 1054 of suction motor 1050 may extend through a volume defined by the outer perimeter of the post-motor filter 1080 and may also pass through a portion of the post-motor filter 1080. Air passing through the suction motor 1050 may then travel rearwardly through the post-motor filter 1080 and out the clean air outlet 1040. This may further reduce backpressure and/or air flow losses through this portion of the hand vacuum cleaner 1000. It will be appreciated that, in some embodiment, the post-motor filter 1080 may be positioned above or below the axis 1054 of the suction motor 1050.

In the illustrated embodiment, the dirty air inlet 1030 of the hand vacuum cleaner 1000 is the inlet end 1032 of an inlet conduit or passage 1036. Optionally, inlet end 1032 of the conduit 1036 can be used as a nozzle to directly clean a surface. Alternatively, or in addition to functioning as a nozzle, inlet conduit 1036 may be connected or directly connected to the downstream end of any suitable accessory tool such as a rigid air flow conduit (e.g., an above floor cleaning wand), a crevice tool, a mini brush, and the like. Accordingly, an assembly comprising a floor cleaning head, a rigid air flow conduit that is moveably mounted to the floor cleaning head at an inlet end of the rigid air flow conduit, and the hand vacuum cleaner disclosed herein, may be provided.

In some examples, inlet conduit or passage 1036 has a longitudinally extending axis 1037, and the longitudinally extending axis 1037 intersects an upper end 1026 of the handle 1020 (see for example FIG. 3).

The hand vacuum cleaner also includes a clean air outlet at the outlet end of the airflow path. The clean air outlet may be located at any position on the surface cleaning apparatus. As exemplified, air may exit the hand vacuum cleaner 1000 via a grill located in a lower portion of the main body (e.g., via an air outlet 1040 provided in the rear end of the main body or a sidewall adjacent the rear end). As shown, the clean air outlet 1040 is positioned at the rear of the post-motor filter housing 1082. Alternately, air may exit through an alternate portion of the hand vacuum cleaner, such as an upper portion of the main body (e.g., as shown in FIGS. 29-32).

The handle 1020 may allow a user to control and wield the hand vacuum cleaner 1000. The handle 1020 may include a hand grip portion 1022 that can be grasped by a user's hand when using hand vacuum cleaner 1000. An empty space or void forward of the handle 1020 allows a user's fingers to wrap around the hand grip portion 1022. The empty space or void may be provided between the hand grip portion 1022 and one or more cleaning stage (e.g., the pre-motor filter 1090). The pre-motor filter 1090 may operate more efficiently with a large surface extent (e.g., downstream and/or rear surface area) and positioning the finger receiving area between the pre-motor filter 1090 and the hand grip portion 1022 may allow the pre-motor filter 1090 to have a larger surface extent than otherwise.

As exemplified in FIG. 1, the handle may be a pistol grip handle and may be provided at a rearward portion of the hand vacuum cleaner. Optionally, the handle may be the rearward most part of the hand vacuum cleaner.

As exemplified, power may be supplied to the suction motor 1050 and other electrical components of the hand vacuum cleaner 1000 from an onboard power source which may include, for example, one or more batteries 1150 or other energy storage device. The energy storage members 1150 may be cylindrical members (as depicted) or of other shapes, such as planar or sheet members (e.g., planar members arranged in a vertical stack with their planar faces extending horizontally, or arranged in a horizontal stack with their planar faces extending vertically).

As exemplified in FIGS. 4 to 13 and 46 to 50, the energy storage members 1150 may be arranged in at least one group 1057. Grouping the energy storage members 1150 may facilitate balancing, housing, charging, and/or removing the energy storage members 1150. In some examples, a grouped plurality of energy storage members 1057 has a lower end 1151 and an upper end 1153.

A group of energy storage members 1150 may be positioned to, e.g., facilitate a well-balanced cleaner 1000 (e.g., positioned to balance a component such as the motor 1050 across a centra line or handle axis, as discussed below), promote good hand-feel, and/or promote a compact design for the cleaner 1000. As exemplified in FIGS. 46 to 50 a grouped plurality of energy storage members **1057*a* may be positioned on a lateral side of the fan and motor assembly 1049. Positioning the group 1157*a* near the fan and motor assembly 1049 may keep heavy and/or hot components of the cleaner 1000 together (e.g., to balance one another and/or facilitate cooling solutions). The group 1157*a* and the fan and motor assembly 1049 may be balanced across a centerline 1047 of the cleaner 1000 (e.g., a centre line that extends vertically in a vertical plane that extends through the handle) and/or an axis 1024 of the handle 1020, as exemplified in FIG. 47**.

In the illustrated example of FIGS. 46 to 50, the energy storage members 1150 are arranged as a single group of energy storage members 1057*a*. The plurality of energy storage members 1057*a* is provided on the first later side 1051 of the fan and motor assembly 1049.

Figure 10:
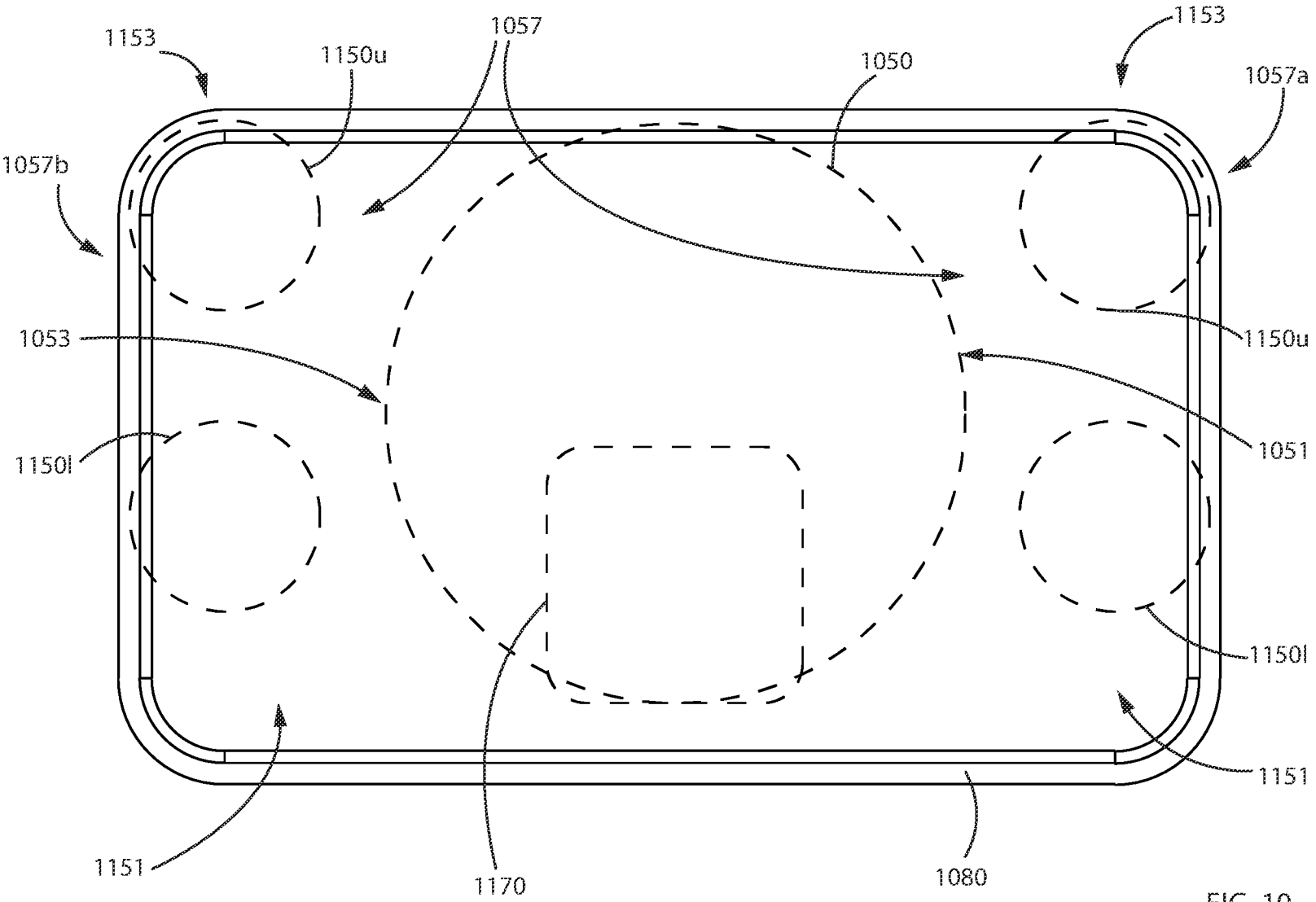
FIG. 10 is a rear view of the energy storage chamber, suction motor and post-motor filter of FIG. 8.

As exemplified in FIG. 10, the energy storage members 1150 may be arranged in a plurality of groups. The energy storage members 1150 may be arranged in a first plurality of energy storage members 1057*a* (i.e., a first group) and a second plurality of energy storage members 1057*b* (i.e., a second group), which may be separate (e.g., separately housed and/or spaced) from the first group 1057*a*. A plurality of groups may allow the groups to balance each other and/or allow for one or more components or parts of components to be received between them. For example, the first plurality of energy storage members 1057*a* may be on the first lateral side 1051 of the fan and motor assembly and the second plurality of energy storage members 1057*b* may be provided on the second lateral side 1053 of the fan and motor assembly.

As in the illustrated example, the energy storage members 1150 may be arranged such that there is an absence of energy storage members 1150 between the lower ends 1151 of each plurality of energy storage members (e.g., a void 1110) where the energy storage members 1150 are arranged in a plurality of groups. This absence therebetween may facilitate positioning other components (e.g., motor 1050) therebetween.

The energy storage members 1150 may be arranged such that the upper end 1153 of at least one grouped plurality of energy storage members (e.g., the first plurality 1057*a* and/or the second plurality 1057*b*) is positioned at a lower part of the cleaner 1000. Such a positioning may allow the handle 1020 to be above the members 1150, contribute to a better balance of the cleaner 1000, and/or contribute to a better hand-feel of the cleaner. For example, the upper end 1153 of at least one grouped plurality of energy storage members (e.g., the first plurality 1057*a* and/or the second plurality 1057*b*) may be positioned below the central longitudinal axis of the air treatment member (e.g., the cyclone axis of rotation 1063) when the upper end 1006 of the cleaner 1000 is above the lower end 1008.

The energy storage members 1150 may be arranged such that a front end 1155 (FIG. 11) of at least one grouped plurality of energy storage members (e.g., the first plurality 1057*a* and/or the second plurality 1057*b*) is positioned in a rearward part of the cleaner 1000. Such a positioning may allow one or more components of the cleaner 1000, such as the handle 1020, to be above the members 1150, contributing to a better balance of the cleaner 1000, and/or contribute to a better hand-feel of the cleaner. For example, the front end 1155 of at least one plurality of energy storage members (e.g., the first plurality 1057*a* and/or the second plurality 1057*b*) may be positioned rearwardly of at least one cleaning stage or two or more cleaning stages (e.g., rearwardly of an upstream cleaning stage, such as rearwardly of a front end 1089 of the pre-motor filter 1090 as exemplified in FIG. 3).

As exemplified in FIGS. 4 to 13 and 46 to 50, one or more energy storage members 1150 can be contained in an energy storage chamber 1100. The energy storage members 1150 function as onboard power sources for the hand vacuum cleaner 1000. In general, the power sources may be any suitable device, including, for example one or more batteries. Optionally, the batteries may be rechargeable or may be replaceable, non-rechargeable batteries.

Optionally, power may be supplied to the hand vacuum cleaner 1000 by an electrical cord connected to the hand vacuum cleaner 1000 (not shown) that can be connected to a standard wall electrical outlet. The power from the electrical cord may also serve to recharge the batteries 1150. In some instances, the batteries 1150 may be recharged while the vacuum cleaner 1000 is operational.

The energy storage chamber 1100 may include any suitable number of energy storage members 1150, and may include, for example, lithium ion battery cells. Any number of cells may be used to create a power source having a desired voltage and current, and any type of battery may be used, including NiMH, alkaline, and the like. Energy storage chamber 1100, which may be referred to as a battery pack, may be electrically connected to the hand vacuum cleaner 1000 by any means known in the art.

The battery pack 1100 may have a power coupling for supplying power to (e.g., charging) the cells 1150. Any suitable power coupling may be used, for example, a female coupling configured to receive a male coupling of an electrical cord that is connectable to a source of AC or DC power, such as a household power socket.

Figure 4:
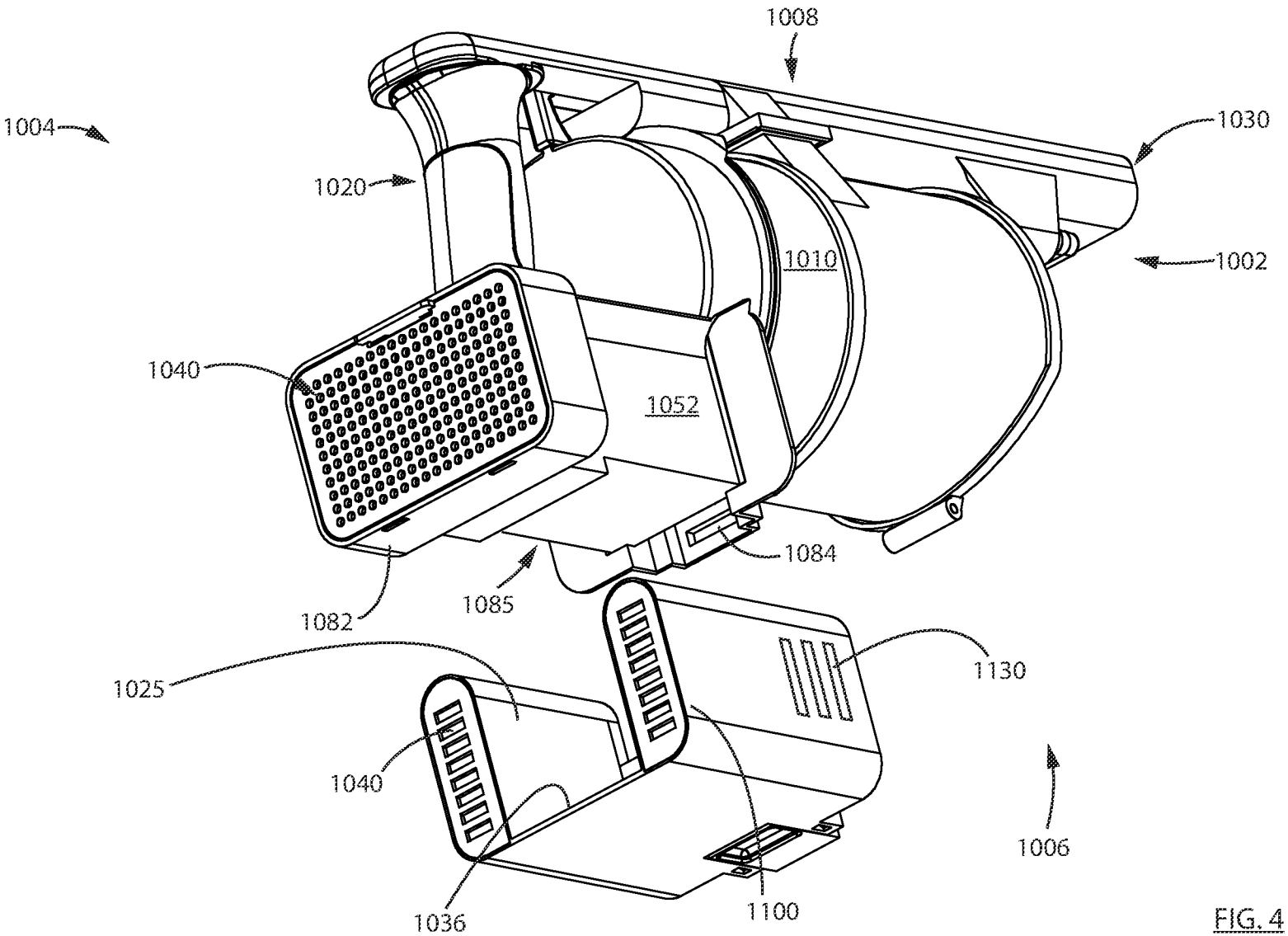
FIG. 4 is a bottom rear perspective view of the hand vacuum cleaner of FIG. 1 with an energy storage chamber removed.
Figure 5:
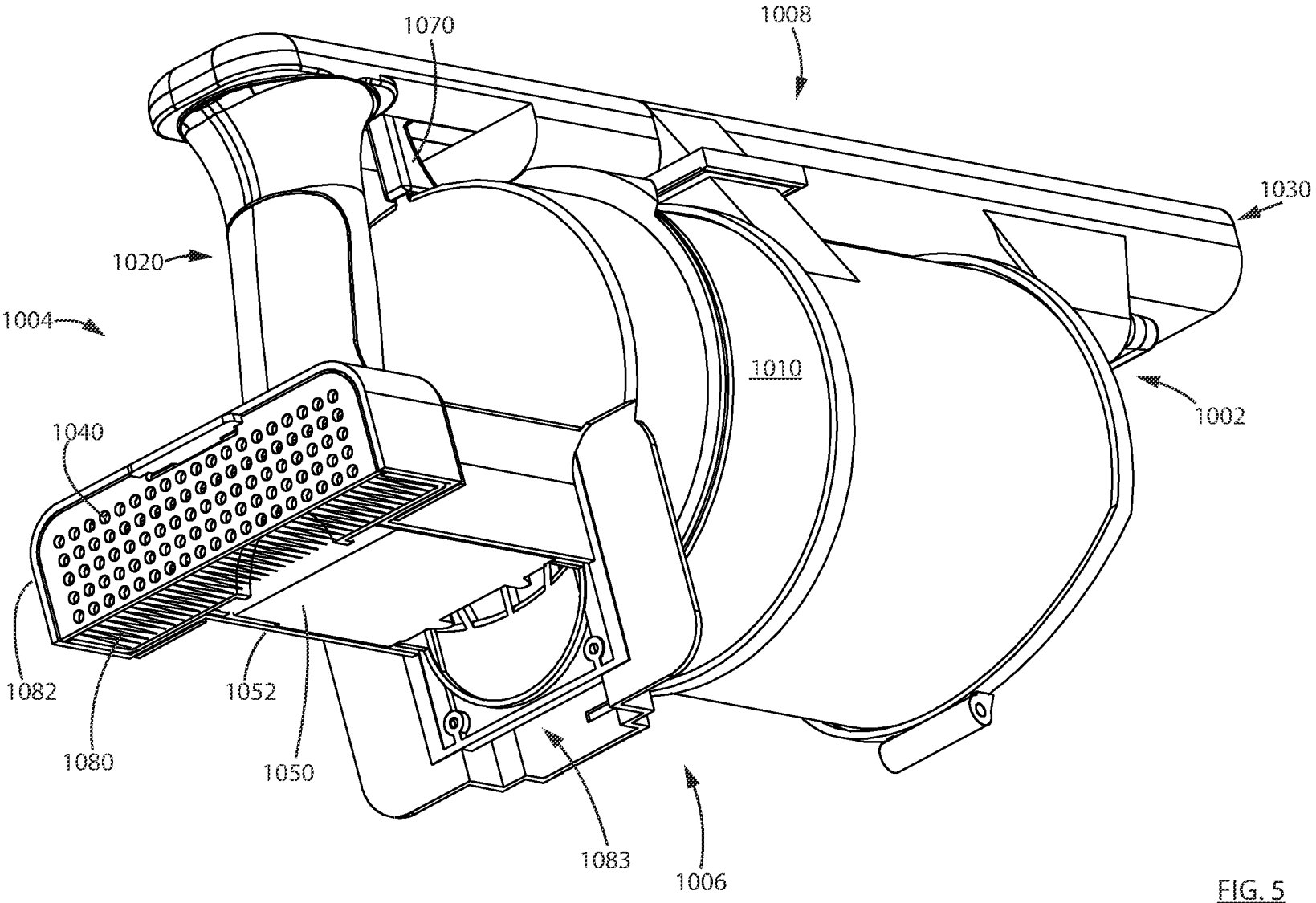
FIG. 5 is a bottom rear perspective view of the hand vacuum cleaner of FIG. 1 with the energy storage chamber removed and a section of the suction motor housing and filter housing removed.
Figure 6:
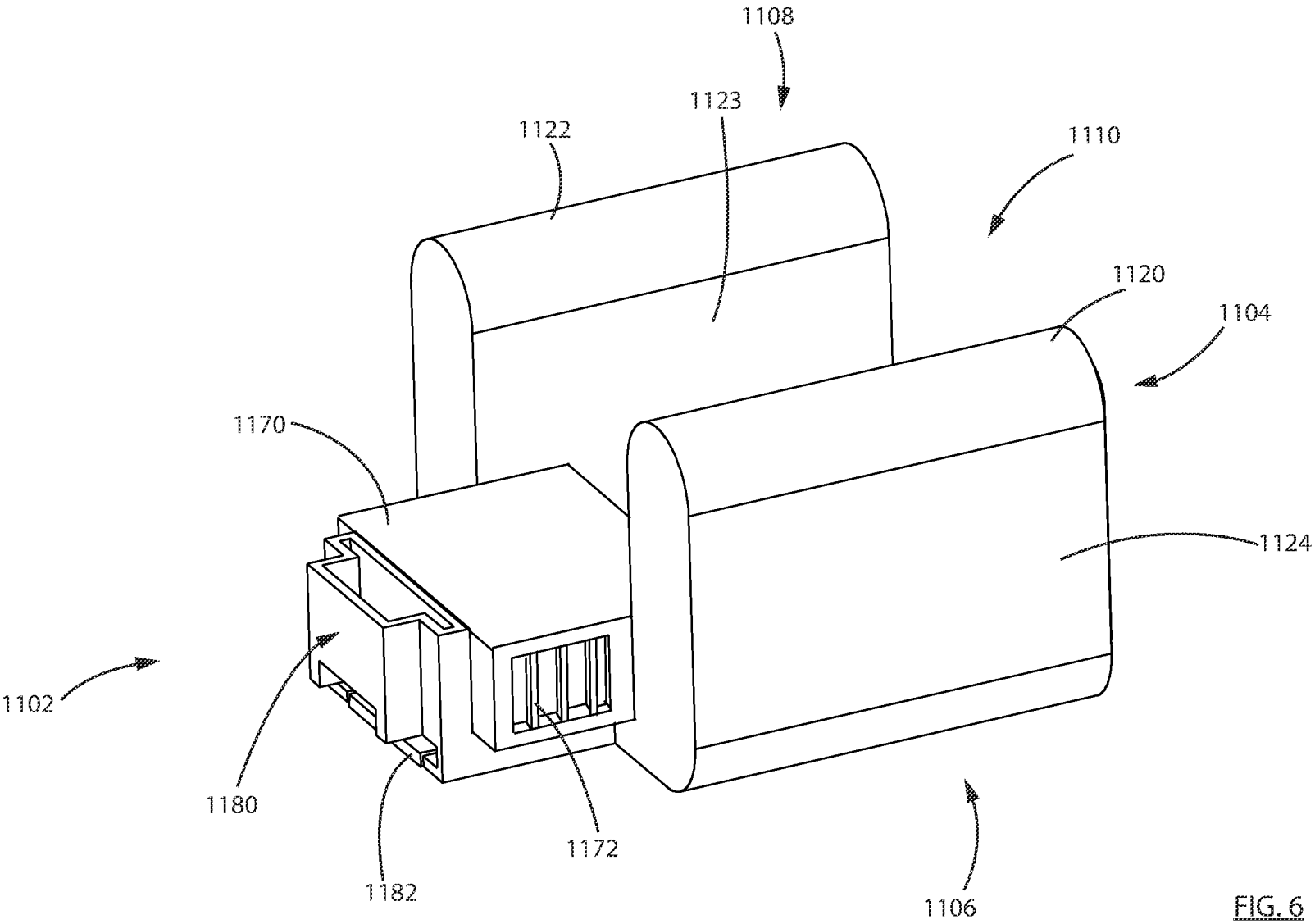
FIG. 6 is a top front perspective view of an energy storage chamber for a hand vacuum cleaner in accordance with an embodiment.
Figure 48:
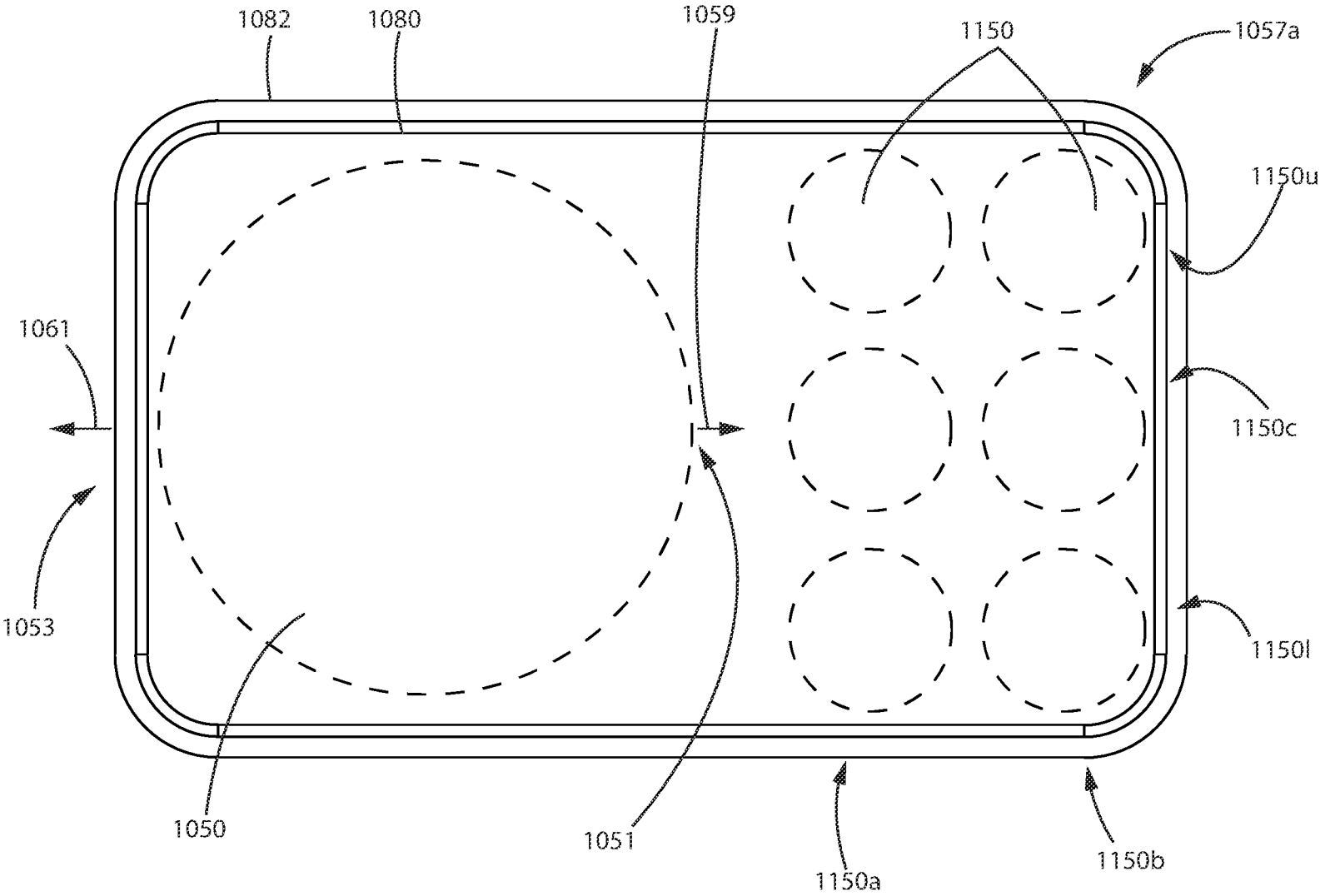
FIG. 48 is a rear view of the energy storage chamber, suction motor and post-motor filter of the hand vacuum cleaner of FIG. 46.

Optionally, as exemplified in FIGS. 4 and 48, the battery pack 1100 may be removable from the rest of the hand vacuum cleaner 1000 using any mechanism known in the art. In alternative embodiments, the energy storage chamber 1100 may be fixed to the main body 1010 and may not be removable. In such a case, the energy storage chamber 1100 may be openable to allow the batteries to be replaced.

Dirt Outlet for an Air Treatment Member

The following is a discussion of a dirt outlet and dirt collection chamber construction, wherein each may be used by itself or in combination with each other, and/or with one or more other aspects of this disclosure.

As exemplified, the dirt collection chamber may be configured so that it is positioned external to and adjacent to the cyclone chamber, and on the opposite side of the plate 1208 from the cyclone chamber. Positioning the dirt collection chamber adjacent the cyclone chamber (e.g., rather than surrounding the cyclone chamber) may help reduce the overall size (width) of the hand vacuum.

As exemplified, the dirt outlet to the dirt chamber is formed as a gap between at least the upper portion of the plate, and the cyclone sidewall (or a sidewall of the dirt collection chamber). An advantage of this configuration is that dirt and debris-entrained in air flow inside of the cyclone chamber—may be ejected (e.g., "spit-out") through the gap and into, the dirt chamber. If all or a majority of the gap is provided in an upper end of the dirt collection chamber (when the surface cleaning apparatus is in an in use position—e.g., the upper end is above the lower end), then dirt may then fall downwardly inside of the dirt chamber to collect (e.g., aggregate) in the lower end of the chamber. In this manner, the dirt outlet configuration may help improve the dirt separation efficiency of the air treatment member.

Referring now to FIGS. 33 to 43, as exemplified, dirt chamber 1064 may be located external to cyclone chamber 1062, and between the dirt chamber face 1212 of plate 1208, and the front wall 1065. In this arrangement, the dirt outlet 1196 may be defined by a gap 1222, formed at least between the upper end 1208*a* of plate 1208 and the cyclone sidewall 1186. Dirt may be ejected from cyclone 1062 into the upper portion of dirt chamber 1064, via gap 1222, and may accumulate inside of the dirt chamber 1064.

The gap 1222 may extend around part or all of the perimeter 1218 of plate 1208. In one embodiment, as exemplified by FIGS. 41 to 43, the gap is not provided at the lower end of the plate 1208. In such a case, only an upper gap portion 1222*a* may be provided (the upper gap portion 1222*a* may be defined between the upper end 1208*a* of plate 1208, and the cyclone sidewall 1186 and/or the dirt collection chamber sidewall). Alternately, the gap 1222 may extend from upper gap portion 1222*a* part way around the side of the plate 1208 towards the lower end of the plate 1208. As exemplified in FIGS. 41 to 43, the lower end 1208*b* of plate 1208 may be in abutting, or near-abutting, engagement with cyclone sidewall 1186. Accordingly, the gap 1222 is provided around most of plate 1208 other than the lower portion 1208*b* of plate 1208.

In another embodiment, as exemplified by FIGS. 33 to 40, gap 1222 may extend around all or most of the plate 1208. In such a case, a lower gap may be provided. The lower gap portion 1222*b* may be defined between the lower end 1208*b* of plate 1208, and the cyclone sidewall 1186 and/or the dirt collection chamber sidewall. If the gap 1222 extends around all of perimeter 1218, then gap 1222 may comprise an annular formation.

Alternately, the gap 1222 may comprise an upper gap portion 1222*a* and a lower gap portion 1222*b*.

If more than just an upper gap 1222*a* is provided, then the upper gap portion 1222*a* may have a larger radial width 1224 than other portions of the gap 1222. As used herein, the radial width 1224 may refer to the radial distance between the perimeter 1218 of plate 1208, and the cyclone sidewall 1186 or dirt collection chamber sidewall. For example, as exemplified in FIGS. 36 and 39, the gap 1222 may have a generally constant radial width 1224 except of the larger radial width 1224 at upper end 1208*a* of plate 1208.

An advantage of this configuration is that the upper gap 1222*a* may define a larger dirt outlet 1196 for receiving a larger quantity of dirt ejected from the cyclone chamber 1062 and/or larger dirt particles.

Figure 36:
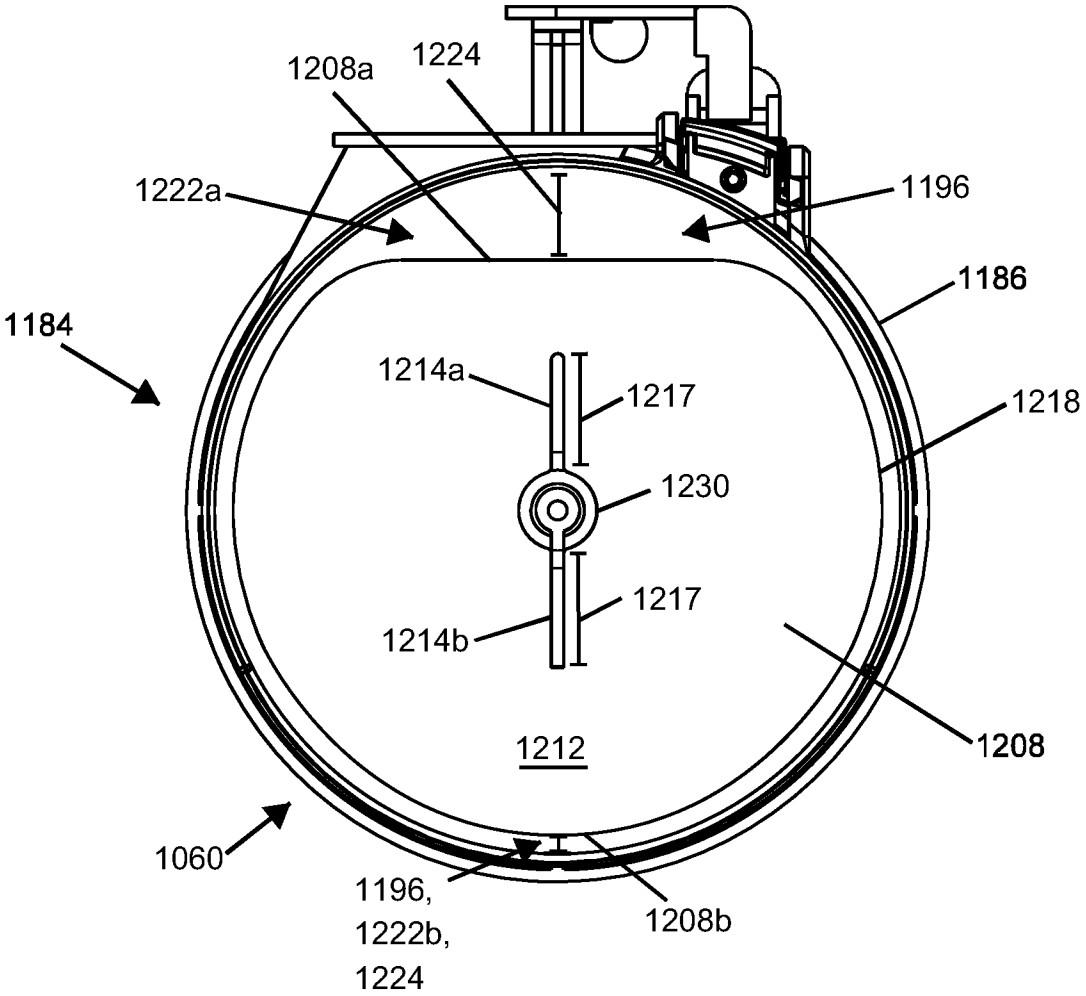
FIG. 36 is a cross-sectional view of the air treatment member of FIG. 33, taken along line 36-36 of FIG. 33.
Figure 37:
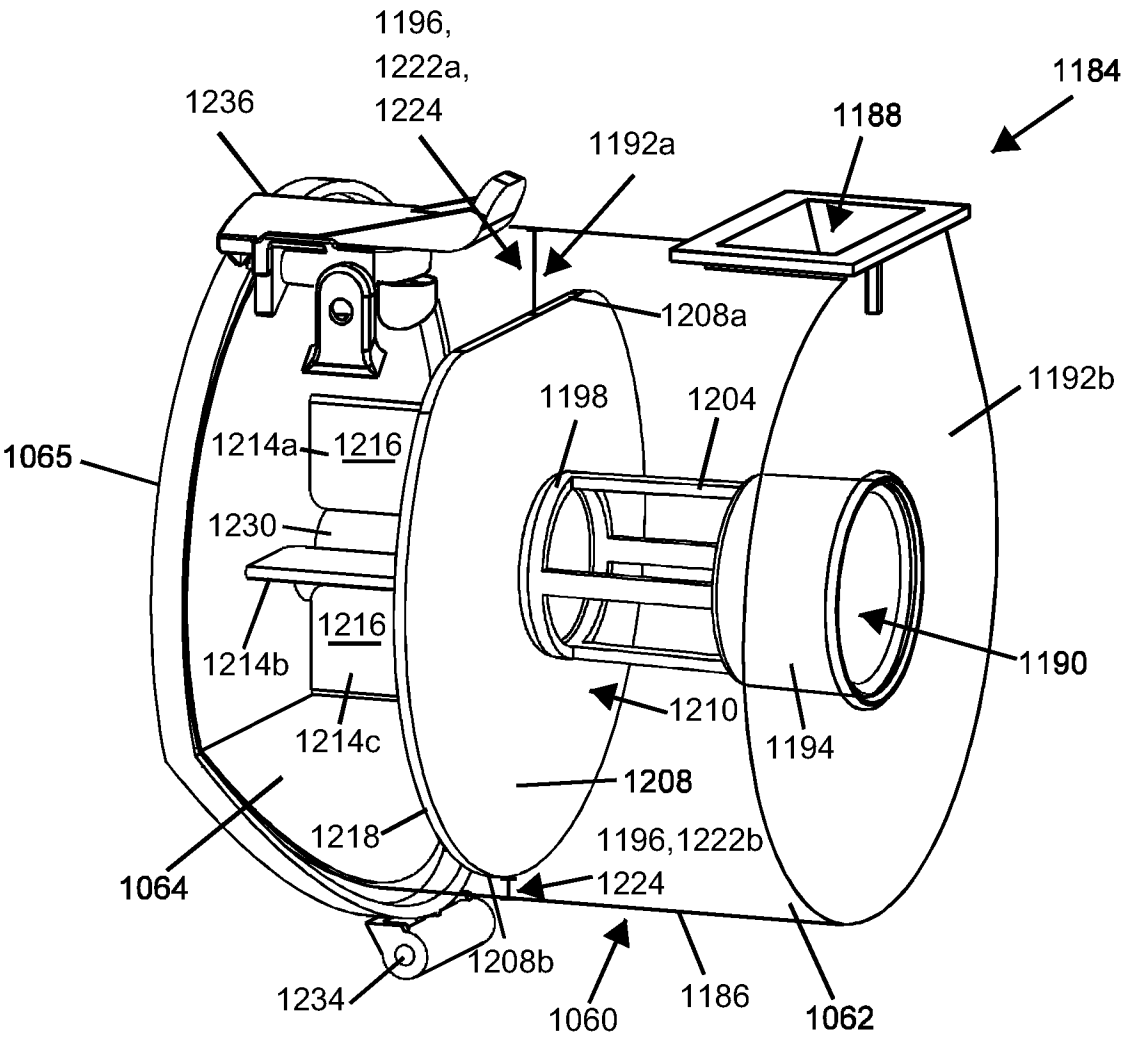
FIG. 37 is a side rear perspective isolation view of the air treatment member of the hand vacuum cleaner of FIG. 1, in accordance with another embodiment.
Figure 38:
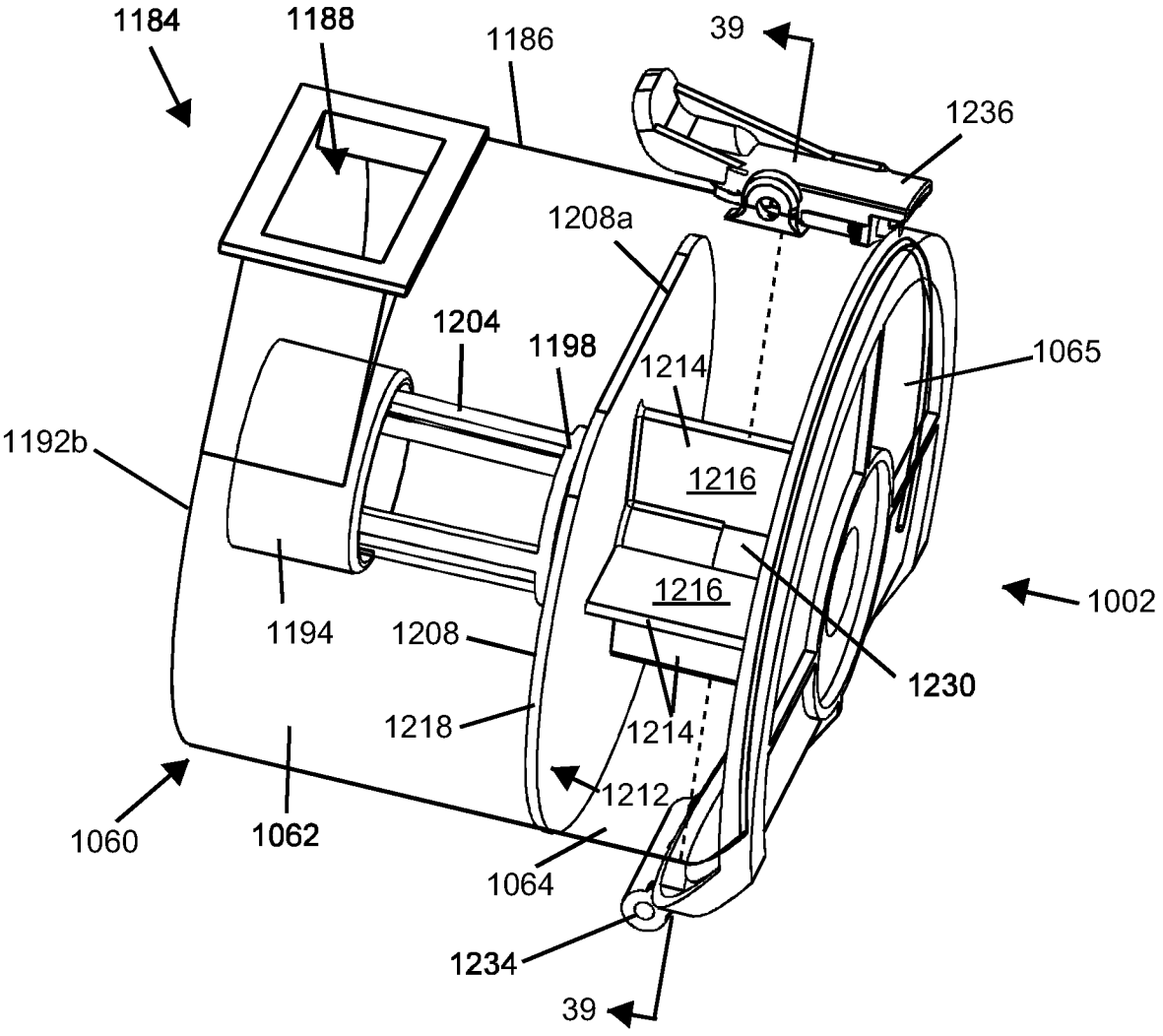
FIG. 38 is a top front perspective view of the air treatment member of FIG. 37.
Figure 39:
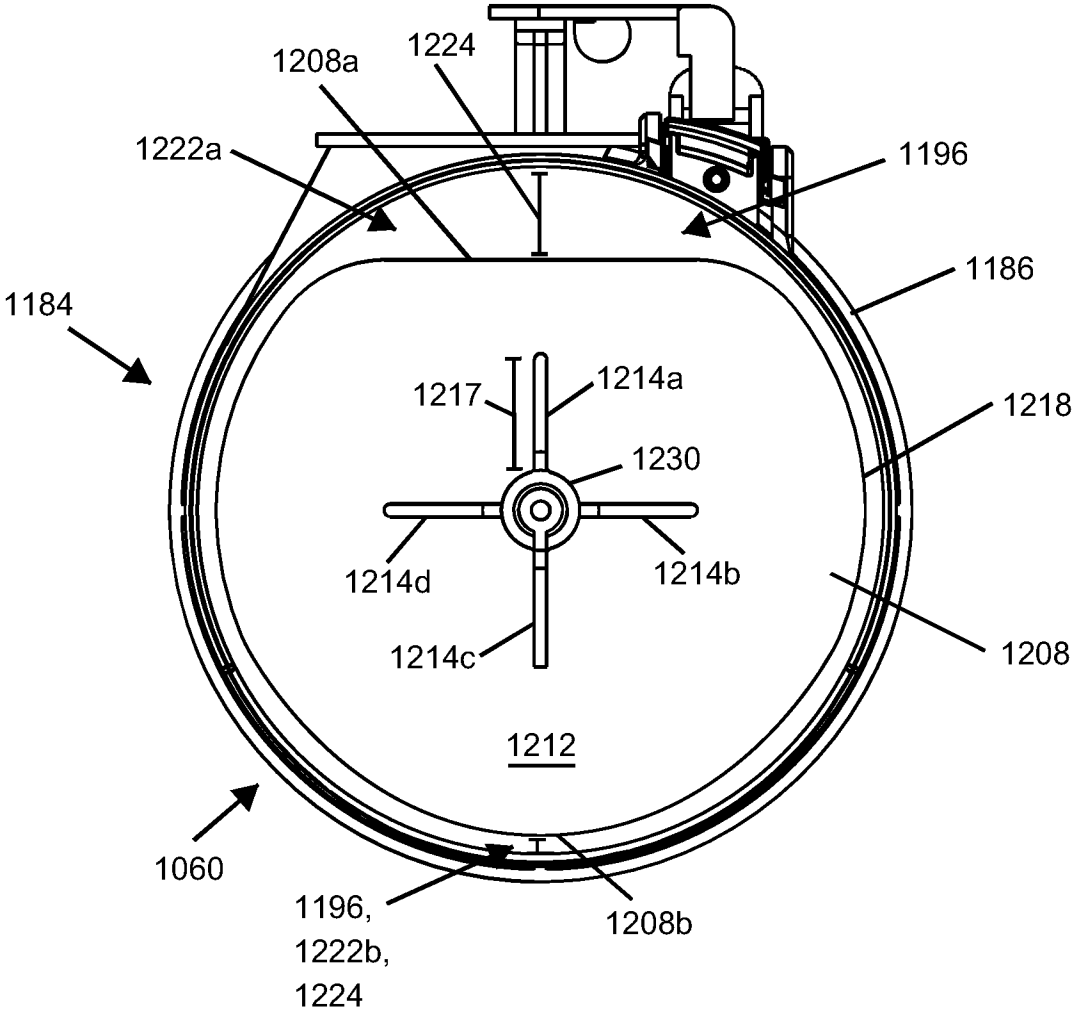
FIG. 39 is a cross-sectional view of the air treatment member of FIG. 37, taken along the line 39-39 of FIG. 38.
Figure 40:
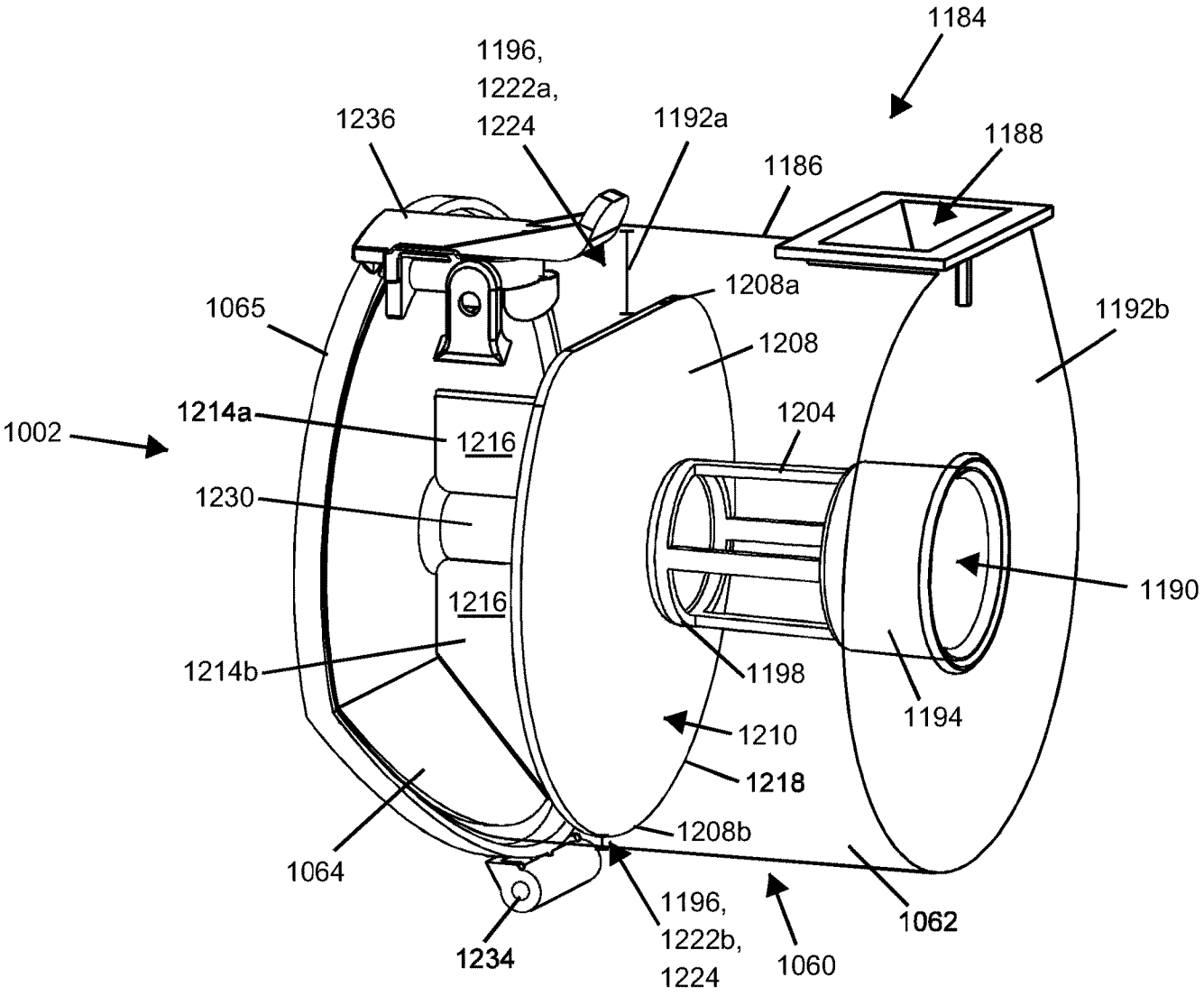
FIG. 40 is a side rear perspective isolation view of the air treatment member of the hand vacuum cleaner of FIG. 1, in accordance with yet another embodiment.
Figure 41:
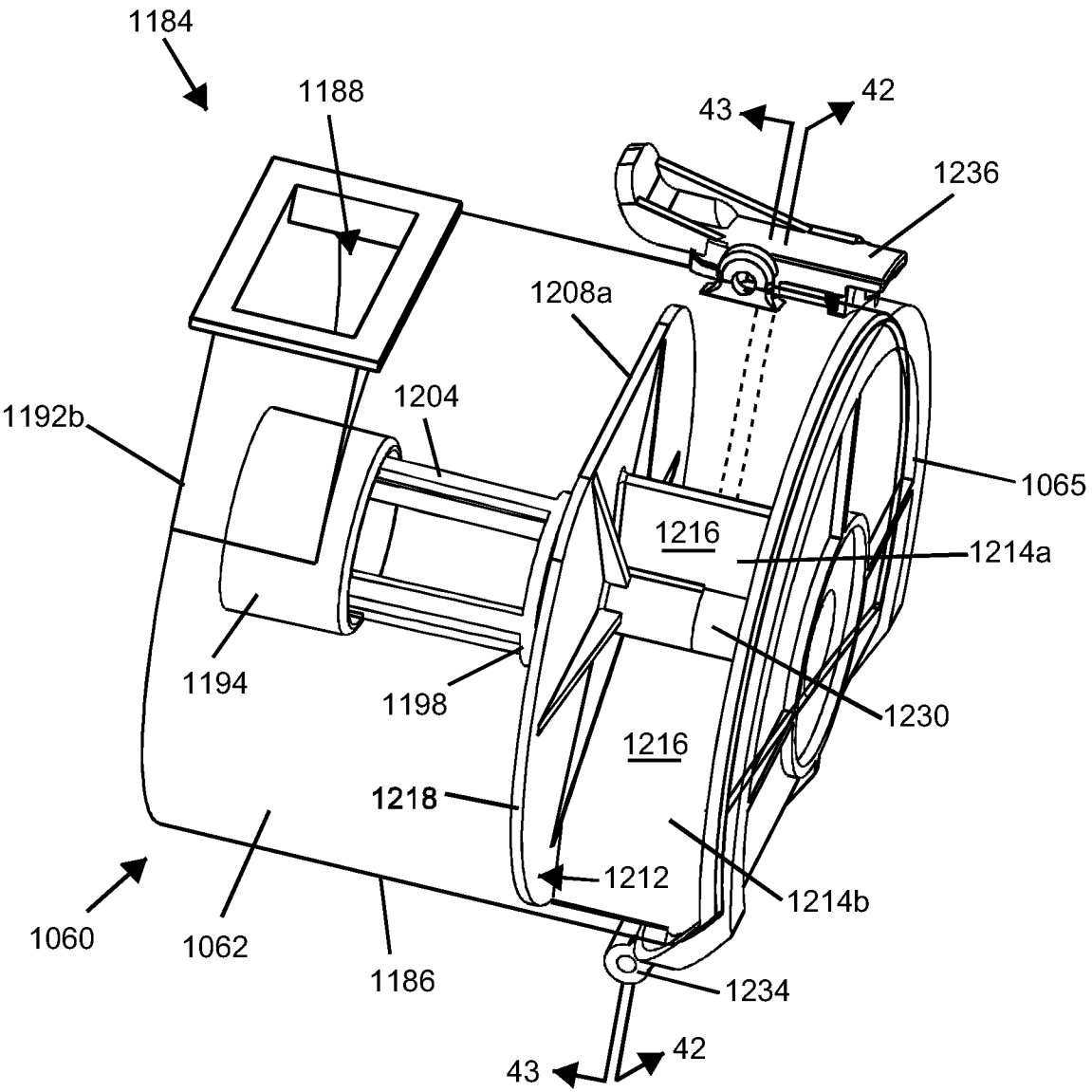
FIG. 41 is a top front perspective view of the air treatment member of FIG. 40.
Figure 42:
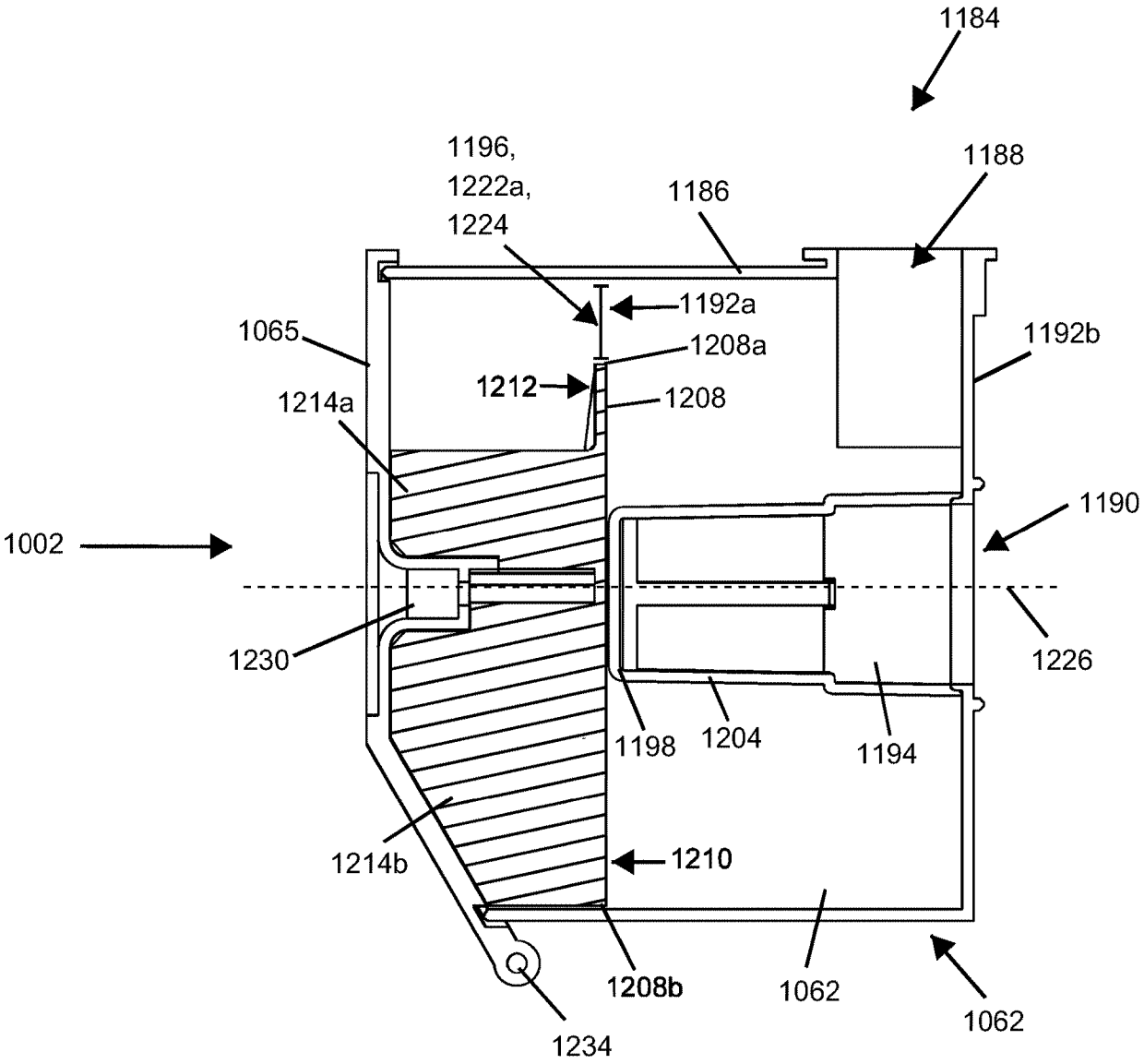
FIG. 42 is a cross-sectional view of the air treatment member of FIG. 40, taken along the line 42-42 of FIG. 41.

For instance, as best exemplified in FIGS. 36 and 39, the radial width 1224 may be greater at the upper gap portion 1222*a* relative to the lower gap portion 1222*b*. Accordingly, larger dirt particles, e.g., popcorn, may enter the dirt chamber 1064 through the widened upper gap portion 1222*a*, and may be prevented from re-entering the cyclone chamber through the lower gap 1222*b* due to the smaller radial width of the lower gap 1222*b*.

The gap 1222 between the upper end of plate 1208 and the cyclone sidewall 1186 may be formed in any suitable manner. For instance, as exemplified in FIGS. 36, 39 and 43, the perimeter 1218 of plate 1208 may include two discontinuities at the upper portion 1208*a* of plate 1208. For instance, the discontinuities may result from a segment of the upper portion 1208*a* of plate 1208 being removed. Alternatively, the gap may be formed from sidewall 1186 diverging from the upper end 1208*a* of plate 1208 (e.g., the sidewall 1186 may not be cylindrically shaped).

The radial width 1224 of gap 1222 may be varied in any suitable manner in order to configure the upper gap 1222*a* to be wider than the lower gap 1222*b*. For instance, as exemplified in FIGS. 36 and 39, and as previously described, a segment of plate 1208 may be removed from only the upper end 1208*a* of plate 1208. In this manner, the radial width 1224 of the upper gap portion 1222*a* is made greater than the lower gap portion. Alternatively, the plate 1208 may be positionally offset inside the cyclone 1184 such that the upper end 1208*a* of plate 1208 is more distally located from the cyclone sidewall 1186 than the lower end 1208*b*. In still other alternative embodiments, the sidewall 1186 may be configured (e.g., shaped) to diverge more greatly from the upper end 1208*a* of plate 1208, than the lower end 1208*b*. The plate 1208 may also be otherwise shaped or configured such that the radial width 1224 of the upper gap is greater than the lower gap 1222*b*.

In alternative embodiments, the gap 1222 may not extend continuously around the plate 1208, but may comprise discontinuous gap portions. For instance, the side walls of plate 1208 may be in an abutting, or near-abutting, engagement with the cyclone wall 1186, such that gap 1222 only comprises the upper gap portion 1222*a* and the lower gap portion 1222*b*.

Hair Wrap Members

The following is a discussion of hair wrap members that may be provided in a dirt collection chamber, which may be used by itself or in combination with each other, and/or with one or more other aspects of this disclosure.

As discussed previously, a dirt collection chamber may have a plate 1208 having one face that faces the dirt collection chamber (the dirt collection chamber face 1212) and an opposed end wall (which may be front wall 1065 of the air treatment member of a surface cleaning apparatus). The hair wrap members are located between the dirt collection chamber face 1212 and the front wall 1065.

The plate may be supported in position by any means known in the art. For example, the plate may be supported in position by a column support 1230 that extends between the front wall 1065 and the plate 1208 (see for example FIG. 33).

Optionally, the plurality of support members may be evenly spaced apart around an axially extending central region of the dirt collection chamber. The hair wrap members may extend outwardly the same amount or varying amounts from the central region. Optionally, the hair wrap members may be recessed inwardly from the perimeter 1218 of plate 1208.

Debris (e.g., hair) which enters the dirt collection chamber 1064 may wrap around column support 1230. This may make it difficult to empty the dirt collection chamber. For example, the hair may wind tightly around column support 1230 and may trap other debris. If the column support 1230 is secured at one end to end wall 1065 and at the other end to plate 1208, then a user cannot slide the hair off of the column support 1230. An advantage of the hair wrap members is that hair, which enters the dirt collection chamber 1064, will wrap around the hair wrap members. This renders the hair to be more easily removable. For instance, an object (e.g., a user's finger) may be inserted in the gaps provided between spaced apart hair wrap members and may be used to manually remove the debris. This avoids designs wherein debris wraps tightly around a single support member and may be otherwise difficult to remove.

FIGS. 33 to 45 exemplify three different embodiments of hair wrap members 1214. As exemplified therein, the central region is provided with a column support 1230 that extends between plate 1208 and front wall 1065. Alternately, or in addition, the hair wrap members 1214 may be connected to one or both of the plate 1208 and the front wall 1065. For example, the hair wrap members 1214 may extend axially, e.g., along cyclone axis 1226, between front wall 1065 and the dirt chamber face 1212 of plate 1208. The hair wrap members 1214 may extend axially by any suitable distance. Accordingly, the plate 1208 may be supported inside of the dirt collection chamber by a plurality of hair wrap members 1214, which extend axially from the end wall 1065 of the dirt collection region to the plate 1208. As the hair wrap members may support the plate, the hair wrap members may also be referred to as support members 1214. It will be appreciated that, in other embodiments, the hair wrap members or support members 1214 may be mounted to the column support 1230 and may not contact one or both of the front wall 1065 and the plate 1208.

An advantage of the support members 1214 contacting or being secured to the plate 1208 is that they may enhance the structural rigidity of the plate 1208. For instance, the use of support members 1214 may help prevent rotational movement of the plate 1208 (e.g., resulting from cyclonic swirling of air inside of the cyclone chamber 1062).

One or more support members 1214 may be provided. For example, as exemplified in FIGS. 36 and 43, two support members 1214*a*, 1214*b* may be provided. Alternately, as exemplified in FIG. 39, four support members 1214*a*, 1214*b*, 1214*c*, and 1214*d* may be provided. It will be appreciated that two or more support members 1214 may be provided. An advantage of using a greater number of support members 1214 is that the structural rigidity of the plate 1208 may be enhanced (e.g., the plate 1208 may be held in position and prevented from rotational movement by a larger number of support members 1214).

The support members 1214 may also be arranged in any suitable configuration around the central region of the dirt collection chamber. For instance, as exemplified, the support members 1214 may be evenly spaced around a central axially extending region. For example, as exemplified in FIGS. 36 and 43, the support members are positioned about 180°. Alternately, as exemplified in FIG. 39, the members may be positioned about 90°. In other embodiments, the support members 1214 may be unevenly spaced around the central region. It will be appreciated that, as long as two of the support members 1214 are spaced apart from each other, if hair wraps around the support members, the hair will be spaced outwardly from, e.g., column support 12130, which will enable a user to, e.g., insert a knife between the hair and the column support 1230 so as to cut the hair and thereby facilitate removal of hair.

While the axially extending central region is illustrated as being substantially co-axial with the cyclone axis 1226, in alternative embodiments, it will be appreciated that the central region may also be provided off-axis (i.e., the support members 1214 may be arranged around an axially extending space that is off set from cyclone axis 1226.

Support members 1214 may be configured to have any suitable shape. For instance, as exemplified, the support members 1214 may comprise planar members with opposed planar sidewalls 1216. As exemplified, the planar members 1214 extend radially outwardly from the central axial region (e.g., central column 1230) by a radial distance 1217 (see e.g., FIGS. 36, 39, and 43). Alternately, support members may extend outwardly but not radially, e.g., they may be curved.

It will be appreciated that each support member 1214 may extend outwardly the same distance or differing distances. As exemplified in FIGS. 36 and 39, the planar members 1214 extend radially from the central axial region, the same radial distance (e.g., radial extension) 1217. In addition, as exemplified in FIGS. 36 and 39, the radial distance 1217 may be configured such that planar members 1214 extend short of the perimeter 1218 of plate 1208 (e.g., the planer support members are recessed inwardly from the outer perimeter 1218). An advantage of this configuration is that hair which becomes wrapped around the support members may be recessed inwardly from gap 1222, which is the dirt outlet from the cyclone chamber and, accordingly, the hair may not interfere with dirt exiting the cyclone chamber.

In alternative embodiments, the support members 1214 may not be planar, but may nevertheless be recessed inwardly from the perimeter 1214, and may be spaced around an axially extending central region in order to collect debris (e.g., hair) that is entrained in the air flow.

Figure 43:
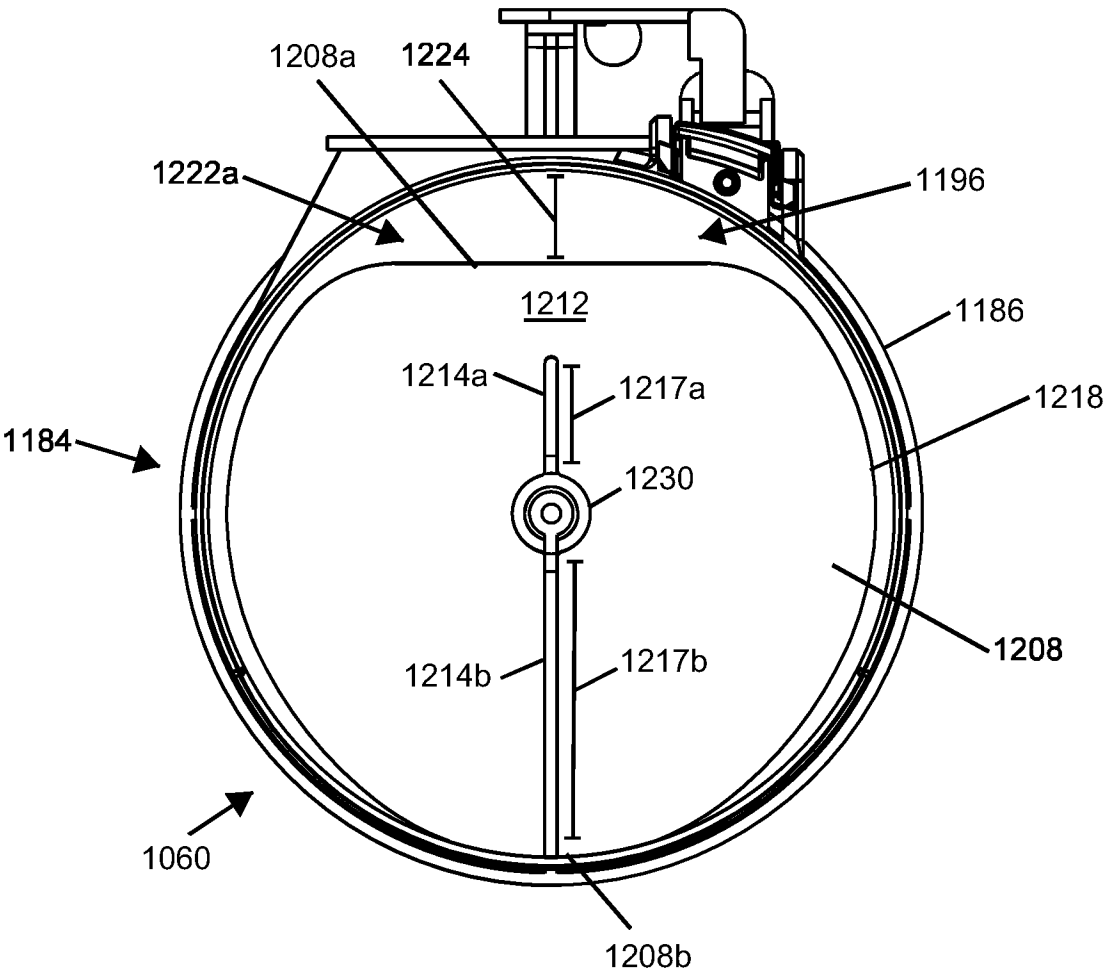
FIG. 43 is a cross-sectional view of the air treatment member of FIG. 40, taken along the line 43-43 of FIG. 41.
Figure 44:
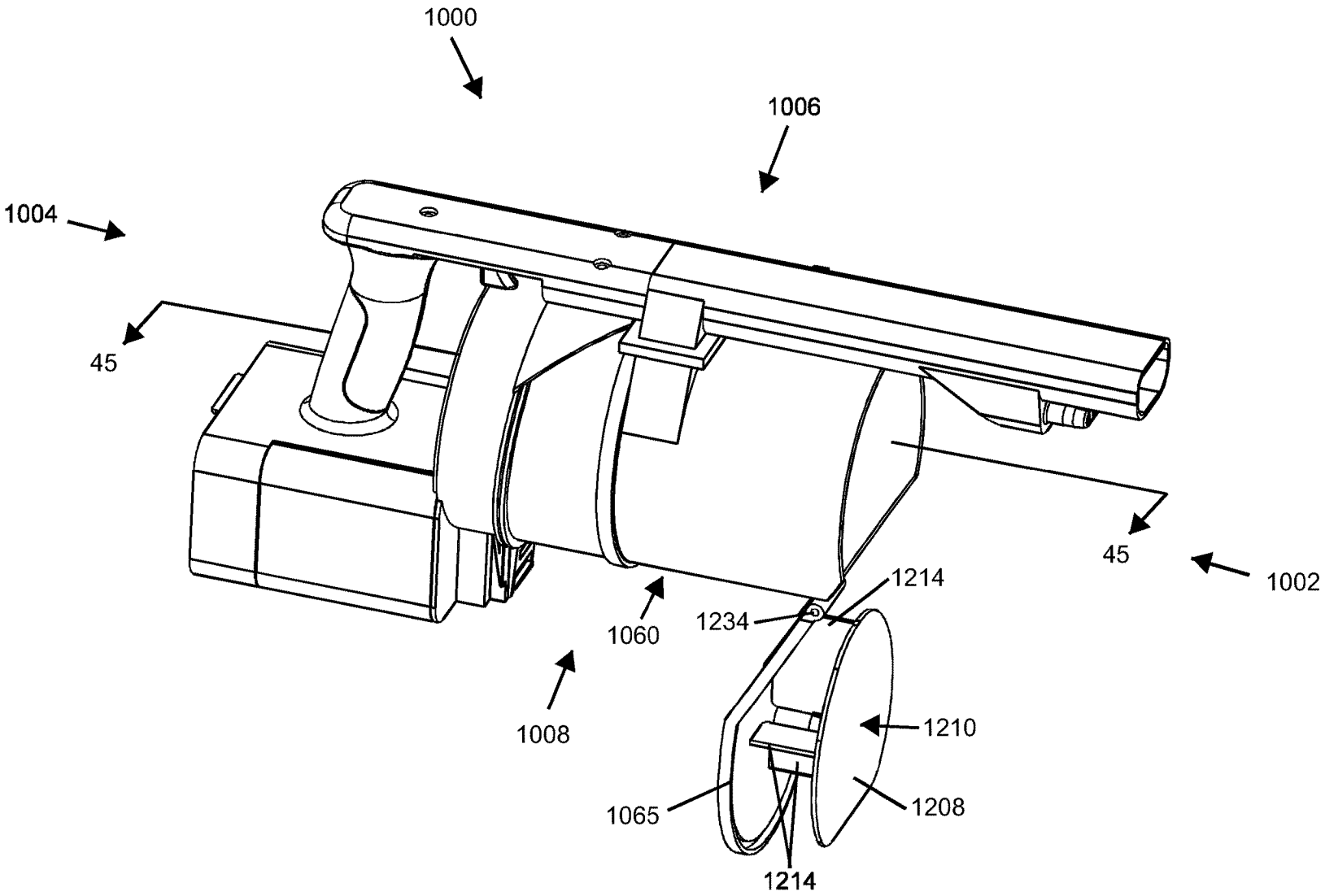
FIG. 44 is a top front perspective view of the hand vacuum cleaner of FIG. 1 with a front wall moved into an open position.
Figure 45:
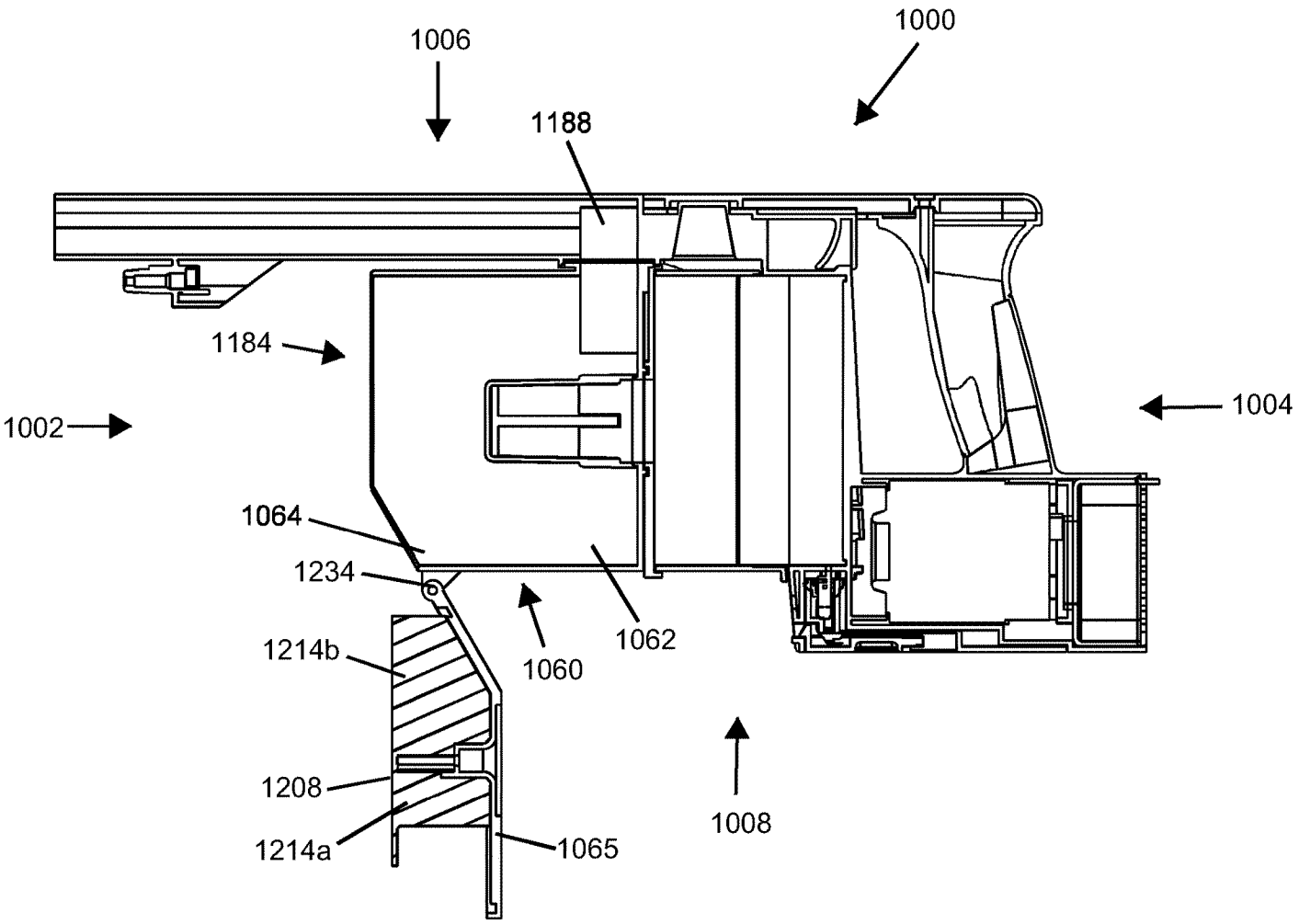
FIG. 45 is a cross-sectional view of the hand vacuum cleaner of FIG. 44, taken along the line 45-45 of FIG. 44.

Alternatively, as exemplified in FIG. 43, the radial extension 1217 of one or more of planar members 1214 may span to substantially the perimeter 1218 of plate 1208 (e.g., radial distance 1217*b* of support member 1204*b*). An advantage of this configuration is that longer (e.g., elongated) support members may further improve (e.g., enhance) the structural rigidity of the plate 1208. If a support members extends to or adjacent the perimeter of plate 1208, then the outward end of the planar member is preferably provided at a location at which there is no gap 1222.

The dirt collection chamber may be openable by any means known in the art. As exemplified in FIGS. 44 and 45, the front wall 1065 of the dirt collection chamber 1064 is openable such that the cyclone chamber and the dirt collection chamber may each be emptied.

The front wall 1065 may be moveably connected (e.g., pivotally openable or removably mounted) to the cyclone 1184 using any suitable mechanism. For instance, as exemplified, the front wall 1065 may be pivotally mounted to a lower end of the cyclone unit side wall 1186 via hinge mechanism 1234, such that cyclone unit 1184 may be opened, and dirt chamber 1064 may be emptied. Alternatively, any other suitable device may be used to pivotally open (or remove) the front wall 1065. Optionally, the front wall 1065 can be secured in the closed position using any suitable type of locking mechanism, including a latch mechanism that can be released by a user. In the exemplified embodiments, a latch 1236 is provided on the cyclone unit side wall 1186 to secure the front wall 1065 to the side wall 1186 of the cyclone 1062 in the closed position.

As exemplified, in embodiments where the plate 1208 is supported on the front wall 1065 (e.g., using one or more support members 1214), the plate 1208 may pivot away from the remainder of the cyclone unit 1184 with the front wall 1065 when the front wall 1065 is opened. An advantage of this configuration is that the dirt collection chamber 1064 and the cyclone chamber 1062 may be concurrently emptied when the front wall 1065 is removed. A further advantage of this configuration is that, when the front wall 1065 is removed, a user may access the support members 1214 to remove debris (e.g., hair) which may be wrapped around the support members.

Mounting of the Energy Storage Chamber

The following is a discussion of the mounting of an energy storage chamber, e.g., a battery pack, that may be used by itself or in combination with one or more other aspects of this disclosure.

Figure 47:
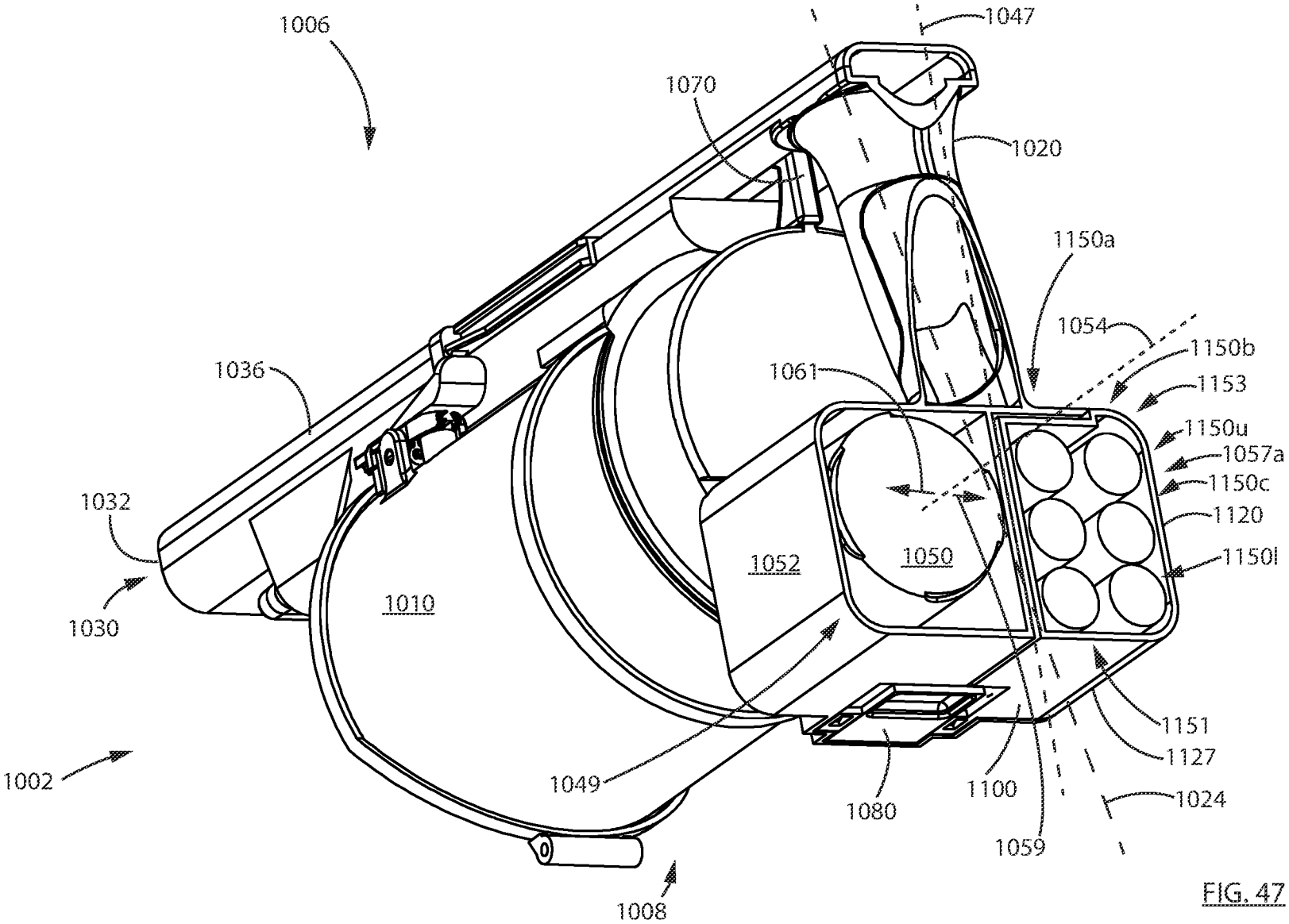
FIG. 47 is a cross sectional view of the hand vacuum cleaner of FIG. 46.

As exemplified in FIG. 47, the energy storage chamber 1100 can be mounted beside the suction motor 1050. Accordingly, the energy storage chamber 1100 may substantially cover a lateral side 1051 of the suction motor housing 1052 when mounted to the hand vacuum cleaner 1000 (e.g., cover more than 50%, more than 75% or more than 90% of the lateral side 1051).

As exemplified in FIG. 4, the energy storage chamber 1100 can be mounted around the suction motor 1050. Accordingly, the energy storage chamber 1100 may substantially surround the bottom and lateral sides of the suction motor housing 1052 when mounted to the hand vacuum cleaner 1000. In such a design, the energy storage chamber 1100 may have an open volume 1110 (FIG. 6) that is removably receivable around part of the main body 1010 of the hand vacuum cleaner.

As exemplified, the energy storage chamber 1100 seats beside and/or around part of the suction motor housing 1052 and accordingly, the suction motor housing 1052 may remain in position when the energy storage chamber 1100 is removed and may therefore retain suction motor 1050 in position and prevent dirt and debris from entering suction motor 1050 when the energy storage chamber 1100 is removed from hand vacuum cleaner. In some embodiments, a portion of the suction motor 1050 may be outside the perimeter of the energy storage chamber 1100, e.g., above the upper end or ahead of the forward end 1102 (FIG. 6) of energy storage chamber 1100.

Figure 49:
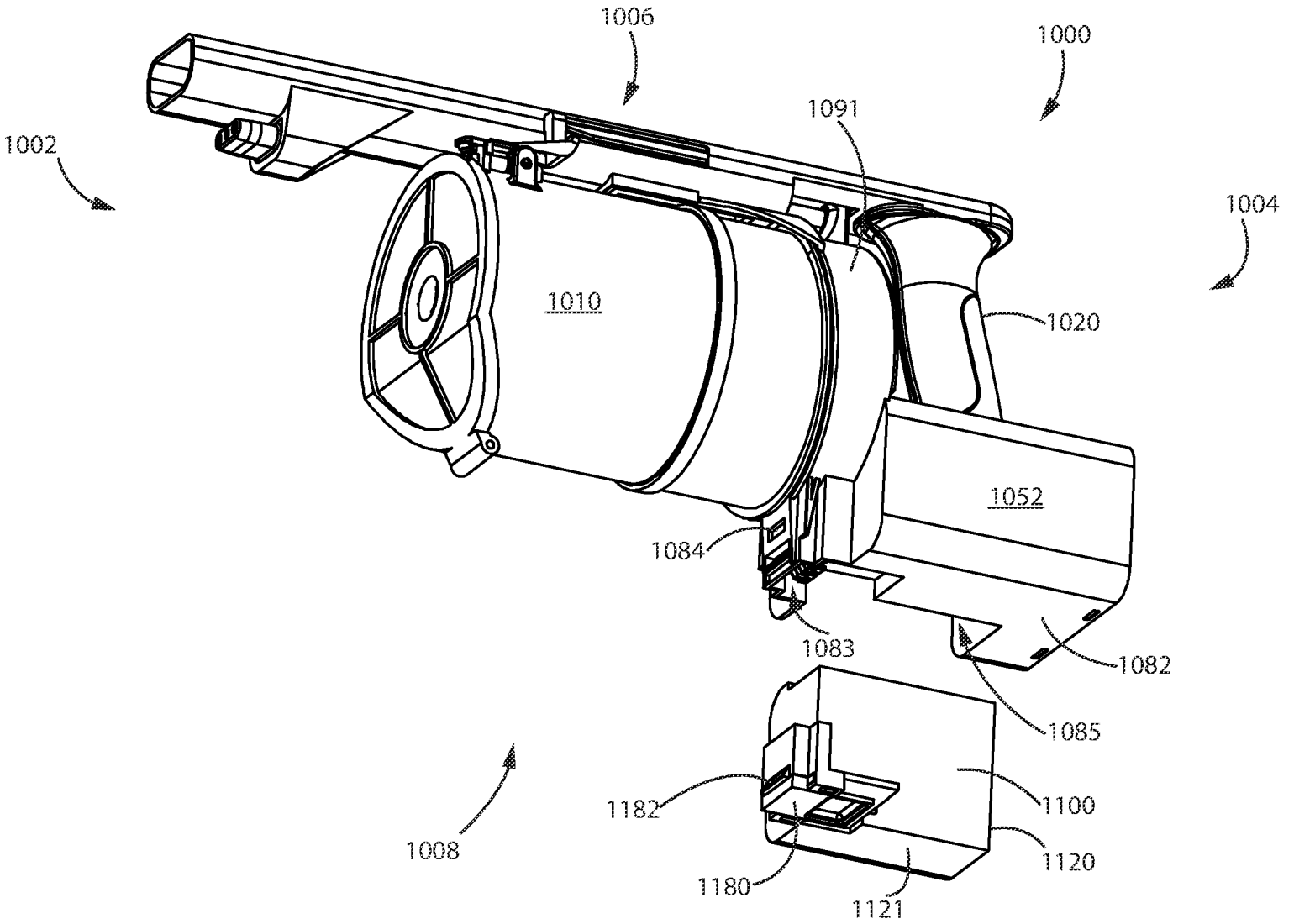
FIG. 49 is a bottom front perspective view of the hand vacuum cleaner of FIG. 46 with an energy storage chamber removed; and, FIG. 50 is a top rear perspective view of the hand vacuum cleaner of FIG. 46 with the energy storage chamber removed.
Figure 50:
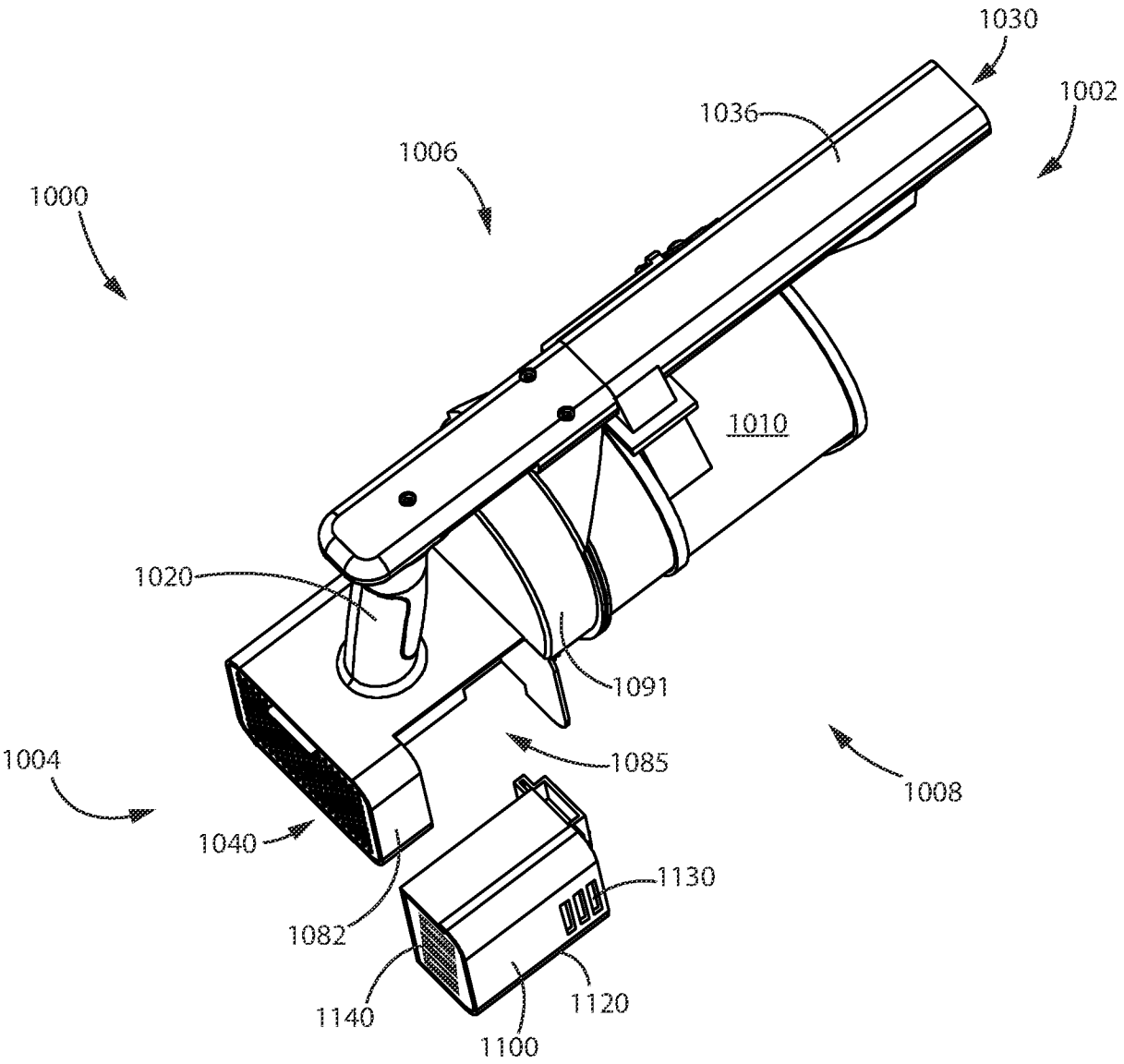

As exemplified in the embodiments of FIGS. 4, 49 and 50, the energy storage chamber 1100 may be removably mounted and removeable in a downward direction. An advantage of this design is that when a user is holding the hand vacuum cleaner by handle 1020, a user may easily remove the battery energy storage chamber 1100.

A further advantage of this design is that the energy storage members may be provided at an outer surface of the hand vacuum cleaner, namely the lateral outer sides of energy storage chamber 1100. Accordingly, the energy storage members may more easily dissipate heat as many (e.g., each) energy storage members may be provided adjacent an outer wall.

Additionally, or alternatively, the energy storage chamber 1100 may mount beside and/or around one or more filters in hand vacuum cleaner 1000, such as pre-motor filter 1090 or post-motor filter 1080. For example, when mounted to the hand vacuum cleaner 1000, the exterior of energy storage chamber 1100 can be mounted substantially flush with the exterior of the main body 1010. Accordingly, it will be appreciated that part or all of one or more of the pre-motor filter, the post-motor filter and the suction motor may seat within the open volume 1110 when the energy storage chamber is mounted to the hand vacuum cleaner.

The energy storage chamber 1100 can be mounted in a battery receiving area 1085 defined by the main body 1010 of the hand vacuum cleaner. Any mounting members for enabling a battery pack to be removably mounted may be used. As exemplified, the battery pack 1100 can include a front mounting member 1180 (see FIGS. 6 and 49). The front mounting member 1180 may engage a corresponding mounting member on the main body 1010 of the hand vacuum cleaner 1000. For instance, the main body 1010 may include a channel 1083 forward of the suction motor 1050 (see FIGS. 5 and 49). The channel 1083 may be shaped to receive the front mounting member 1180. To mount the energy storage chamber 1100 to the main body 1010, the front portion 1180 can be slid upwards into channel 1083 with the housing 1120 of the energy storage chamber sliding into the battery receiving area 1085.

Alternately, or in addition, the energy storage chamber 1100 and main body 1010 can also include one or more pairs of inter-engageable securement members. The securement members can engage one another to secure the energy storage chamber 1100 to the main body 1010. For instance, the mounting member 1180 may have an extending member or protrusion 1182. Main body 1010 can include a corresponding recess 1084 (see FIGS. 4 and 49) shaped to engage the extension member 1182. When the battery pack 1100 is mounted to the main body 1010 (i.e., when the front portion 1180 is slid upwards into channel 1183), the extending member 1182 can be received in the recess 1084. The extending member 1182 can engage the base of recess 1084 to retain the battery pack 1100 mounted to the main body 1010.

To remove the energy storage chamber 1100, a user may depress the extending member 1182 so that it recedes from the recess 1084. The energy storage chamber 1100 can then be slid downwards and removed. The extending member 1182 may be biased to its extended position so that the securement members engage automatically as the front portion 1180 slides into place.

In the examples shown, the battery pack 1100 includes a mounting member 1180 at the front side only. This may allow a user to detach the battery pack 1100 using only one hand (e.g., using an index finger to depress extending member 1182 while using the palm to support energy storage chamber 1100). The battery pack receiving area 1085 of hand vacuum cleaner 1000 can be shaped to prevent sagging of the rear of battery pack 1100. For instance, the receiving area 1085 can be sized to provide a snug fit with the battery pack 1100. The filter housing 1082 may then prevent the rear 1104 of battery pack 1100 from sagging. In some cases, this may also ensure that any airflow through the housing 1120 can be fluidly coupled into the battery housing 1082 and out the clean air outlet 1040.

In alternative embodiments, the hand vacuum cleaner may include additional mounting members for battery pack 1100. For example, an additional mounting member may be provided on the rear 1104 of battery pack 1100. This may further support the battery pack 1100 and prevent sagging.

In the illustrated embodiments, the hand vacuum cleaner 1000 includes an energy storage chamber 1100 that is mounted to a lower rear portion of the main body 1010. The handle 1020 is located at the rear end 1004 of the hand vacuum cleaner 1000. The handle 1020 extends generally vertically between and upper handle end 1026 and a lower handle end 1028. The energy storage chamber 1100 can be positioned at or below the lower end 1028 of the handle 1020. The suction motor 1050 can also be positioned on the lower rear end of hand vacuum cleaner 1000, at or below the lower end 1028.

The central axis 1024 of the handle 1020 may extend through the suction motor 1050 or between the suction motor 1050 and the group of energy storage members 1057. In the example shown in FIGS. 3 and 4, the axis 1024 intersects the rotational axis 1054 of the suction motor 1050. In the example shown in FIG. 48, the axis 1024 extends between the motor 1050 and the group of energy storage members 1057. These configurations may ensure that the weight of the suction motor 1050 is evenly balanced when a user is carrying the hand vacuum cleaner 1000 by handle 1020.

The central axis 1024 of the handle 1020 may also extend through a portion of the energy storage chamber 1100. In the example shown in FIGS. 3 and 4, the central axis 1024 extends through a central vertical plane of the open volume 1110 between the energy storage members 1150 (i.e., through the lateral centerline of the energy storage chamber 1100). The energy storage members 1150 are thus evenly balanced on either lateral side of the central axis 1024.

A power switch 1070 may be provided to selectively control the operation of the suction motor 1050 (e.g., either on/off or variable power levels or both). Operation of the power switch 1070 may control operation of the suction motor 1050 by establishing a power connection between the batteries 1150 and the suction motor 1050. The power switch 1070 may be provided in any suitable configuration and location, including a button, rotary switch, sliding switch, trigger-type actuator, touch pad and the like. In the example shown, the power switch 1070 is positioned proximate to the front side of the hand grip portion 1022. This may allow a user to grasp the hand vacuum cleaner 1000 and selectively control operation of the suction motor 1050 using one hand.

Construction of an Energy Storage Chamber

The following is a discussion of the construction of an energy storage chamber, e.g., a battery pack, that may be used by itself or in combination with one or more other aspects of this disclosure.

FIGS. 6 to 13 and 46 to 50 illustrate exemplary embodiments of the energy storage chamber 1100. The energy storage chamber 1100 includes a plurality of energy storage members 1150, which may be positioned on opposing lateral sides of the energy storage chamber 1100 as exemplified in FIGS. 6 to 49. In some examples, the suction motor 1050 can nest between the energy storage members 1150 in the open volume, with at least some energy storage members 1150 on a first lateral side 1051 (FIG. 10) of the suction motor 1050 and at least some energy storage members 1150 on a second lateral side 1053 of the suction motor 1050.

The energy storage chamber 1100 includes a housing 1120. A plurality of energy storage members 1150 are contained within housing 1120, and each grouped plurality of energy storage members may be enclosed in a section of the housing 1120 (e.g., enclosed separately from each other grouped plurality of energy storage members). In the example illustrated in FIGS. 6 to 13, the housing 1120 has a first lateral housing section 1122 and a second lateral housing section 1124. Each lateral housing section 1124 encloses one or more energy storage members 1150.

Figure 11:
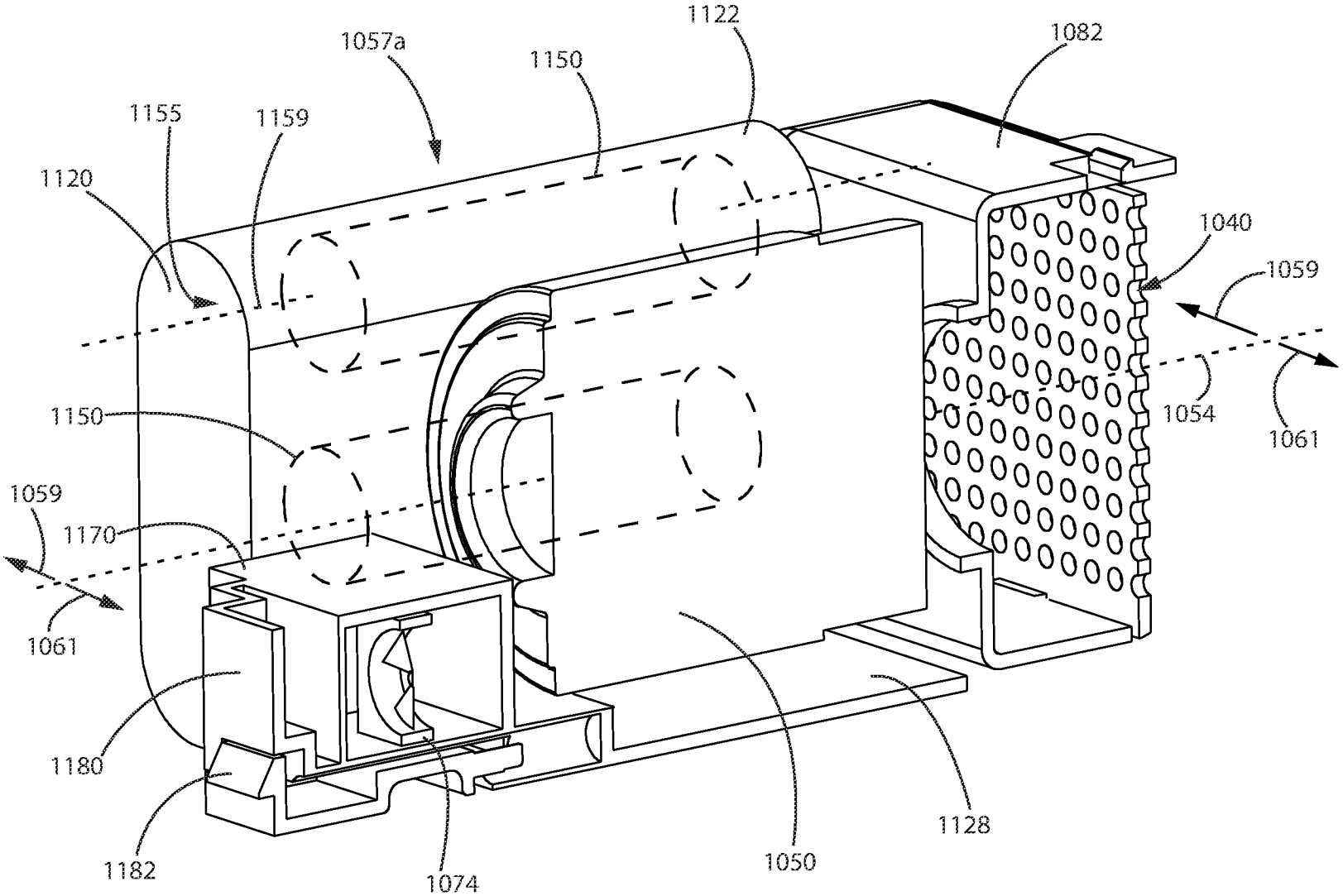
FIG. 11 is a perspective sectional view of the energy storage chamber, suction motor and post-motor filter of FIG. 7, taken along line 11-11 in FIG. 7.
Figure 12:
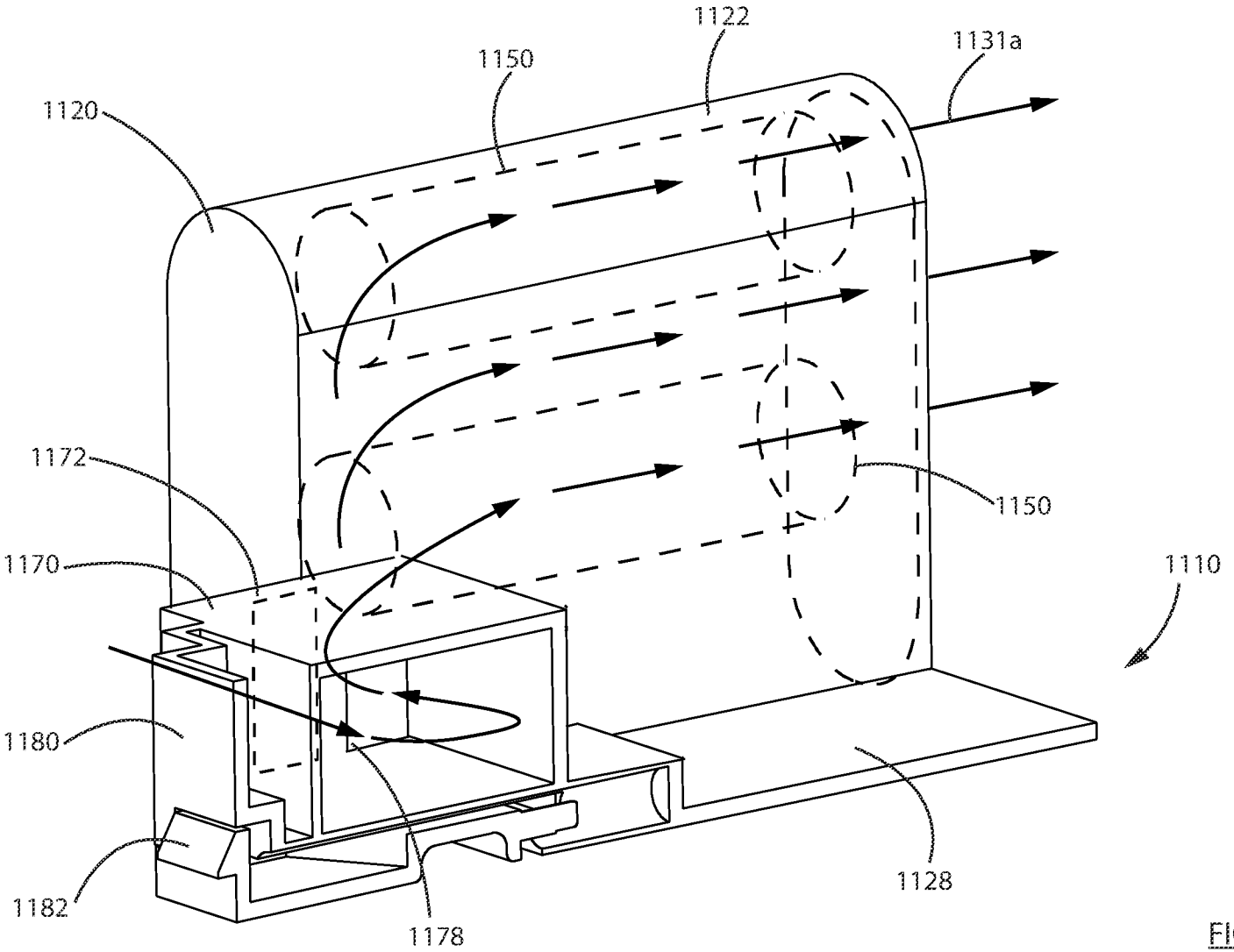
FIG. 12 is a perspective sectional view of the energy storage chamber of FIG. 7, taken along line 11-11 in FIG. 7, with a fan unit removed.

As illustrated in FIGS. 11 and 48, the first lateral housing section 1122 and the second lateral housing section 1124 are separated by a web 1128 (e.g., a laterally extending web 1128). Web 1128 may hold the housing sections 1122, 1124 in position relative to one another. In some examples, the web 1128 (FIG. 11) and/or a lower wall 1121 of a housing section (FIG. 48) is part of a lower surface 1009 (FIGS. 1 and 47) of the hand vacuum cleaner 1000 (e.g., the storage members 1150 and/or chamber 1100 may be at a lower part of the cleaner 1000).

In the examples illustrated, each lateral housing section includes a plurality of (e.g., two or four or six) energy storage members 1150 (e.g., a grouped plurality 1057*a*, 1057*b*). As exemplified in FIGS. 6 to 13, the first lateral housing section 1122 includes the first plurality of energy storage members 1057*a* and the second lateral housing section 1124 includes the second plurality of energy storage members 1057*b*.

In, some examples the energy storage members 1150 (e.g., the energy storage members 1150 in each lateral housing section) extend (e.g., a central longitudinal axis 1159, shown in FIG. 11, of the energy storage member 1150 may extend) generally in a length direction of the energy storage chamber 1100, i.e., between the front 1102 and rear 1104 of the energy storage chamber 1100. As exemplified, this is also the direction of the suction motor axis and the cyclone axis of rotation. The interior of the lateral housing sections 1122 and 1124 may include alignment members to maintain the batteries 1150 in place in the lateral housing sections 1122 and 1124.

Figure 8:
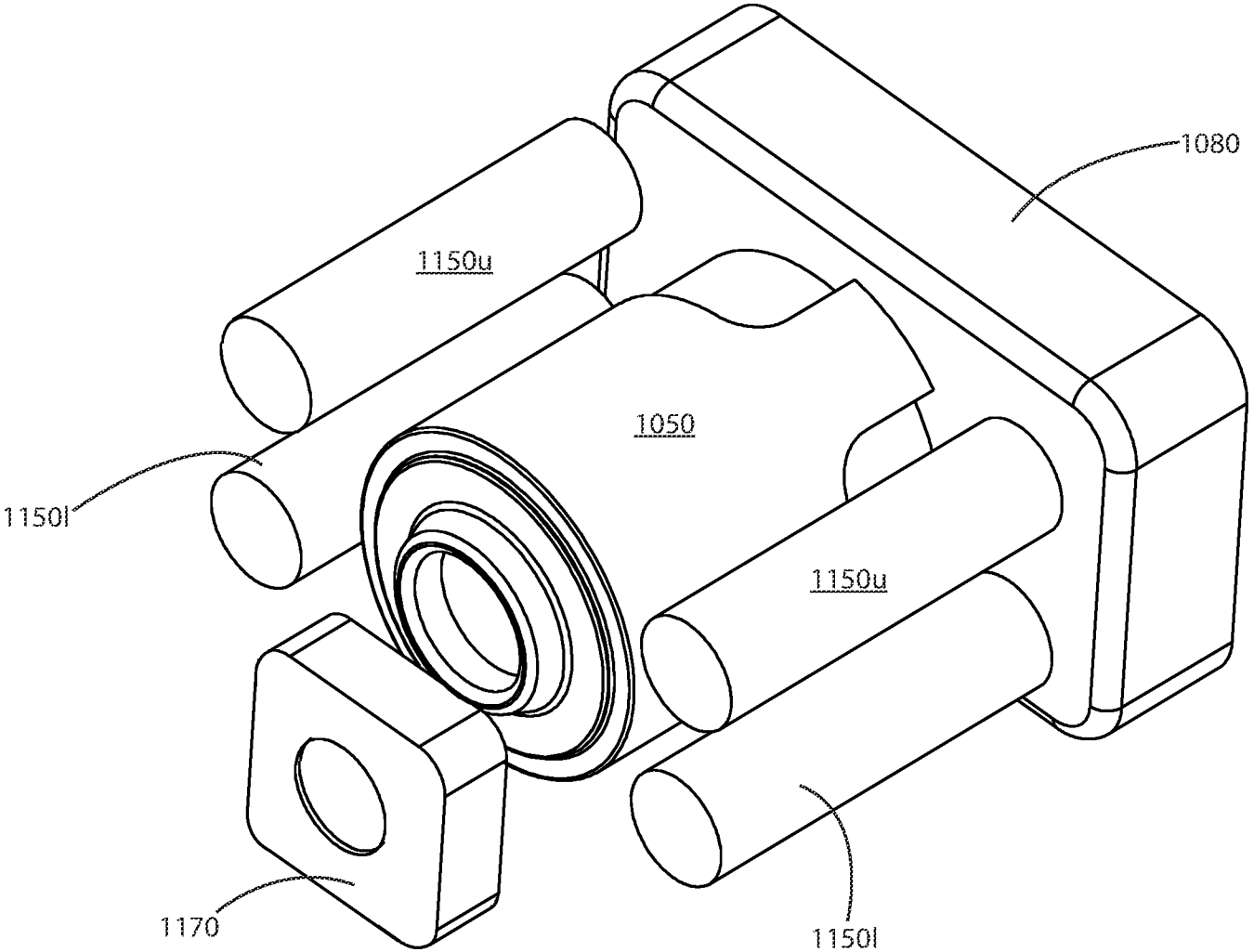
FIG. 8 is a front perspective view of the energy storage chamber, suction motor and post-motor filter of FIG. 7 with a housing of the energy storage chamber and the suction motor removed.
Figure 9:
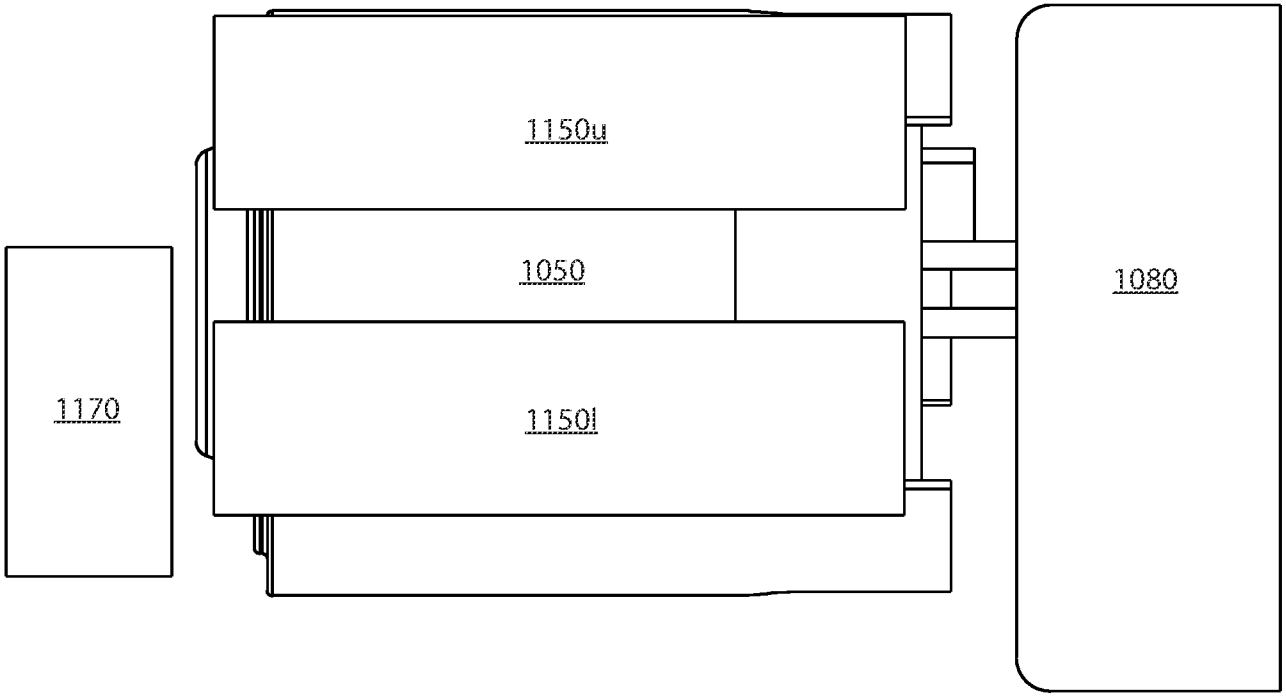
FIG. 9 is a side view of the energy storage chamber, suction motor and post-motor filter of FIG. 8.

The energy storage members 1150 can be arranged into separate rows. As shown in the example of FIG. 8, an upper row of energy storage members 1150*u* and a lower row of energy storage members 1150 are contained within each lateral housing section 1122 and 1124. As shown in the example of FIG. 47, the lateral housing section 1127 also contains a central row 1150*c*. Also as exemplified in FIG. 47, the energy storage members 1150 may be arranged in laterally-spaced columns (e.g., an inner column 1150*a* and an outer column 1150*b*). Each row of energy storage members 1150 extends substantially in parallel with the motor and fan assembly, i.e., substantially parallel to the motor axis of rotation 1054. Each column of energy storage members 1150 extends substantially vertically, e.g., substantially at a 90° angle to the motor axis of rotation 1054.

In the example shown, the rows of energy storage members are substantially the same (e.g., in length) as one another, and the columns of energy storage members are substantially the same (e.g., in length) as one another. Alternatively, the rows can be different from one another (e.g., have different lengths) and/or the columns can be different from one another (e.g., have different lengths). For example, in some cases, one or more rows of energy storage members may have different sizes or numbers of energy storage members (see e.g., FIGS. 20-22), which may allow various components of hand vacuum cleaner 1000 to nest within the energy storage chamber 1100.

In the examples shown, the post-motor filter 1080 is positioned rearward of the energy storage chamber 1100. The post-motor filter 1080 extends laterally across the rear of the suction motor 1050. The post-motor filter 1080 extends across substantially the entirety of the suction motor 1050 at the rear side 1104 of energy storage chamber 1100. As shown in FIGS. 10 and 48, the perimeter of suction motor 1050 falls within the outer perimeter of the filter housing 1082 when viewed from the rear of hand vacuum cleaner 1000. The post-motor filter 1080 can filter air exiting the suction motor 1050 before it exits the hand vacuum cleaner 1100 via clean air outlet 1040.

As shown, the post-motor filter 1080 may also extend across the rear of one or more lateral housing sections (e.g., sections 1122 and/or 1124). This may allow the filter housing 1182 to support the energy storage chamber 1100 in the mounted position (e.g., an engagement member such as a protrusion provide on the energy storage chamber may be inter-engagable with (receivable in a recess of) the filter housing 1182). The filter housing 1182 may contact or be secured to the housing 1120 so as to prevent sagging of the rear of the energy storage chamber 1100.

As shown in FIGS. 10 and 48, each of the energy storage members 1150 is positioned within the outer perimeter of the filter housing 1082 when viewed from the rear 1104 of hand vacuum cleaner 1000. That is, the central axis of each energy storage member 1150 extends through the volume defined by the perimeter of the post-motor filter 1080 when the energy storage chamber 1100 is mounted to main body 1010. It will be appreciated that, depending upon the size of the post-motor filter 1080 or the post-motor filter housing, the post-motor filter 1080 or the post-motor filter housing may not be positioned rearward of all of the suction motor and/or all of the energy storage members.

In the example illustrated in FIGS. 1 to 5, the energy storage chamber 1100 defines an open volume 1110 between the energy storage members 1150. The open volume 1110 is generally defined between the inner wall 1123 of the first lateral housing section 1122, the inner wall 1125 of the second lateral housing section 1124, and the base or web 1128 of the housing 1120. This open volume 1110 allows the battery pack 1100 to be mounted to the hand vacuum cleaner 1000 with one or more components of the hand vacuum cleaner, such as a motor or filter, nested between the energy storage members 1150.

In the example shown, the suction motor 1050 (and suction motor housing 1052) is positionable within the open volume 1110. The suction motor 1050 can be laterally displaced from, and nested between, at least some of the energy storage members 1150 in the respective lateral sections 1122 and 1124. In the example shown in FIGS. 1 to 5, the suction motor 1050 may be positioned centrally between the energy storage members 1150 when the energy storage chamber 1100 is mounted on the main body 1010. The rotational axis 1054 of suction motor 1050 may be defined on a lateral plane that separates the upper and lower rows of energy storage members (i.e., a laterally extending central plane of the suction motor 1050 passes between energy storage members 1150*u* and 1150*d*).

Figure 7:
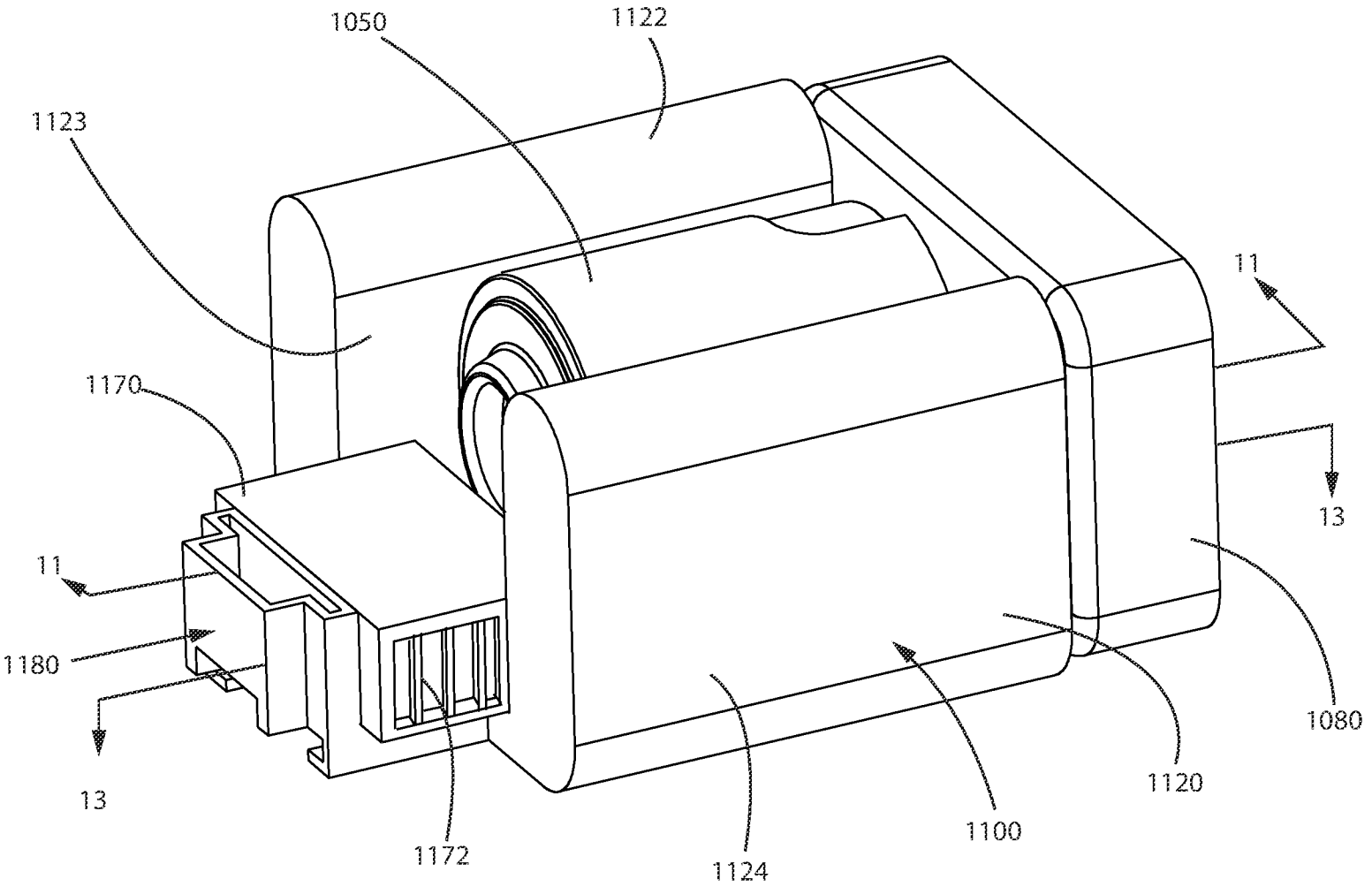
FIG. 7 is a front perspective isolation view of the energy storage chamber, suction motor and post-motor filter of the hand vacuum cleaner of FIG. 1 in accordance with an embodiment.
Figure 46:
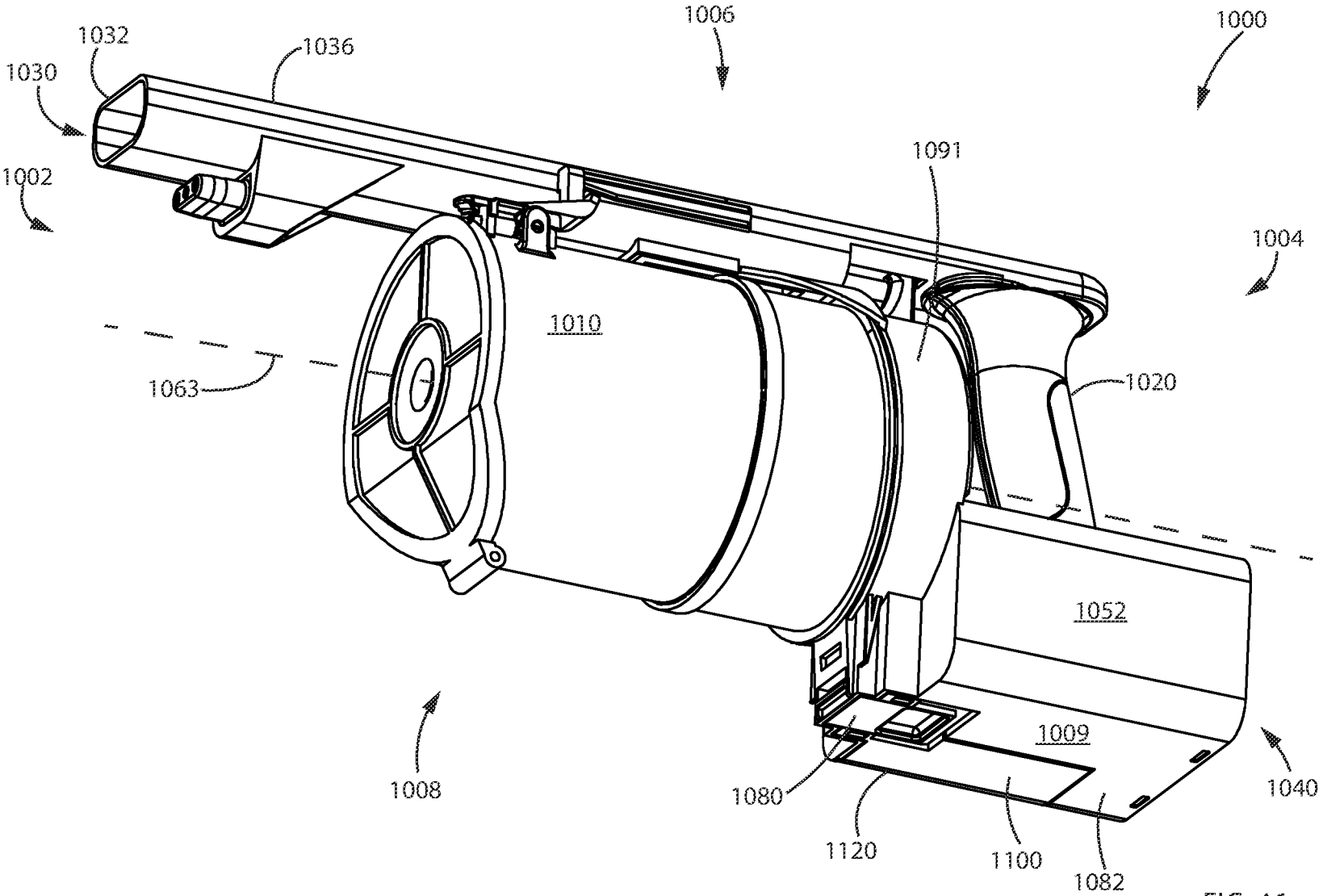
FIG. 46 is a bottom front perspective view of another hand vacuum cleaner in accordance with an embodiment.

As shown, for example in FIGS. 7 and 46, the entirety of suction motor 1050 can be positioned between or beside the energy storage members 1150 (e.g., in open volume 1110). Alternatively, a portion of the suction motor 1050 may be external to the open volume 1110 (i.e., not located between the energy storage members 1150) or above, below, forward, and/or rearward of the energy storage members. For example, an upper portion of suction motor 1050 may be contained within the main body 1010 of the hand vacuum cleaner at a location above the upper end of the energy storage chamber 1100. Alternately, or in addition, a forward and/or a rearward portion of suction motor 1050 may be contained within the main body 1010 of the hand vacuum cleaner at a location forward and/or rearward of the energy storage chamber 1100.

In alternative embodiments, the motor and fan assembly may not be nested within or beside the energy storage chamber 1100. For example, the energy storage chamber 1100 may be positioned forward or rearward of the suction motor 1050 with at least a portion of a pre-motor filter 1090 or post-motor filter 1080 positioned between or beside the energy storage members 1150.

Some energy storage members, such as lithium-ion batteries, may produce heat while being charged and/or discharged (e.g., while supplying power to an electric motor). Accordingly, it may be important to cool the energy storage members 1150, particularly where they are located near to other heat producing components of the hand vacuum cleaner 1000, such as suction motor 1050. The hand vacuum cleaner 1000 may direct air through the energy storage chamber 1100 (i.e., through the interior of housing 1120) to promote cooling of the energy storage members 1150.

Figure 13:
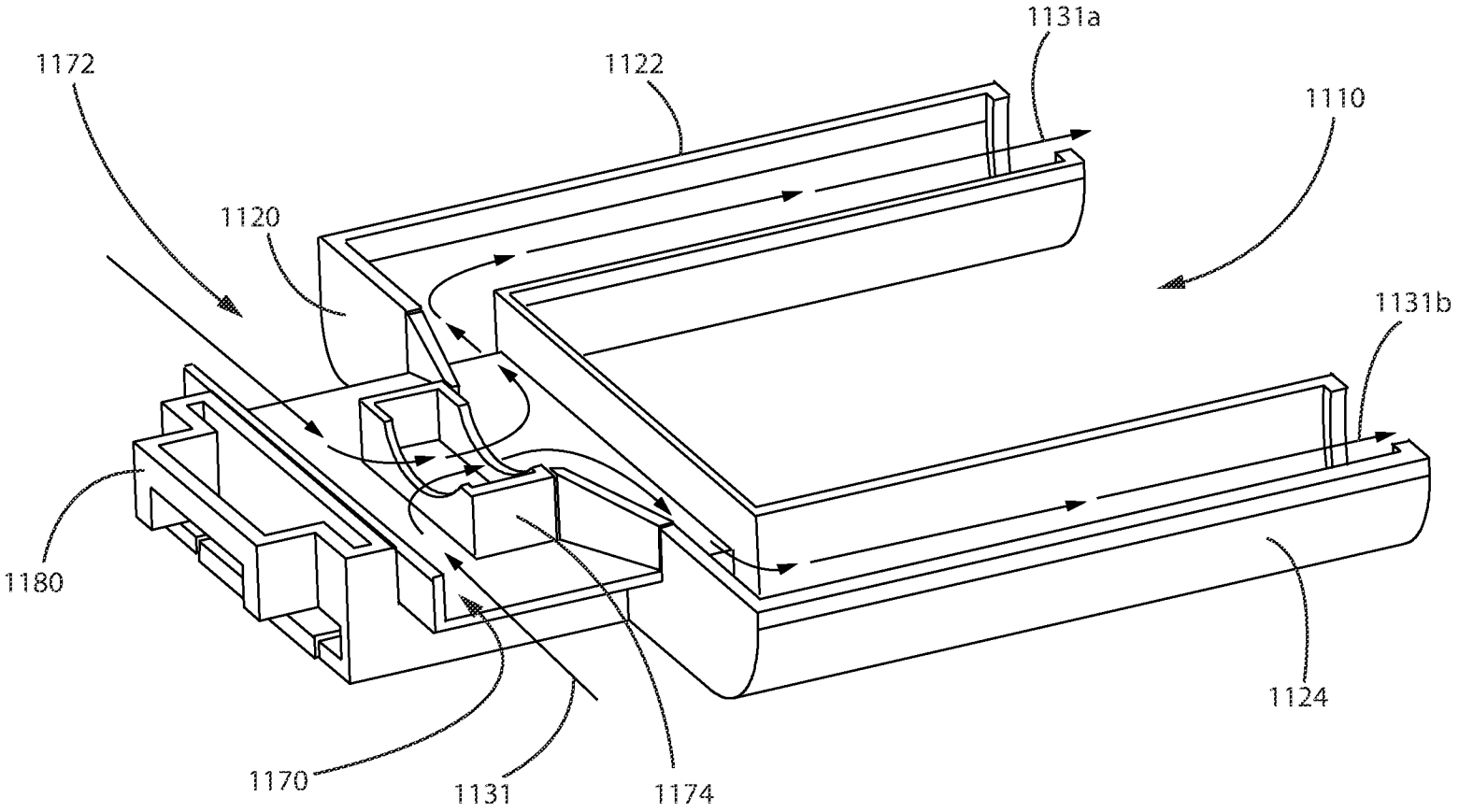
FIG. 13 is a perspective sectional view of the energy storage chamber of FIG. 7, taken along line 13-13 in FIG. 7, with a fan unit removed.

In some embodiments, the hand vacuum cleaner 1000 can include a second air flow path 1131 (FIG. 13). The second airflow path 1131 may direct or enable a flow of ambient air towards (or through) the energy storage chamber 1100 containing the onboard energy storage members 1150. Ambient air is air other than that which is passing through the primary airflow path 1031, e.g., air drawn in from the exterior of the surface cleaning apparatus 1000. The ambient air drawn through the second air flow path can promote cooling of the energy storage members 1150.

The energy storage chamber 1100 may separate the batteries 1150 from the primary air flow path 1031. This may prevent dirt or debris entrained in the air in primary air flow path 1031 from dirtying the housing 1120 enclosing the energy storage chamber 1100. The housing 1120 of the energy storage chamber 1100 may also include a thermal barrier (e.g., a thermal insulating material) to prevent the suction motor 1050 or primary air flow path 1031 from heating the energy storage members 1150.

The housing 1120 of the energy storage chamber 1100 may include electrically insulating members that enclose the batteries 1150. For example, the housing 1120 itself may be manufactured of electrically insulating materials such as plastic. This may electrically insulate the batteries 1150 within the energy storage chamber 1100.

In some cases, at least a portion of the housing 1120 may be thermally conductive. For instance, having the outer sides of housing 1120 be thermally conductive permits heat transfer between one or more housing sections (e.g., sections 1122 and 1124 or section 1127) of the energy storage chamber 1100 and ambient air outside the hand vacuum cleaner 1000. This may further promote cooling of the batteries 1150.

The second air flow path 1131 can pass through one or more housing section (e.g., the housing sections 1122 and 1124 or the section 1127) enclosing the energy storage members 1150. The energy storage chamber 1100 can include an ambient air inlet 1130 (FIGS. 1 and 50). Ambient air can enter the second air flow path 1131 through ambient air inlet 1130.

Optionally, a filter may be positioned in the second airflow path 1131 upstream of the energy storage chamber 1100. For example, the filter may be positioned at the ambient air inlet 1130. The filter may prevent dirt and debris entrained in the ambient air from entering the second air flow path 1131 and/or energy storage chamber 1100 and potentially clogging air channels therethrough. The filter may be any suitable type of filter such as a foam filter, felt filter, HEPA filter, other physical filter media, electrostatic filter, and the like.

The energy storage chamber 1100 may include an air mover. A fan unit 1170 is exemplified in FIGS. 1 to 13 (and may also be included in the example of FIGS. 46 to 50). The fan unit 1170 can include a fan 1174 operable to direct ambient air to flow through the second air flow path 1131. Ambient air can pass from the ambient air inlet 1130 and be drawn into the fan unit 1170 via fan inlet 1172. The ambient air can then pass through fan 1174 towards the energy storage members (e.g., towards the housing section 1127 or, where the cleaner 1000 includes a plurality of groups of energy storage members, the second air flow path 1131 may split into separate lateral airflow sections 1131*a* and 1131*b*). Air then passes through fan outlets 1178 of one or more housing sections (e.g., lateral housing sections 1122 and 1124), where the air may promote cooling of the energy storage members 1150. Air may then exit (e.g., through an outlet 1140 separate from the inlet 1130, such as through a secondary air outlet to the ambient or through towards clean air outlet 1040).

Providing the post-motor filter 1080 across at least a portion of the rear of the energy storage chamber 1100 may allow the post-motor filter 1080 to filter air through the secondary air flow path 1131 as well as the air flow path 1031. Air exiting the second air flow path 1031 may pass through the post-motor filter 1080 and exit the same clean air outlet 1040 as air from the primary air flow path 1031. If the energy storage chamber 1100 is removably mounted to the main body 1010, a gasket or the like may be provided to provide an airtight seal between the second airflow path 1131 and the post-motor filter 1080.

Referring to FIGS. 14-17, shown therein is an alternative example of an energy storage chamber 2100 and nesting arrangement for a hand vacuum cleaner, such as hand vacuum cleaner 1000. As exemplified in FIGS. 14-17, an energy storage chamber 2100 may allow part or all of a post-motor filter 2080 to be positioned between at least some of the energy storage members 2150. The features of energy storage chamber 2100 may be generally similar to the energy storage chamber 1100, with the reference numerals indicating similar features increased by 1000. Although a fan unit is omitted from energy storage chamber 2100, it will be appreciated that energy storage chamber 2100 may be provided with a fan unit analogous to fan unit 1174.

Figure 14:
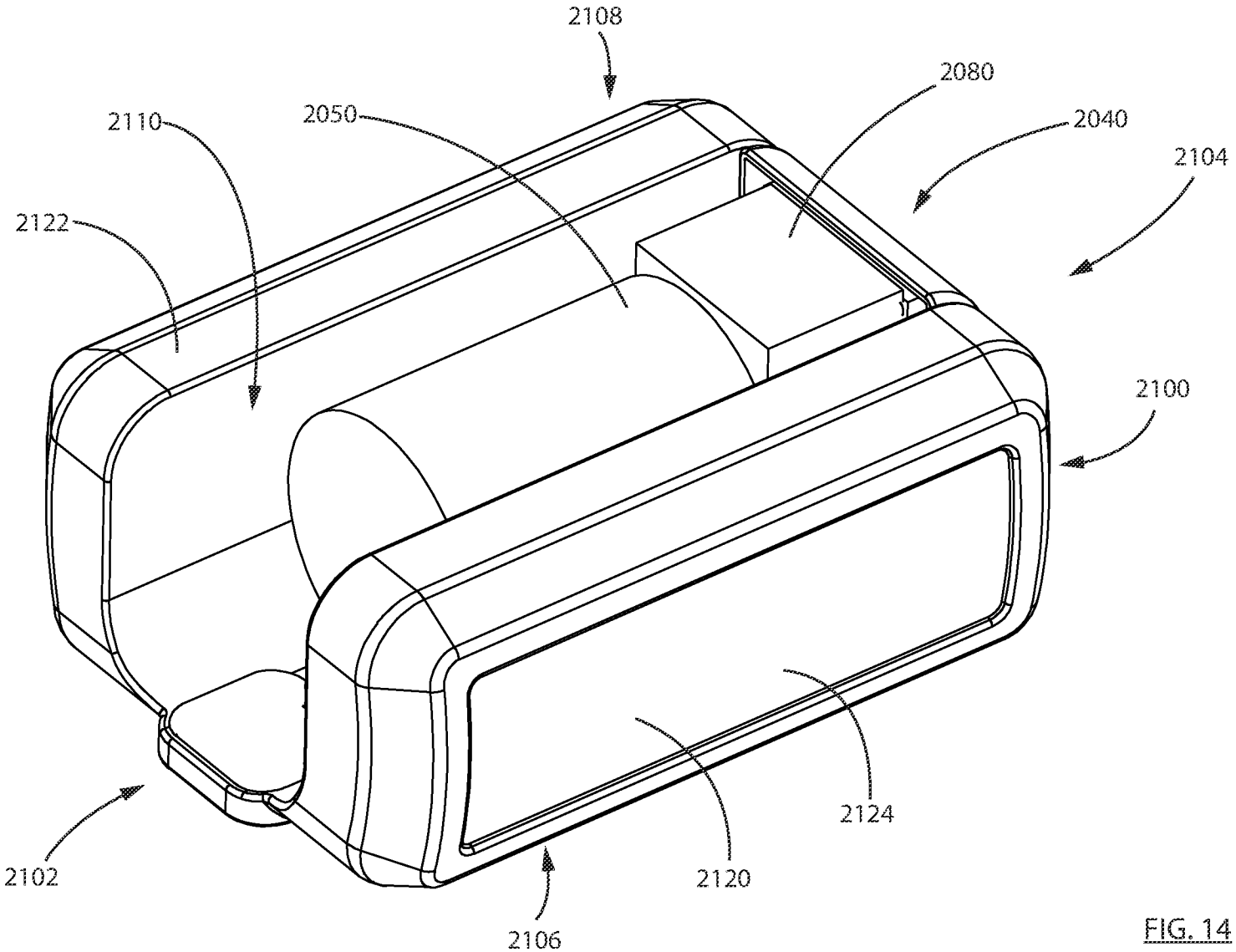
FIG. 14 is a top front perspective isolation view of an alternative energy storage chamber, suction motor, and post-motor filter in accordance with an embodiment.

As shown in FIG. 14, the energy storage chamber 1100 has a housing 2120 with a pair of opposed lateral side sections 2122 and 2124. A void or open volume 2110 is defined between the lateral housing sections 2122 and 2124. The volume 2110 may define a receiving or nesting space within which components of a hand vacuum cleaner can be positioned when the energy storage chamber 2100 is mounted thereto.

As with energy storage chamber 1100, the energy storage members 2150 are arranged into upper and lower rows within the lateral housing sections 2122 and 2124. In the energy storage chamber 2100, each row includes two energy storage members 2150 (upper energy storage members 2150*u* and lower energy storage members 21501) that extend lengthwise along the energy storage chamber 2100 between the front 2102 and rear 2104.

In the example shown, a post-motor filter 2080 is positioned in the air flow path downstream from the suction motor 2050. The post-motor filter 2080 can filter air exiting the suction motor 2050 before the air exits the vacuum cleaner via clean air outlet 2040. The rotational axis of the suction motor 2050 can pass through the outer perimeter of the post-motor filter 2080. This may reduce the number of air flow directions, and thus reduce backpressure and/or air flow losses through this portion of the hand vacuum cleaner.

Figure 15:
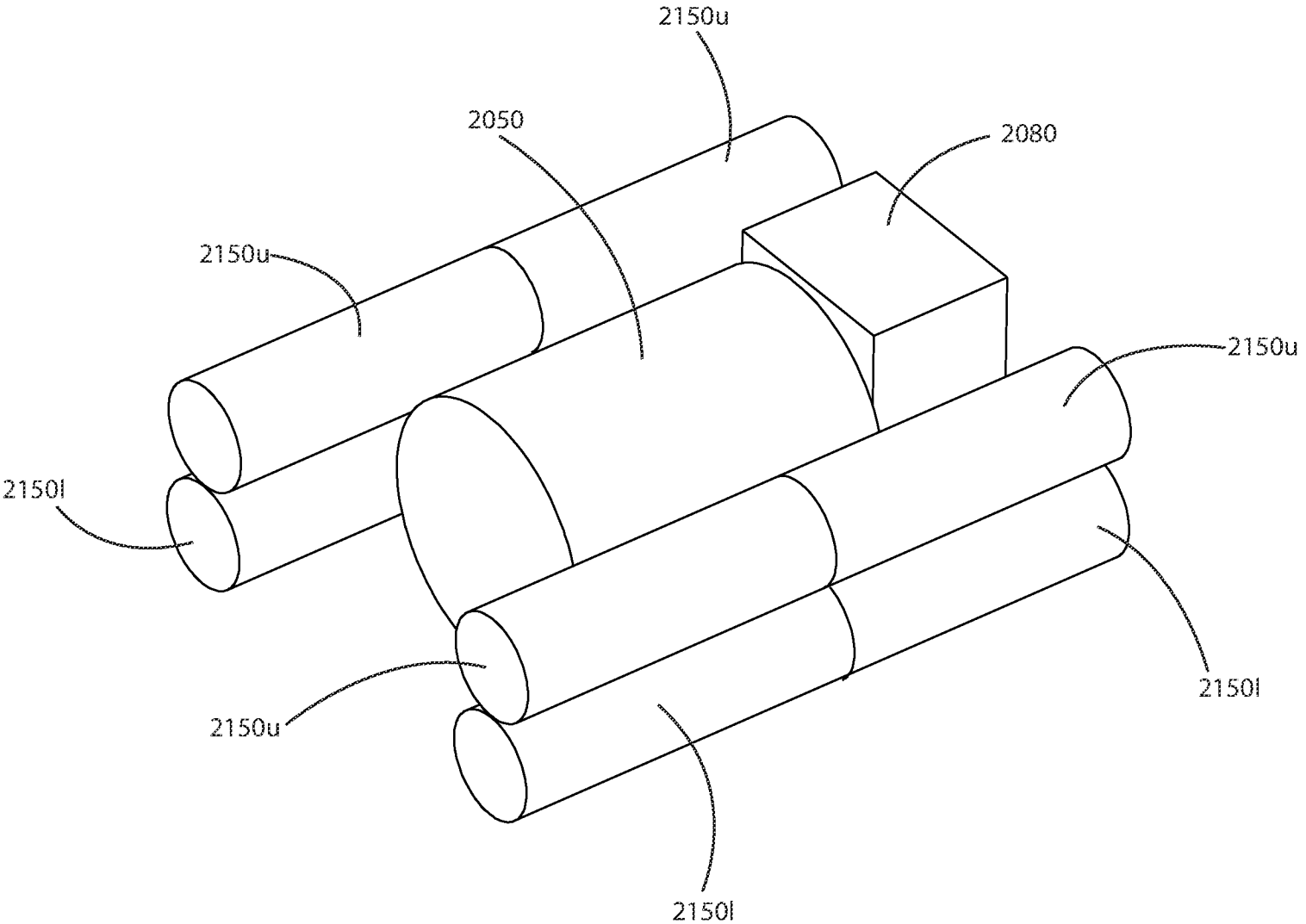
FIG. 15 is a top front perspective isolation view of the energy storage chamber, suction motor, and post-motor filter of FIG. 14 with a housing of the energy storage chamber and suction motor removed.
Figure 16:
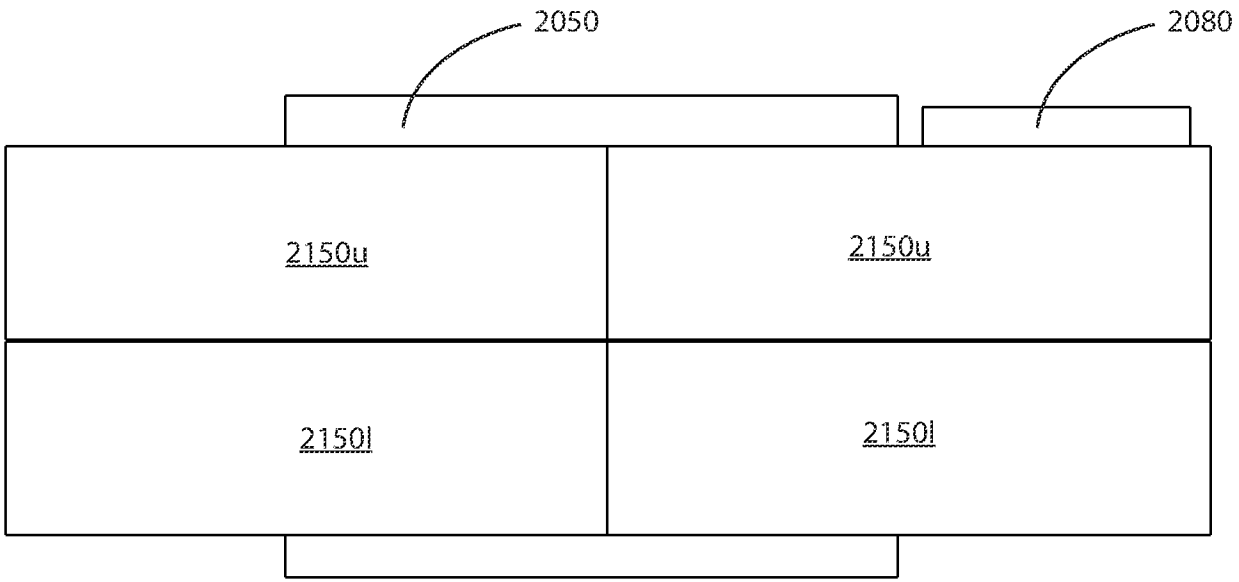
FIG. 16 is a side view of the energy storage chamber, suction motor, and post-motor filter of FIG. 15.
Figure 17:
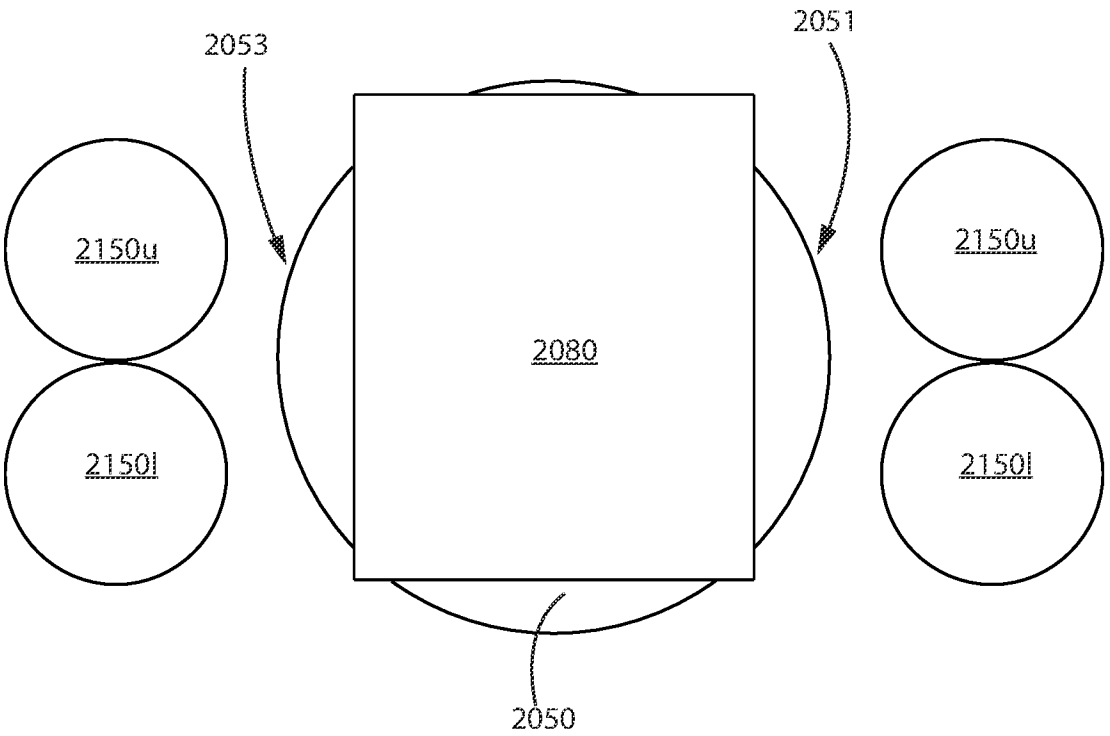
FIG. 17 is a rear view of the energy storage chamber, suction motor, and post-motor filter of FIG. 15.

As exemplified in FIG. 15, when the energy storage chamber 2100 is mounted on the hand vacuum cleaner, all of the post-motor filter 2080 is positioned between the energy storage members 2150. As exemplified, the post-motor filter 2080 is positioned between the rear energy storage members 2150 of both the upper and lower rows.

As shown, the post-motor filter 2080 can be sized to fit entirely within the open volume 2110 of the energy storage chamber 2100. Alternatively, a portion of the post-motor filter 2080 may extend outside of the open volume 2110, for instance above the upper end of the energy storage chamber 2100 and/or rearward of the energy storage members.

The suction motor 2050 can also be positioned between the energy storage members 2150 of energy storage chamber 2100. As shown in FIG. 14, the suction motor 2050 also nests within the open volume 2110. This may provide a compact nesting arrangement for the batteries, suction motor 2050 and post-motor filter 2080, while also ensuring substantially linear air flow between suction motor 2050 and post-motor filter 2080. As shown, a portion of both the forward and rearward energy storage members 2150 in the upper and lower rows can be positioned on both lateral sides 2051 and 2053 of the suction motor 2050. The suction motor 2050 can be laterally adjacent to a portion of each of the energy storage members 2150 in the energy storage chamber 2100.

A portion of the open volume 2110 is located forward of the suction motor 2050. This may allow the energy storage chamber 2100 to nest with other components of the hand vacuum cleaner, such as a pre-motor filter. Additionally, or alternatively, a fan unit may be positioned within this empty region of open volume 2110.

Figure 18:
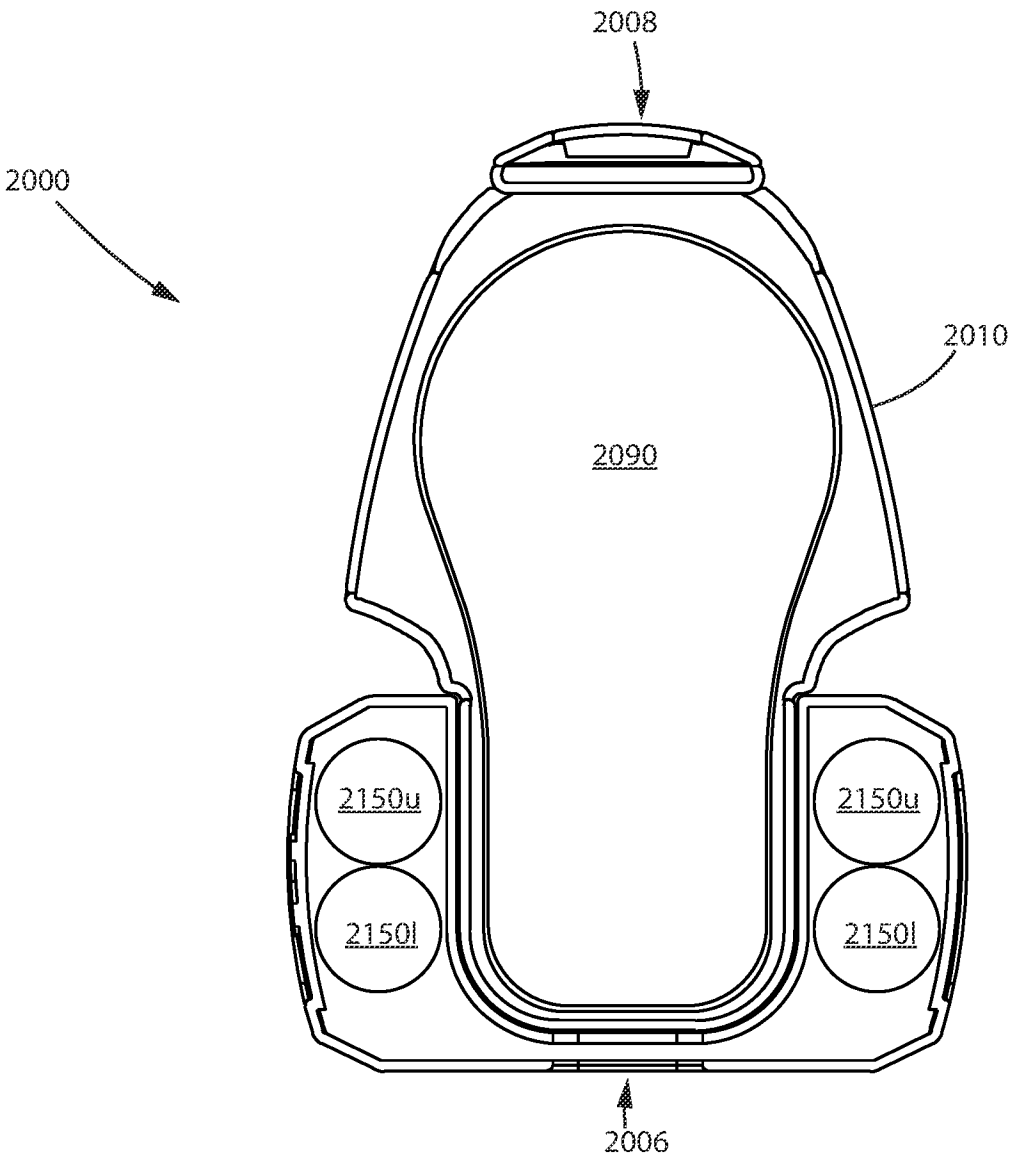
FIG. 18 is a section view of an alternative hand vacuum cleaner in accordance with an embodiment.
Figure 19:
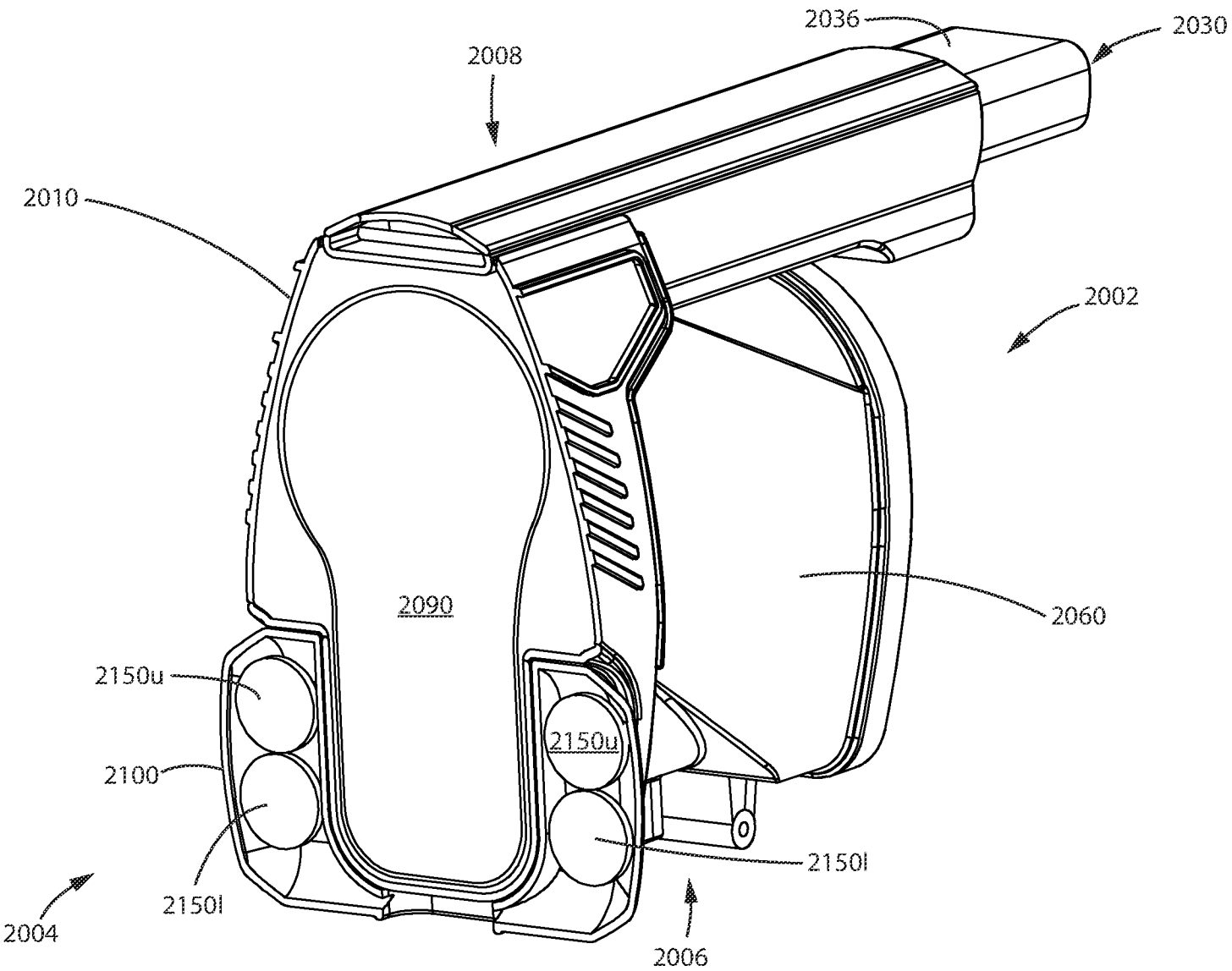
FIG. 19 is a rear perspective sectional view of the hand vacuum cleaner of FIG. 18.

As shown in FIGS. 18 and 19, the energy storage chamber 2100 may be used with an alternative hand vacuum cleaner 2000. The hand vacuum cleaner 2000 can include a pre-motor filter 2090 that nests at least partially between the energy storage members 2150 of the energy storage chamber 2100. As shown, the pre-motor filter 2090 extends downward into the forward portion of the open volume 2110 (e.g., the forward portion that is vacant in FIG. 15). This lower portion of the pre-motor filter 2090 can thus be positioned between the front energy storage members 2150 when the energy storage chamber 2100 is mounted to the hand vacuum cleaner 2000.

Nesting the pre-motor filter 2090 between the energy storage members 2150 may allow the hand vacuum cleaner to provide a substantially linear air flow between the outlet of the pre-motor filter 2090, the suction motor 2050, and the post-motor filter 2080. In the example illustrated, the rotational axis of the suction motor 2050 extends through a portion of the pre-motor filter 2090 and through a portion of the post-motor filter 2080. Air can travel through this section of the hand vacuum cleaner 2000 with minimal changes in direction, which may backpressure and/or air flow losses.

Figure 20:
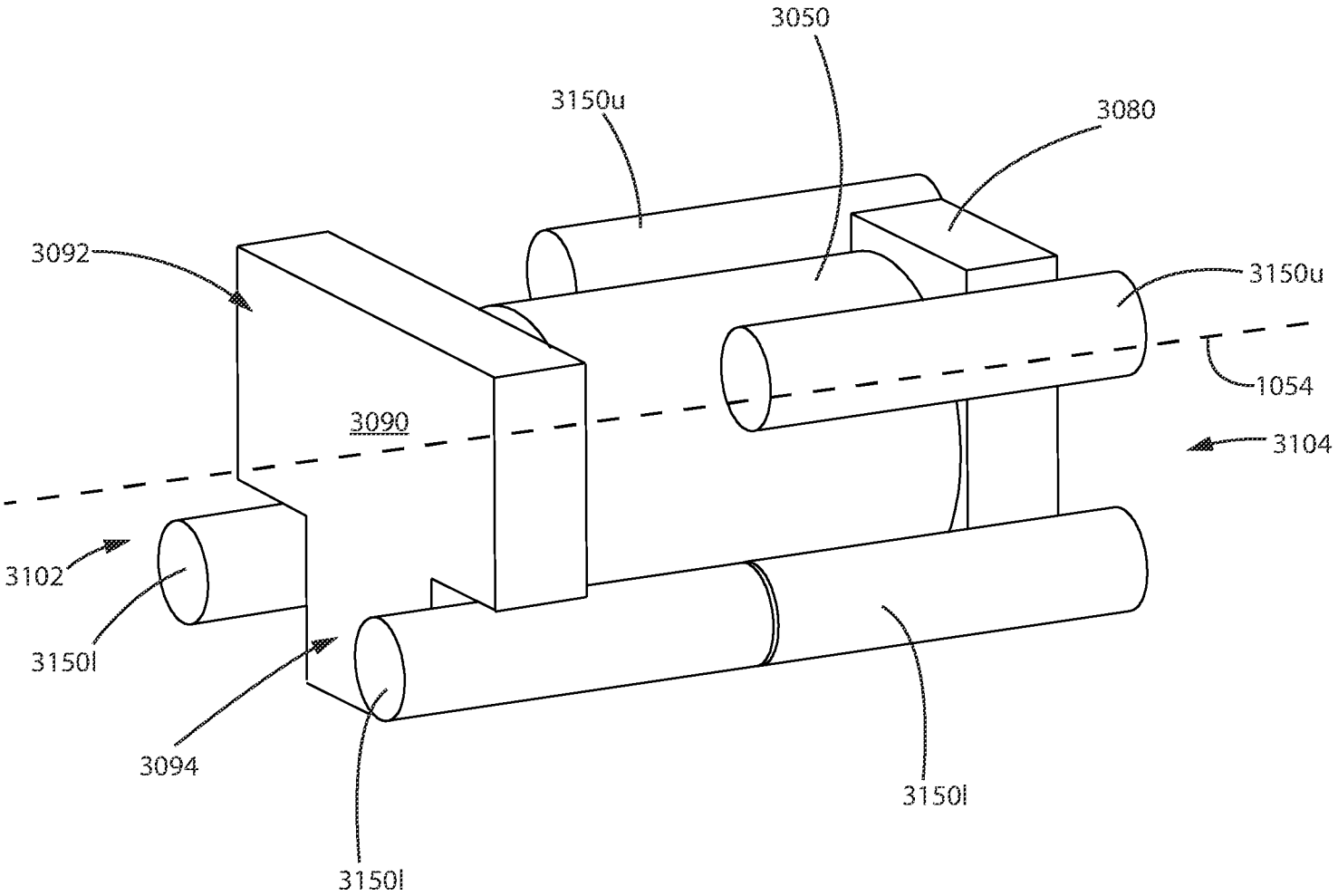
FIG. 20 is a top front perspective isolation view of an energy storage chamber, suction motor, pre-motor filter and post-motor filter that may be used with the vacuum cleaner of FIG. 18 with a housing of the energy storage chamber and suction motor removed.
Figure 21:
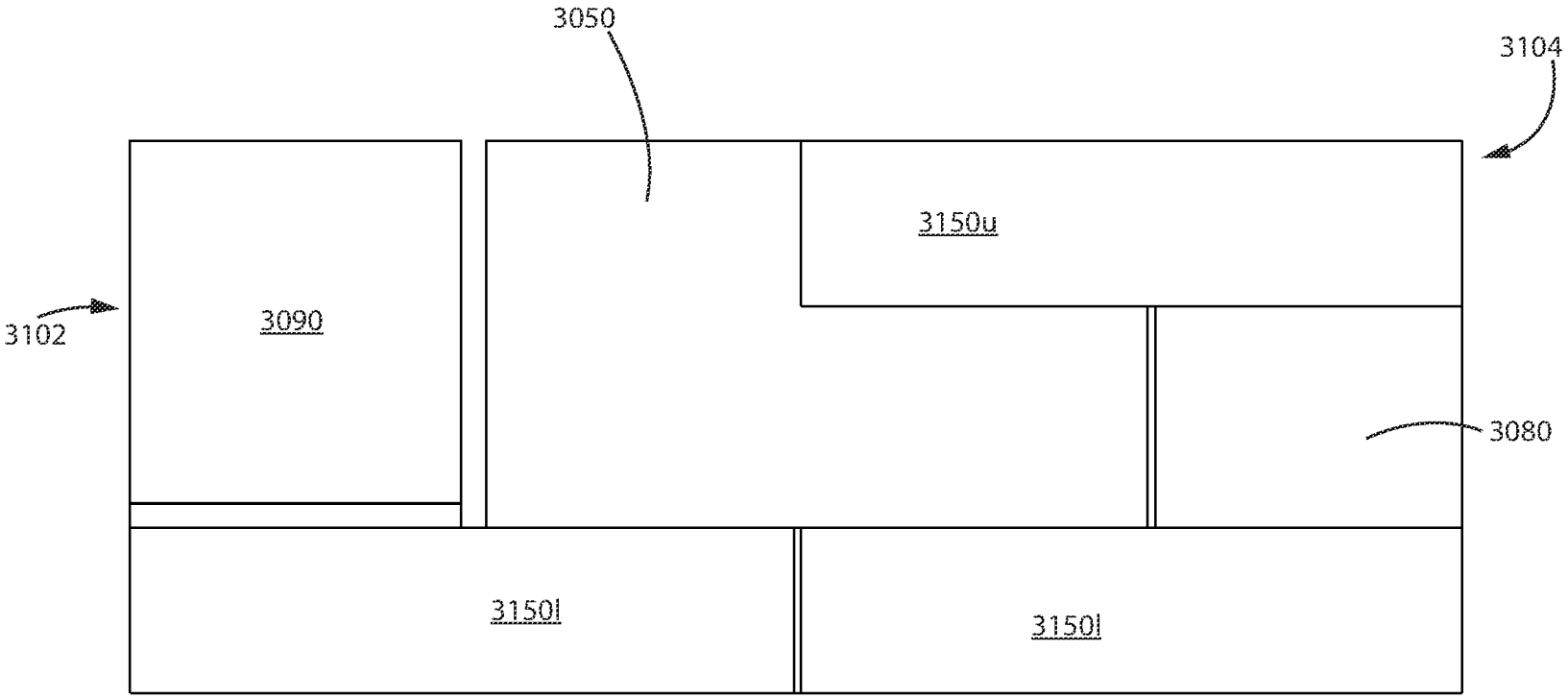
FIG. 21 is a side view of the energy storage chamber, suction motor, pre-motor filter and post-motor filter of FIG. 20.
Figure 22:
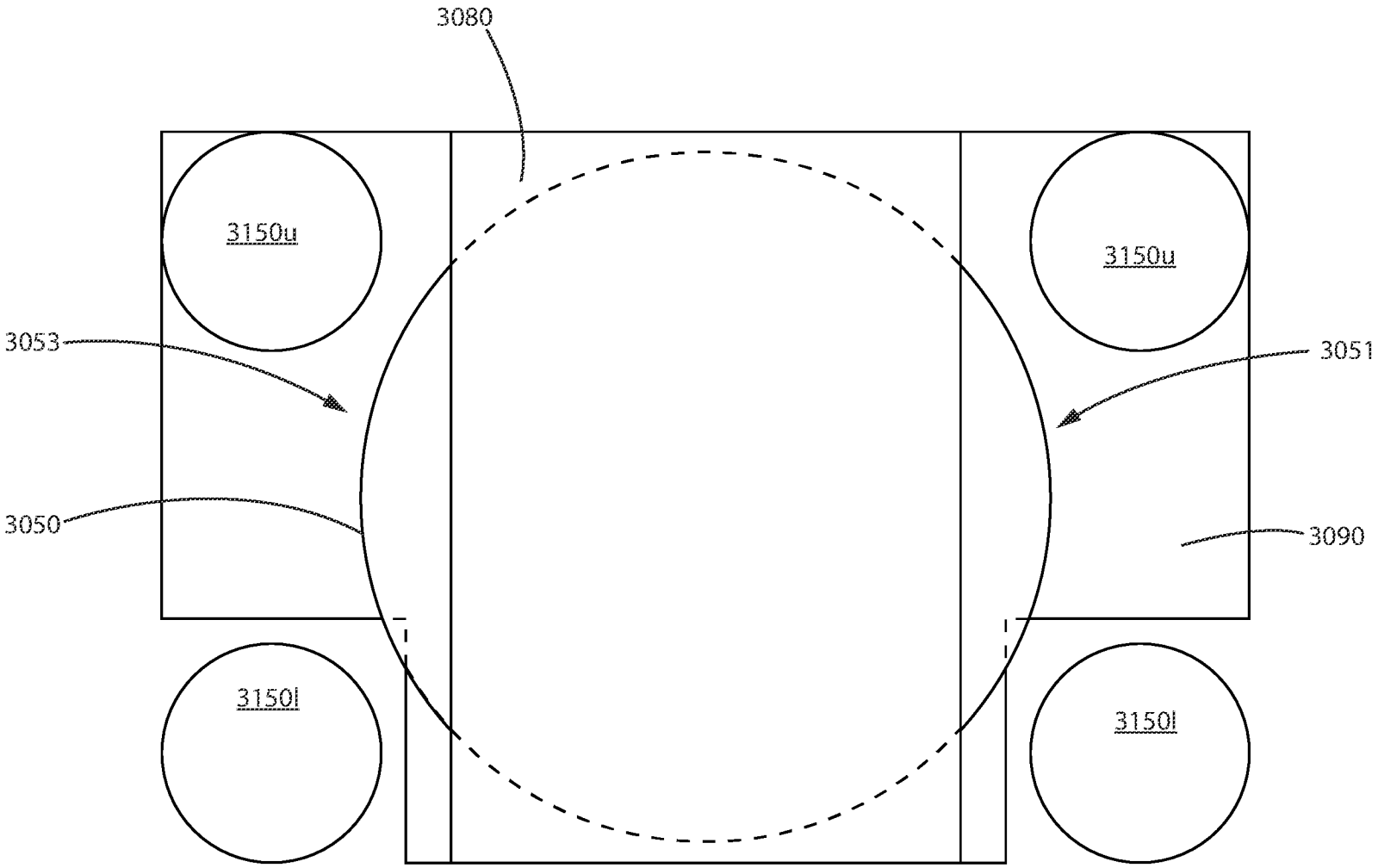
FIG. 22 is a rear view of the energy storage chamber, suction motor, pre-motor filter and post-motor filter of FIG. 20.

Referring to FIGS. 20-22, shown therein is an alternative example of a nesting arrangement for a hand vacuum cleaner, such as hand vacuum cleaners 1000 and 2000. As shown, energy storage members 3150 are arranged into two rows, upper energy storage members 3150*u* and lower energy storage members 31501. As with energy storage chambers 1100 and 2100, the energy storage members 3150 can be contained within lateral housing sections of the energy storage chamber.

As with energy storage chamber 2100, the suction motor 3050 and post-motor filter 3080 can be positioned between the energy storage members 3150. Energy storage members 3150*u* and 31501 are positioned on both lateral sides 3051 and 3053 of the suction motor 3050. A portion of a pre-motor filter 3090 can also be positioned between the energy storage members 3150. The rotational axis of the suction motor 3050 passes through both the pre-motor filter 3090 and post-motor filter 3080, allowing for substantially linear air flow in this section of the vacuum cleaner.

However, unlike the energy storage chambers 1100 and 2100, the rows of energy storage members 3150 have different lengths. As shown, the upper row of energy storage members 3150*u* includes fewer energy storage members, in this case only one energy storage member in each upper row, as compared to two energy storage members 31501 in the lower rows. This allows components of the hand vacuum cleaner to nest above (i.e., to overlie) the batteries 31501 in the lower row at the front 3102 of the energy storage chamber—in front of the upper batteries 3150*u* that are positioned at the rear 3104.

In the example illustrated, the pre-motor filter 3090 has a first portion 3092 and a second portion 3094. The first, or upper portion, 3092 has a wider lateral extent, with an axis of the upper energy storage members 3150*u* extending through the upper portion 3092. The upper portion 3092 can overlie a portion of the lower energy storage members 31501 that are positioned at the front of the energy storage chamber. The lower portion 3094 has a narrower lateral width and is positioned between the front lower energy storage members 31501.

Accordingly, by varying the length of one or more rows of the energy storage members (e.g., using more or fewer batteries), an open volume of different shapes may be provided which can be used to accommodate more or less of a filter and/or the suction motor. Preferably, the same number of batteries are provided on each lateral side so as to provide a more uniform weight distribution on either side of a central plane extending longitudinally (front to back) through the hand vacuum cleaner.

Figure 23:
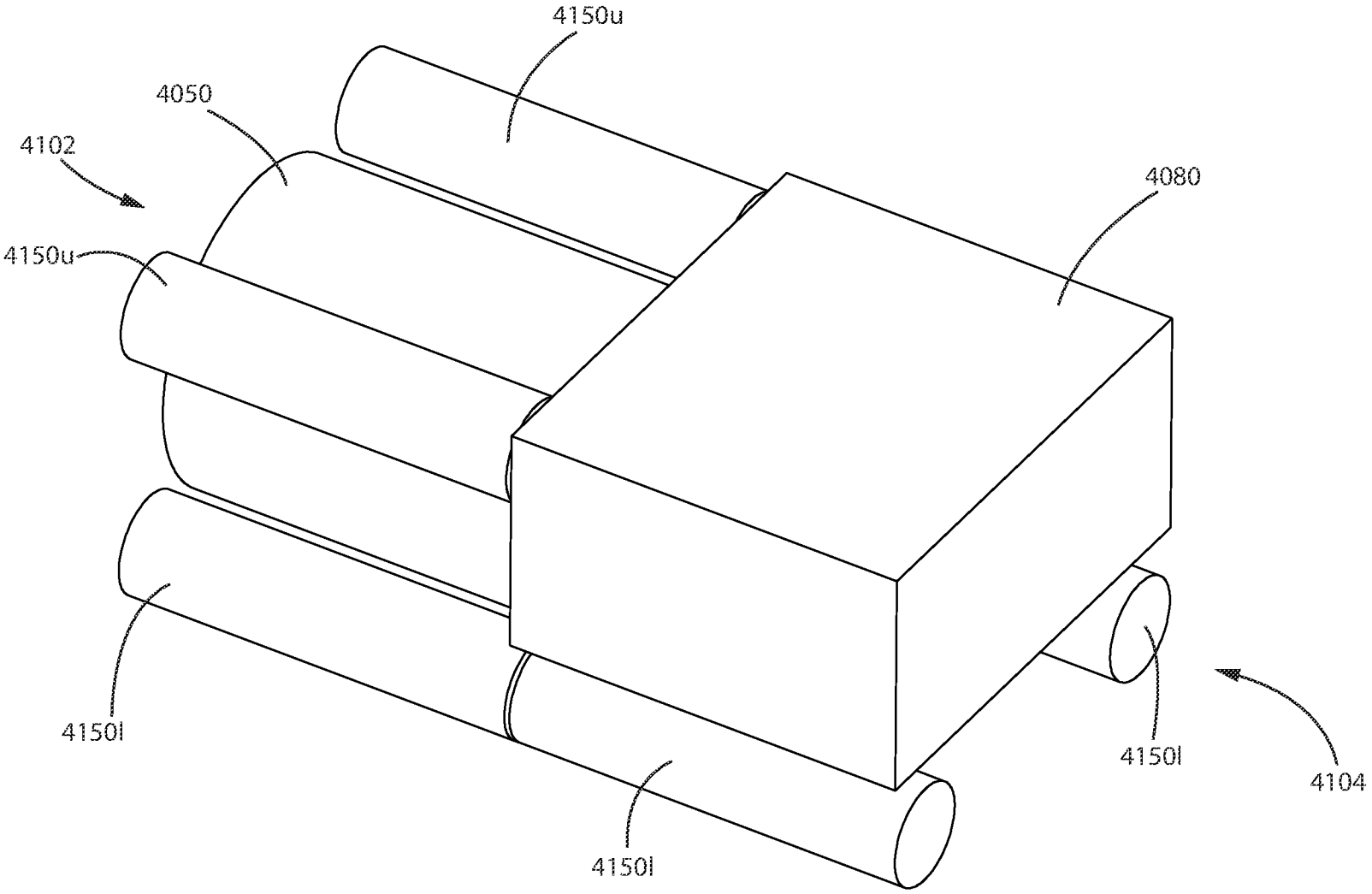
FIG. 23 is a rear perspective isolation view of an alternative energy storage chamber, suction motor and post-motor filter that may be used with the hand vacuum cleaner of FIG. 1 or FIG. 18 in accordance with an embodiment with a housing of the energy storage chamber and the suction motor removed.
Figure 24:
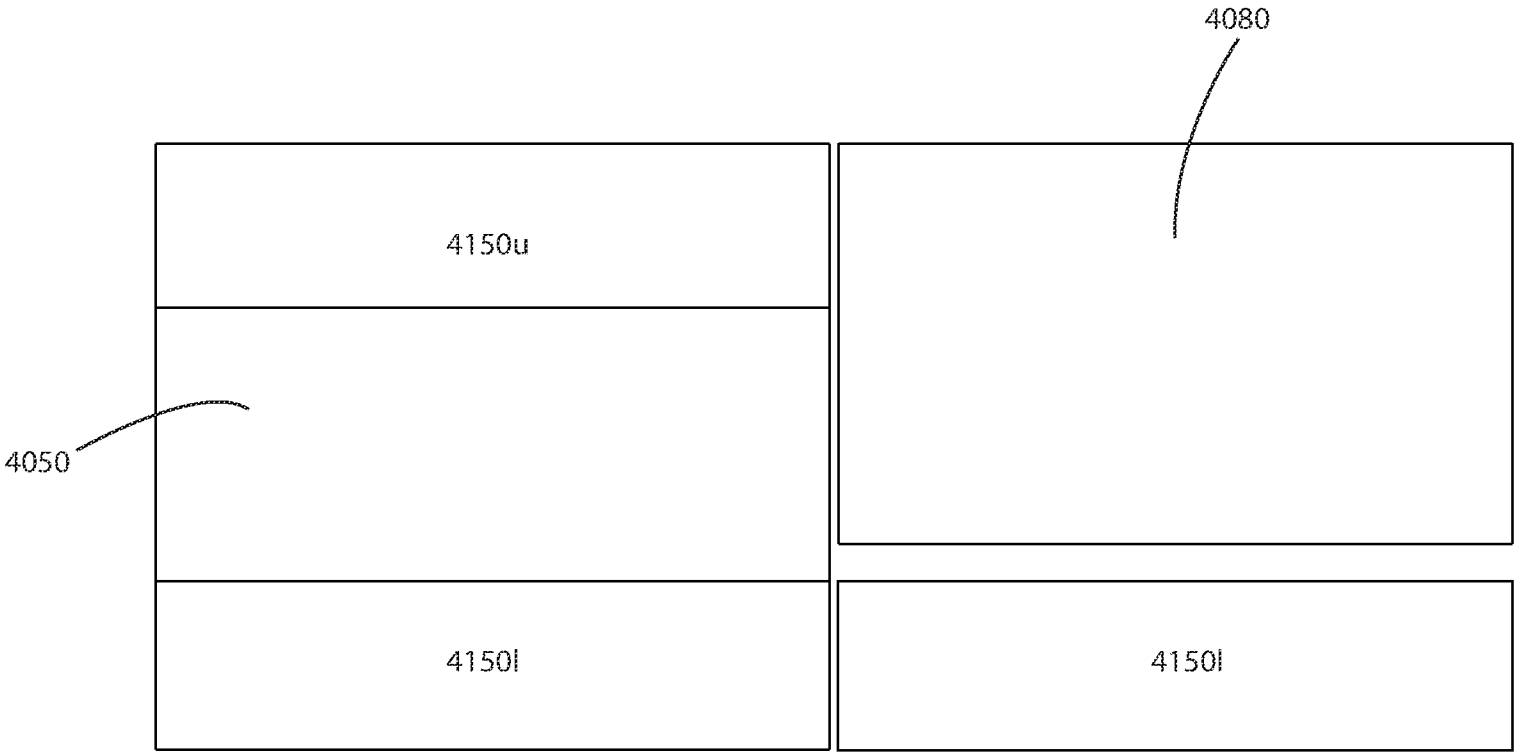
FIG. 24 is a side view of the energy storage chamber, suction motor and post-motor filter of FIG. 23.
Figure 25:
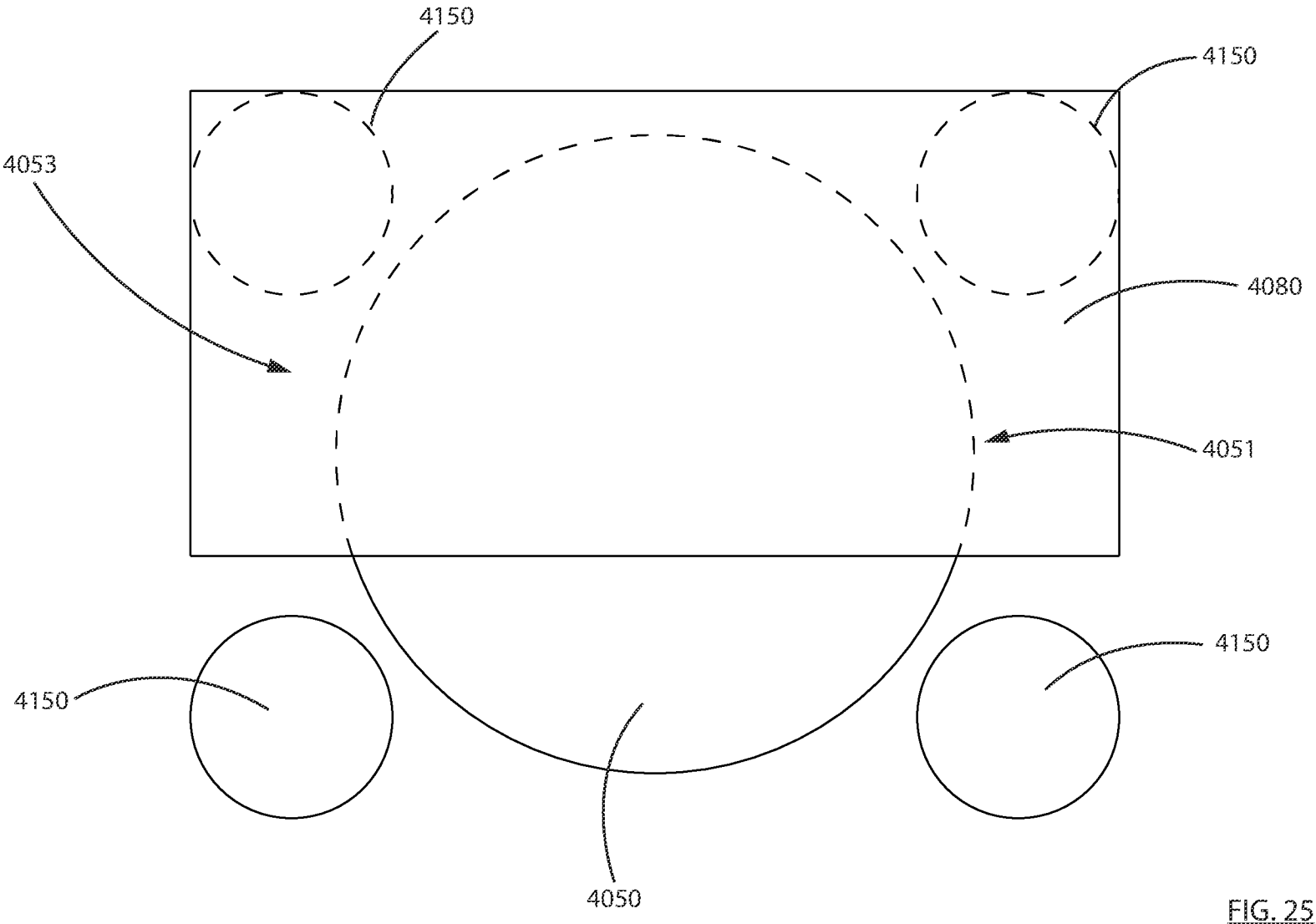
FIG. 25 is a rear view of the energy storage chamber, suction motor and post-motor filter of FIG. 23.

Referring to FIGS. 23-25, shown therein is an alternative example of a nesting arrangement for a hand vacuum cleaner, such as hand vacuum cleaners 1000 and 2000. As with the example shown in FIGS. 20-22, energy storage members 4150 are arranged into upper and lower rows, extending axially between the front 4102 and rear 4104 of the energy storage chamber. As shown, the lower energy storage members 41501 extend along a greater axial extent than the upper energy storage members 4150*u*. However, in this example the lower row of energy storage members 41501 extends rearward of the upper row of energy storage members 4150*u* (i.e., there are no upper energy storage members 4150*u* at the rear 4104 of the energy storage chamber). As with energy storage chambers 1100 and 2100, the energy storage members 4150 can be contained within lateral housing sections of the energy storage chamber.

As shown, the post-motor filter 4080 can overlie the rear lower energy storage members 4150. The post-motor filter 4080 can also extend across the longitudinal axis of the upper energy storage members 4150*u* on either lateral side.

The suction motor 4050 can be positioned centrally between the upper energy storage members 4150*u* and lower energy storage members 41501 at the front 4102. Energy storage members 4150*u* and 41501 are positioned on both lateral sides 4051 and 4053 of the suction motor 4050. The rotational axis of the suction motor 4050 can extend through the post-motor filter 4080, allowing for substantially linear air flow towards the clean air outlet.

Figure 26:
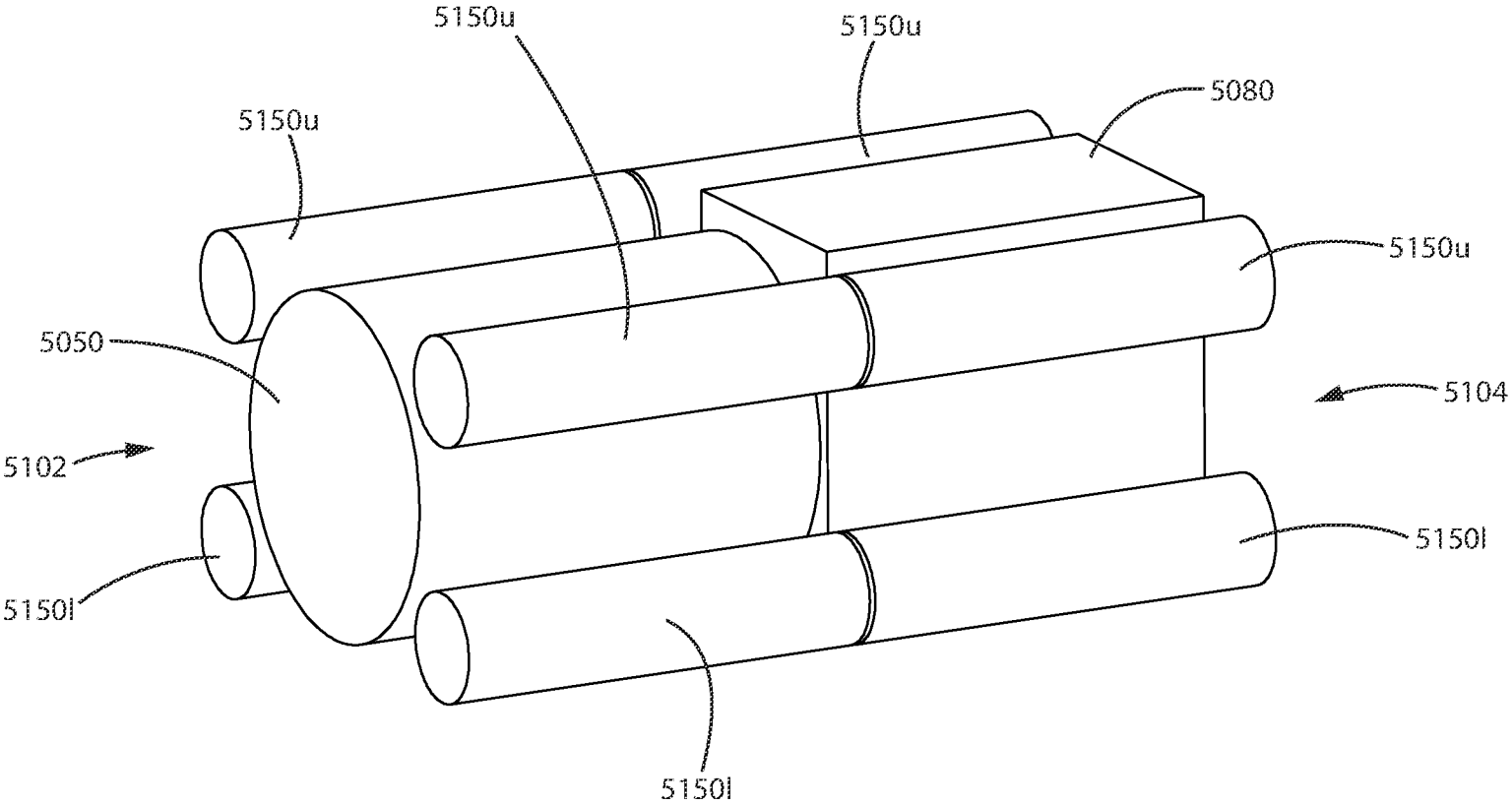
FIG. 26 is a front perspective isolation view of another alternative energy storage chamber, suction motor and post-motor filter that may be used with the hand vacuum cleaner of FIG. 1 or FIG. 18 in accordance with an embodiment with a housing of the energy storage chamber and suction motor removed.
Figure 27:
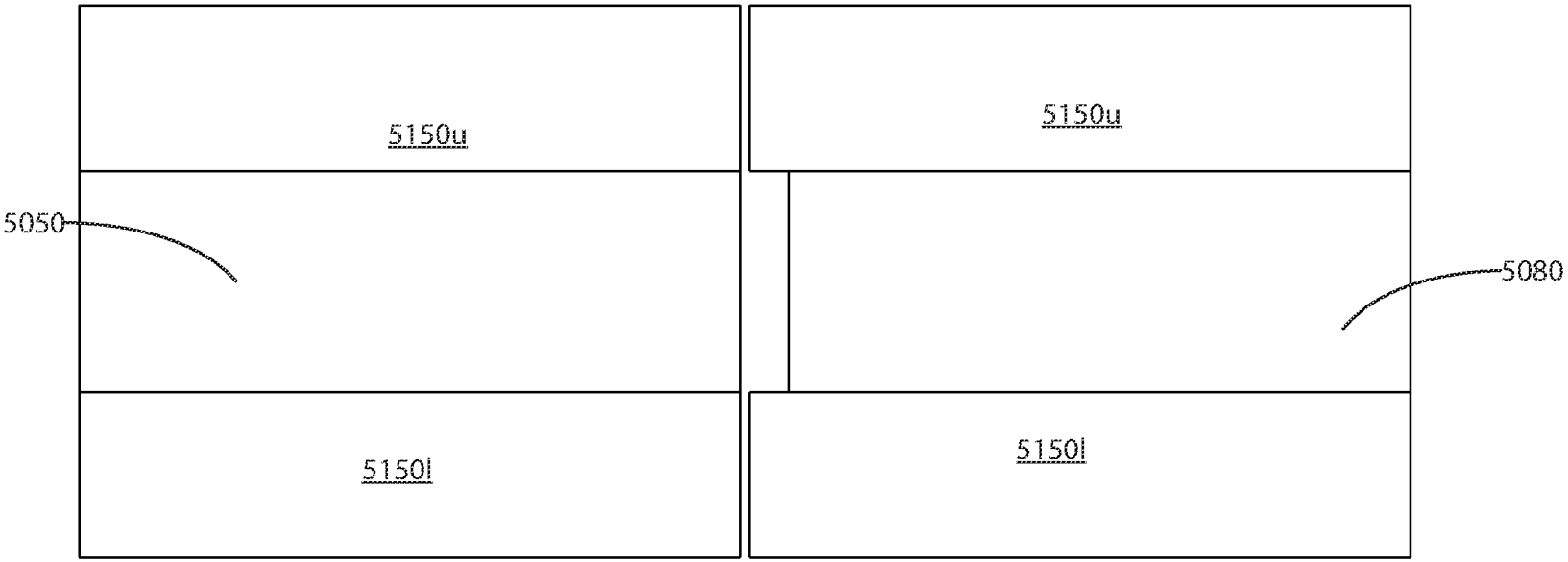
FIG. 27 is a side view of the energy storage chamber, suction motor and post-motor filter of FIG. 26.
Figure 28:
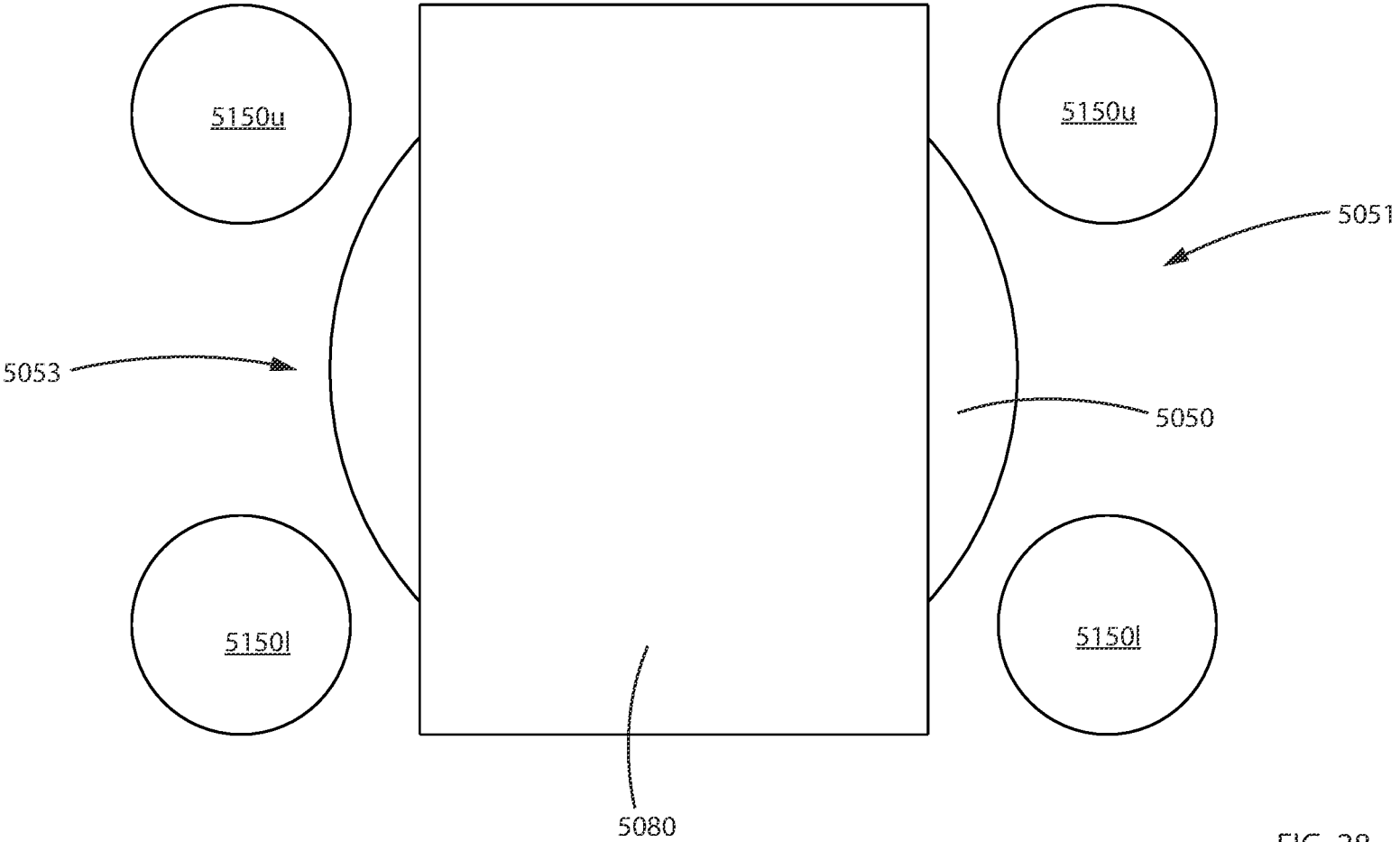
FIG. 28 is a rear view of the energy storage chamber, suction motor and post-motor filter of FIG. 26.
Figure 29:
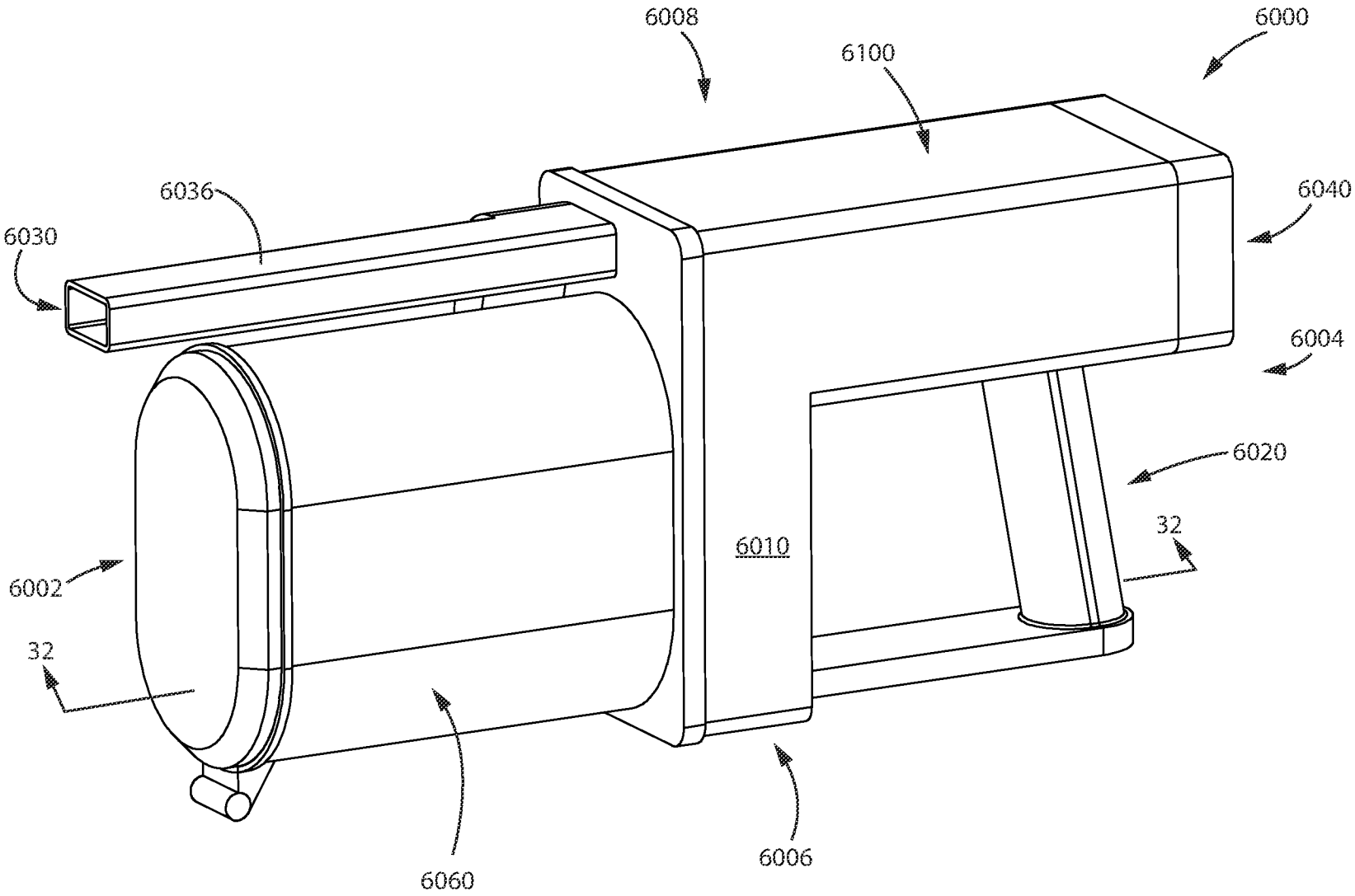
FIG. 29 is a top front perspective view of an alternative hand vacuum cleaner in accordance with an embodiment.

Referring to FIGS. 26-28, shown therein is an alternative example of a nesting arrangement for a hand vacuum cleaner, such as hand vacuum cleaners 1000 and 2000. In the example shown in FIGS. 26-28, the energy storage members 5150 are arranged into upper and lower rows, extending axially between the front 4102 and rear 4104 of the energy storage chamber. As shown, the upper and lower rows having the same length, similar to energy storage chambers 1100 and 2100. However, in the example shown here, the suction motor 5050 extends along the entire length of the energy storage members 5150*u* and 51501 at the front 5102 of the energy storage chamber.

Energy storage members 5150*u* and 51501 are positioned on both lateral sides 5051 and 5053 of the suction motor 5050. The post-motor filter 5080 is nested between the energy storage members 5150 at the rear 5104 of the energy storage chamber. As with energy storage chambers 1100 and 2100, the energy storage members 5150 can be contained within lateral housing sections of the energy storage chamber.

Referring to FIGS. 29-32, shown therein is an alternative example of a hand vacuum cleaner 6000. The hand vacuum cleaner 6000 is an example of a hand vacuum cleaner in which the energy storage chamber 6100 is mounted to the upper portion of the main body 6110. The features of hand vacuum cleaner 6000 similar to those of hand vacuum cleaner 1000 are identified using reference numerals incremented by 5000.

As with hand vacuum cleaner 1000, the hand vacuum cleaner 6000 includes a main body 6010 having a housing, a handle 6020, an air treatment member 6060 connected to the main body 6010, a dirty air inlet 6030, a clean air outlet 6040, and an air flow path 6031 extending between the dirty air inlet 6030 and the clean air outlet 6040, which may be referred to as a first or primary air flow path. However, in hand vacuum cleaner 6000, the clean air outlet 6040 is positioned at the upper rear of the main body 6010.

Surface cleaning apparatus 6000 has a front end 6002, a rear end 6004, an upper end or top 6006, and a lower end or bottom 6008. A motor and fan assembly is provided to generate vacuum suction through the first air flow path 6031. In the example shown, the motor and fan assembly includes a suction motor 6050.

As with hand vacuum cleaner 1000, the air treatment member 6060 may be any air treatment member and is exemplified as a cyclone assembly having a single cyclonic cleaning stage with a single cyclone chamber 6062. In the example shown, a dirt collection region 6064 in included that is external to the cyclone chamber 6062.

Figure 30:
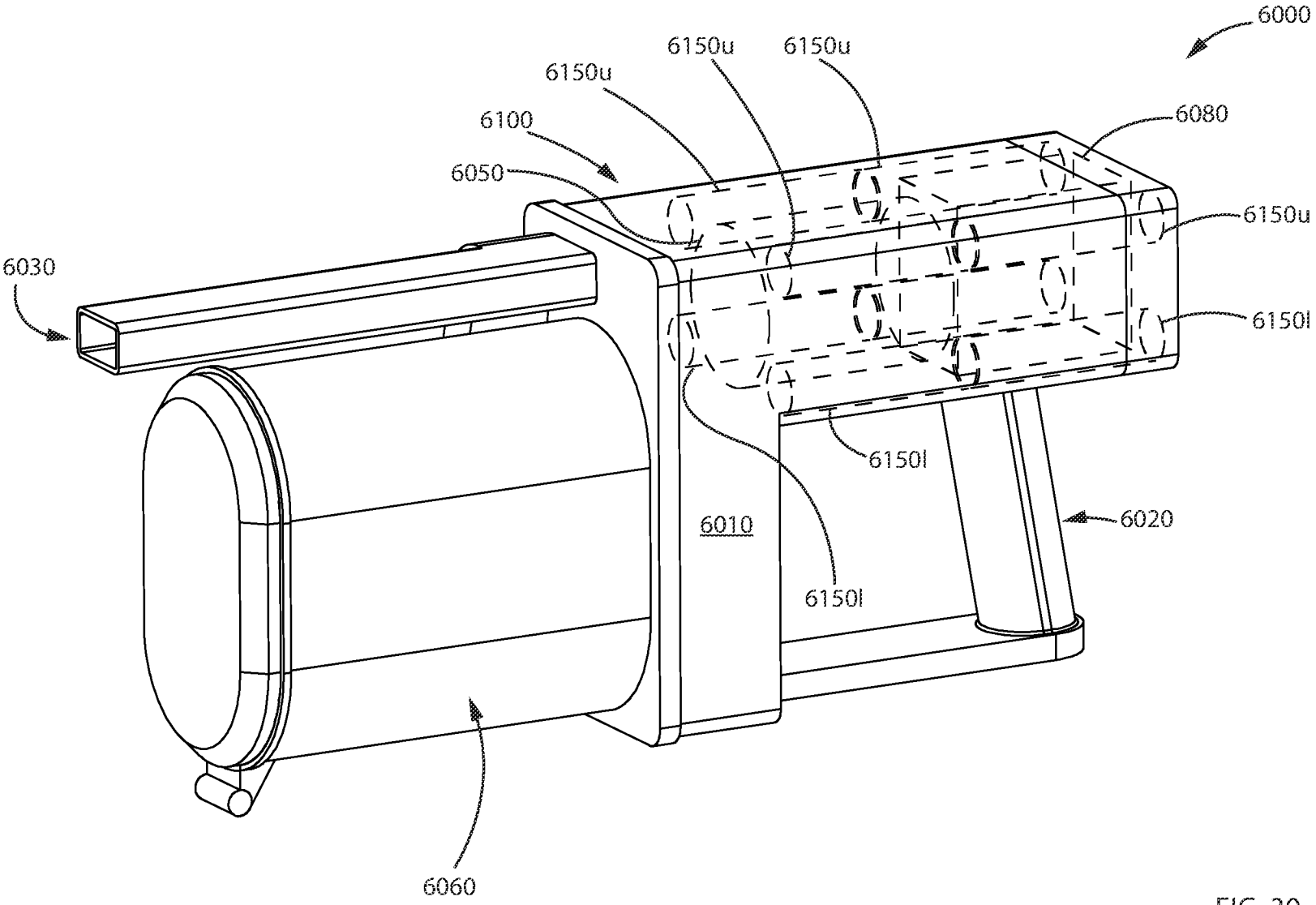
FIG. 30 is a top front perspective view of the hand vacuum cleaner of FIG. 29 showing the internal position of the energy storage chamber, suction motor and post-motor filter in accordance with an embodiment.
Figure 31:
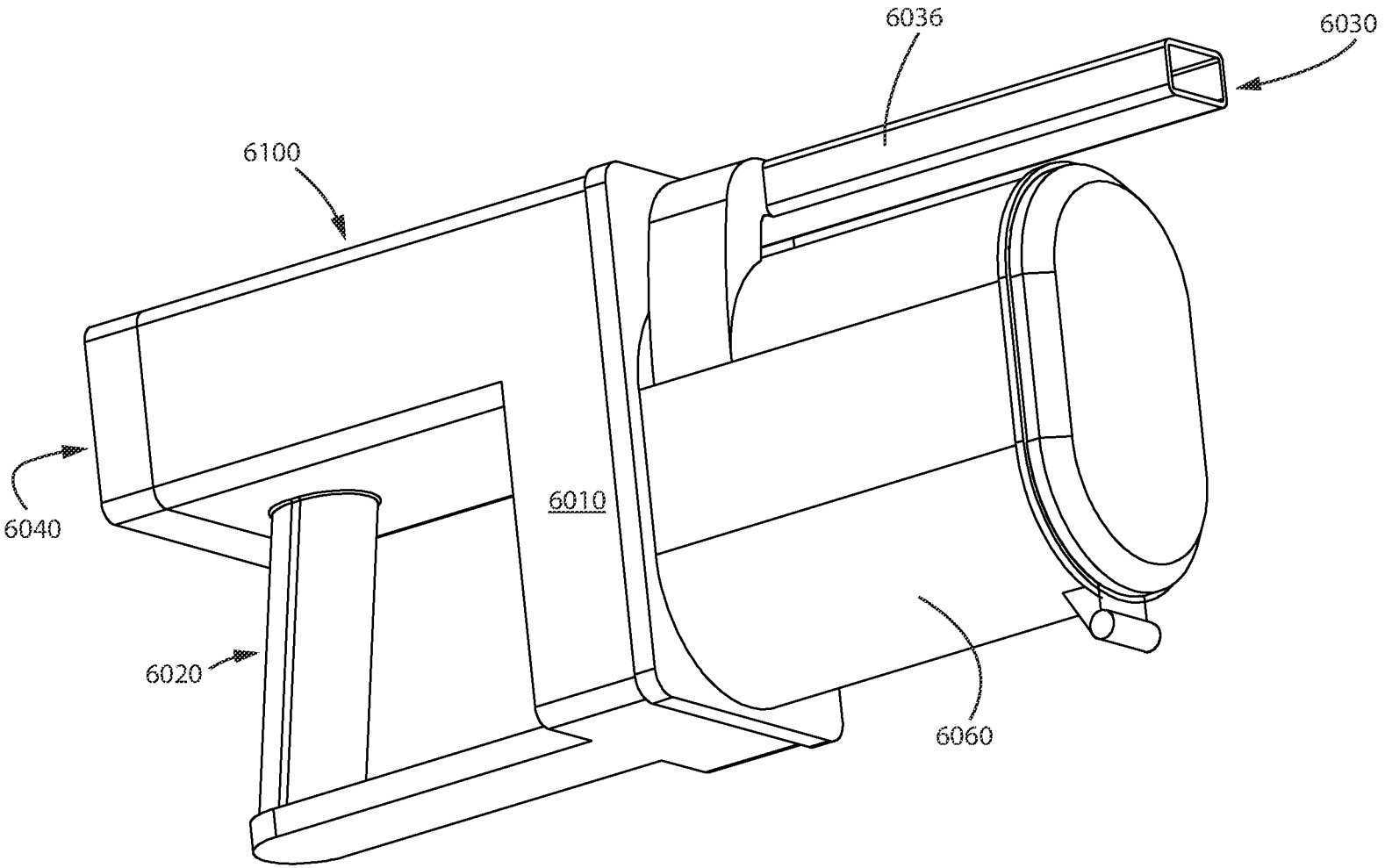
FIG. 31 is a bottom front perspective view of the hand vacuum cleaner of FIG. 29.
Figure 32:
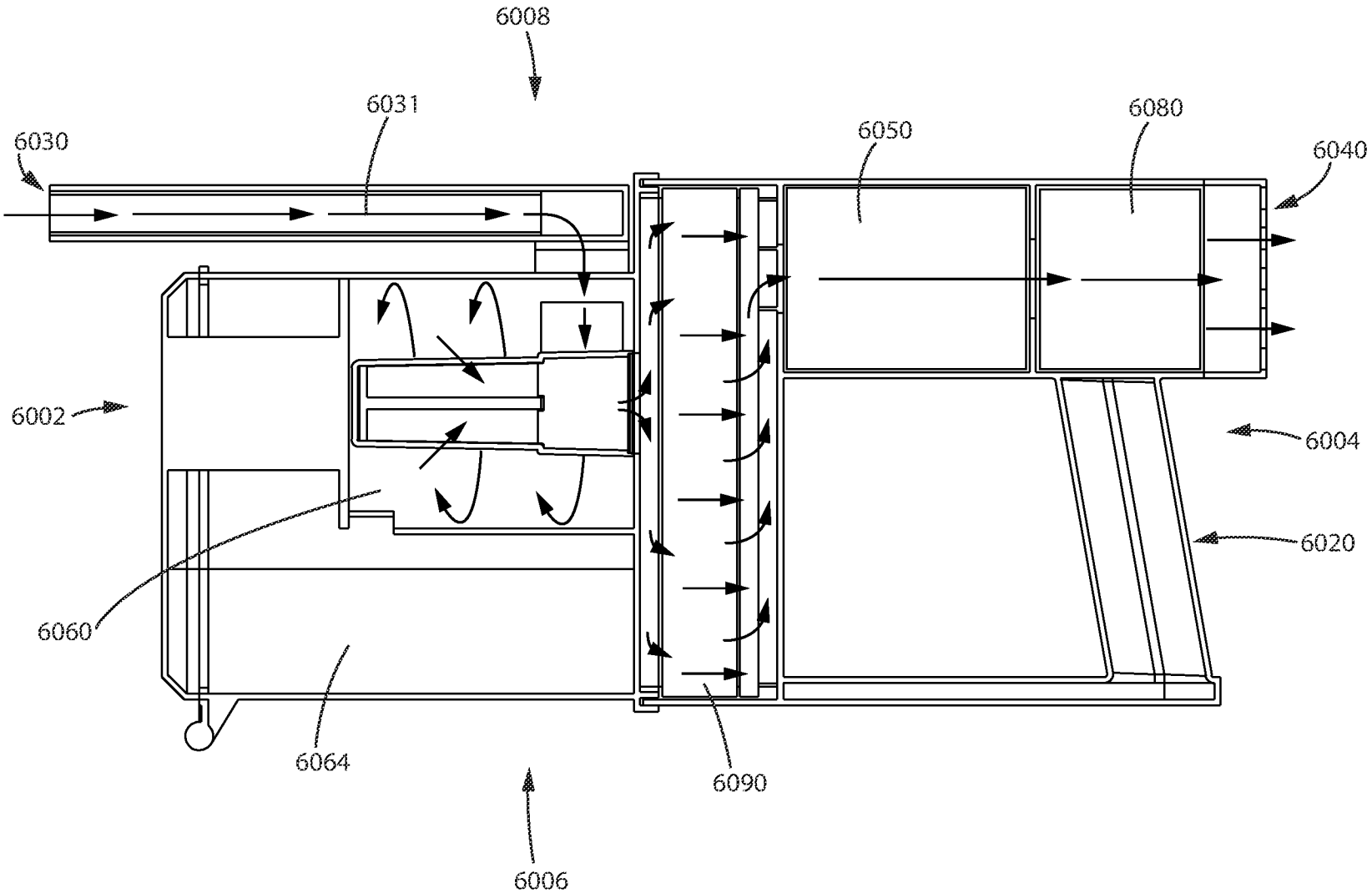
FIG. 32 is a cross-sectional view of the hand vacuum cleaner of FIG. 29 along line 32-32 in FIG. 29.
Figure 33:
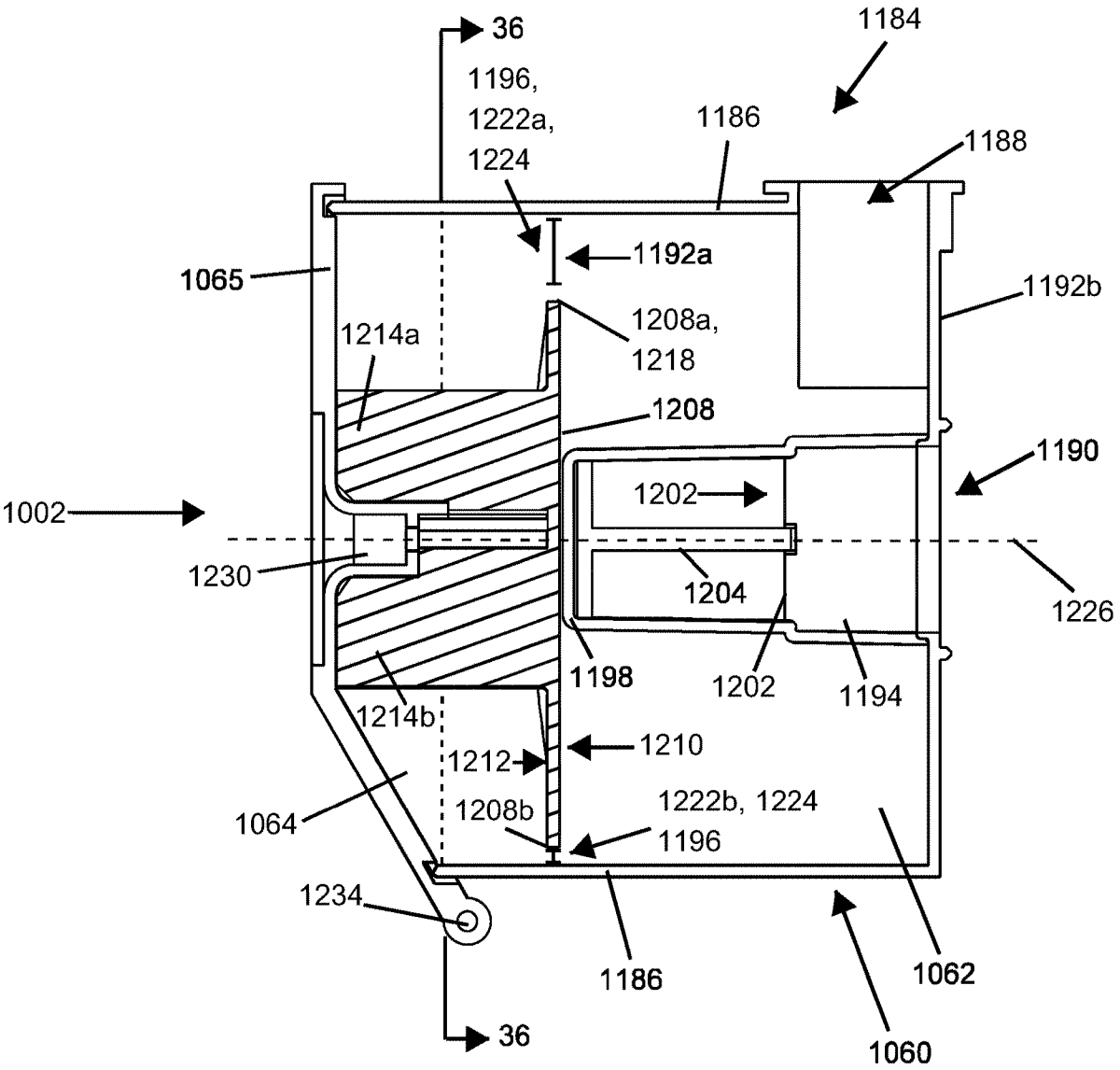
FIG. 33 is a cross-sectional isolation view of an air treatment member of the hand vacuum cleaner of FIG. 1, taken along line 3-3 of FIG. 1, in accordance with another embodiment.
Figure 34:
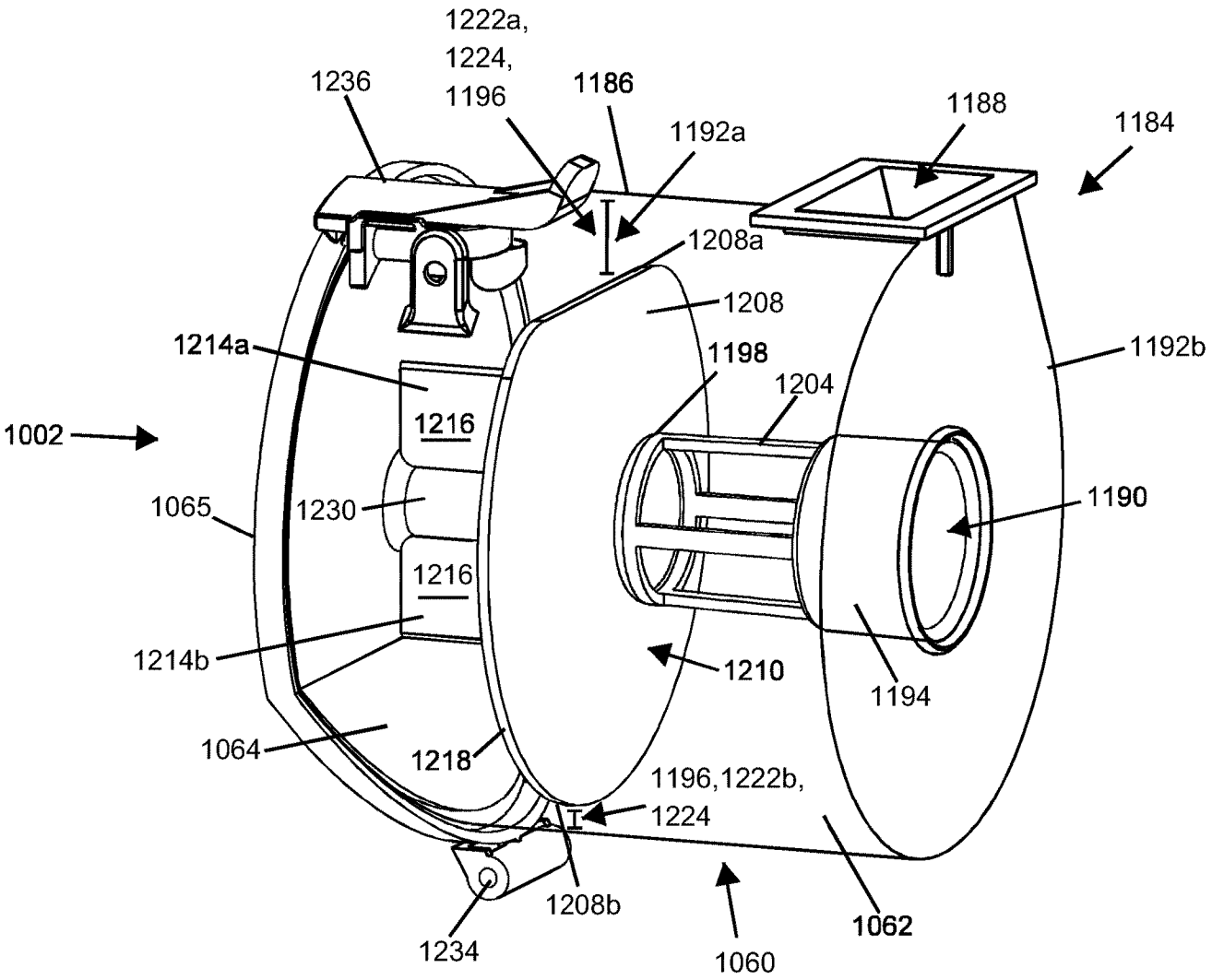
FIG. 34 is a side rear perspective view of the air treatment member of FIG. 33.
Figure 35:
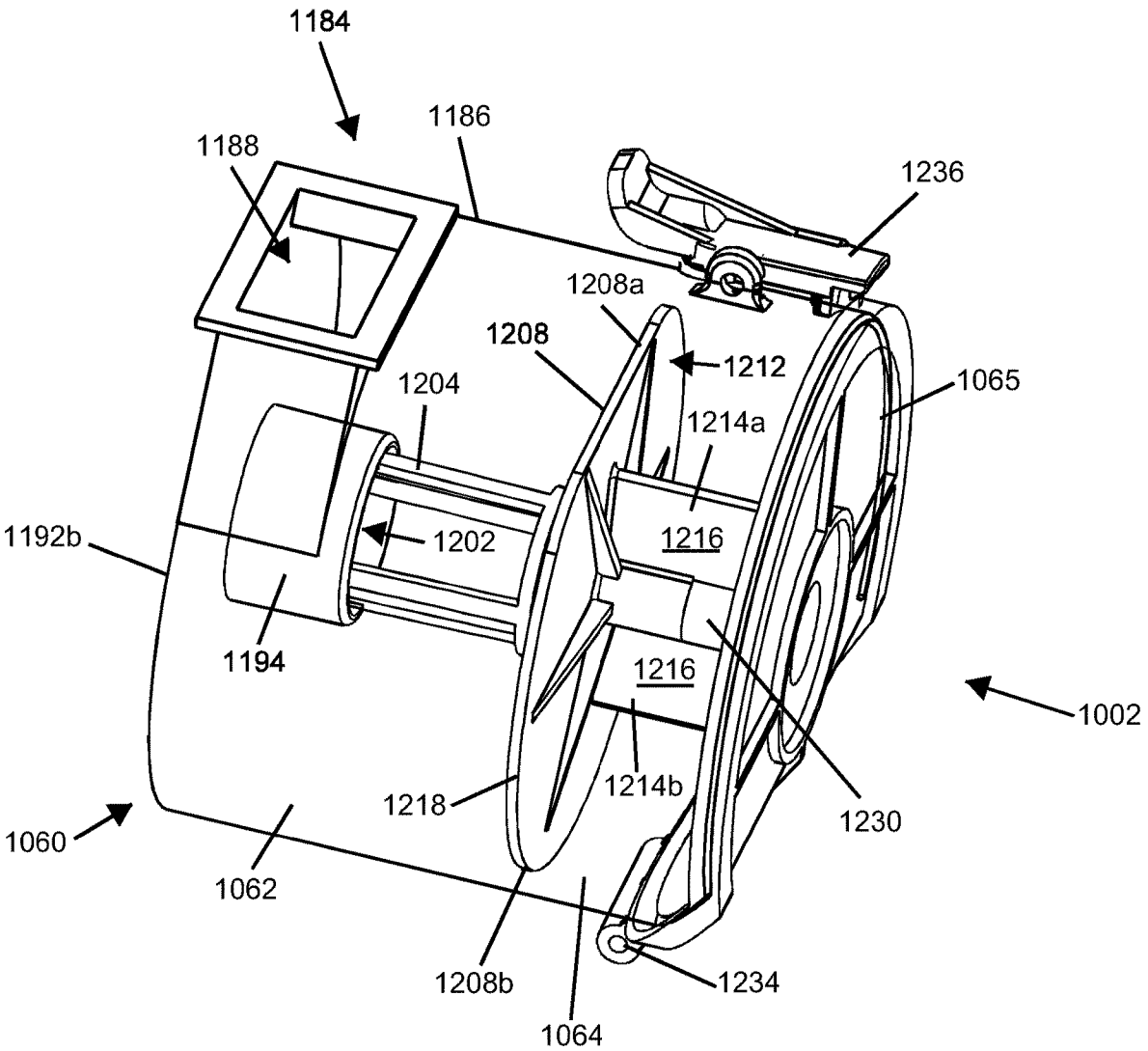
FIG. 35 is a top front perspective view of the air treatment member of FIG. 33.

The handle 6020 is located at the rear end 6004 of the hand vacuum cleaner 6004. The handle 6020 has a handle axis extending between upper and lower ends of the handle. As shown in FIG. 30, a plurality of batteries 6150 are positioned at the upper end of the handle 6020.

Hand vacuum cleaner 6000 can include an energy storage chamber 6100 that is arranged to allow components of the hand vacuum cleaner 6000 to nest between the plurality of energy storage members 6150. In the example shown, the energy storage chamber 6100 has the motor and fan assembly 6050 and the post-motor filter 6080 nested between energy storage members 6150 at the upper end of the handle 6020. The configuration of the energy storage members 6150 in energy storage chamber 6100 is generally similar to that shown in FIGS. 26-28. In alternative embodiments, the various nesting arrangements and energy storage chambers shown in FIGS. 6-28 may be used in hand vacuum cleaner 6000 with suitable modifications (e.g., flipping the locations of components vertically) to allow for the positioning of the energy storage chamber 6000 on the upper end of the main body 6010. The energy storage chamber 6100 may also be upwardly removable using any means disclosed herein.

As used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

What is claimed is:

1. A hand vacuum cleaner having a front end, a rear end, an upper end and a lower end, the hand vacuum cleaner comprising:

(a) a main body;

(b) an air flow path from an air inlet to a clean air outlet with an air treatment member provided in the air flow path;

(c) a fan and motor assembly provided in the main body, the fan and motor assembly is positioned in the air flow path downstream of the air treatment member, the fan and motor assembly having a motor axis of rotation, the fan and motor assembly having a first lateral side that is laterally spaced in a first direction from the motor axis of rotation and a second lateral side that is laterally spaced in a second direction from the motor axis of rotation wherein the second direction is opposite to the first direction;

(d) a handle; and, (e) a removeable energy storage member pack that is removably mountable to the main body, the removeable energy storage pack comprising:

a first lateral housing section enclosing a first plurality of energy storage members, a second lateral housing section separate from the first lateral housing section, the second lateral housing section enclosing a second plurality of energy storage members separate from the first plurality of energy storage members, and a laterally extending web joining a lower end of the first lateral housing section and a lower end of the second lateral housing section, the web being an outer surface of the removable energy store, isolated from the air flow path and external to the first and second housings, and wherein the removeable energy storage member pack is upwardly mountable to a mounted position in which the fan and motor assembly is nested between the first and second lateral housing sections.

2. The hand vacuum cleaner of claim 1 wherein a lower surface of the hand vacuum cleaner comprises the laterally extending web when the energy storage member pack is installed on the hand vacuum cleaner.

3. The hand vacuum cleaner of claim 1 wherein the air flow path comprises an inlet passage extending longitudinally rearwardly from the air inlet to the air treatment member, the air inlet is provided at the upper end of the hand vacuum cleaner and has a longitudinally extending axis and the longitudinally extending axis intersects an upper end of the handle.

4. The hand vacuum cleaner of claim 1 wherein the air treatment member comprises a cyclone having a cyclone axis of rotation, the cyclone axis of rotation extends in a forward/rearward direction and, when the hand vacuum cleaner is oriented with the upper end of the hand vacuum cleaner above the lower end of the hand vacuum cleaner, an upper end of the removeable energy storage member pack is positioned at a vertical position lower than a vertical position of the cyclone axis of rotation.

5. The hand vacuum cleaner of claim 1 wherein the air treatment member comprises a cyclone having a cyclone axis of rotation, the cyclone axis of rotation extends in a forward/rearward direction and, when the hand vacuum cleaner is oriented with the upper end of the hand vacuum cleaner above the lower end of the hand vacuum cleaner, the cyclone axis of rotation extends through a lower end of the hand grip portion above an upper end of the fan and motor assembly.

6. The hand vacuum cleaner of claim 1 wherein the air treatment member comprises a cyclone having a cyclone axis of rotation, the cyclone axis of rotation extends in a forward/rearward direction and, when the hand vacuum cleaner is oriented with the upper end of the hand vacuum cleaner above the lower end of the hand vacuum cleaner, the motor axis of rotation is positioned below the cyclone axis of rotation.

7. The hand vacuum cleaner of claim 1 further comprising a pre-motor filter, wherein a front end of the first plurality of energy storage members is positioned rearward of a front end of the pre-motor filter.

8. The hand vacuum cleaner of claim 1 further comprising a pre-motor filter wherein a finger receiving area is provided between the hand grip portion and the pre-motor filter.

9. A hand vacuum cleaner having a front end, a rear end, an upper end and a lower end, the hand vacuum cleaner comprising:

(a) a main body;

(b) an air flow path from an air inlet to a clean air outlet with an air treatment member provided in the air flow path, wherein the air treatment member has a central longitudinal axis extending in a forward/rearward direction that is horizontal when the upper end is above the lower end;

(c) a fan and motor assembly provided in the main body, the fan and motor assembly is positioned in the air flow path downstream of the air treatment member, the fan and motor assembly having a motor axis of rotation, the fan and motor assembly having a first lateral side that is laterally spaced in a first direction from the motor axis of rotation and a second lateral side that is laterally spaced in a second direction from the motor axis of rotation wherein the second direction is opposite to the first direction;

(d) a handle;

(e) a first plurality of energy storage members provided on the first lateral side of the fan and motor assembly and enclosed in a first lateral energy storage member housing section of a removeable energy storage member pack, the removeable energy storage member pack having a planar vertical wall extending vertically along a planar vertical wall of the main body at the first lateral side of the fan and motor assembly when the removeable energy storage member pack is mounted to the main body whereby, when the removeable energy storage member pack is mounted to the main body, a line extending laterally outwardly from the fan and motor assembly extends through the planar vertical wall of the main body and then through the planar vertical wall of the first lateral energy storage member housing and then through a volume in which the first plurality of energy storage members are positioned, and (f) a second plurality of energy storage members that is provided on the second lateral side of the fan and motor assembly, the second plurality of energy storage members is provided in a second lateral energy storage member housing section of the removeable energy storage member pack, wherein the first and second lateral energy storage member housing sections are spaced apart from each other, wherein the first and second lateral energy storage member housing sections are separated by a laterally extending web of the removeable energy storage member pack, the web being an outer surface of the removable energy store, isolated from the air flow path and external to the first and second housings.

10. The hand vacuum cleaner of claim 9 wherein the first and second lateral energy storage member housing sections are separated by a laterally extending web of the removeable energy storage member pack that has an absence of energy storage members.

11. The hand vacuum cleaner of claim 10, wherein a lower surface of the hand vacuum cleaner comprises the laterally extending web when the energy storage member pack is installed on the hand vacuum cleaner.

12. The hand vacuum cleaner of claim 9 wherein the air flow path comprises an inlet passage extending longitudinally rearwardly from the air inlet to the air treatment member, the air inlet is provided at the upper end of the hand vacuum cleaner and has a longitudinally extending axis and the longitudinally extending axis intersects an upper end of the handle.

13. The hand vacuum cleaner of claim 9 wherein, when the hand vacuum cleaner is oriented with the upper end of the hand vacuum cleaner above the lower end of the hand vacuum cleaner, an upper end of the fan and motor assembly is positioned below the central longitudinal axis.

14. The hand vacuum cleaner of claim 9 wherein, when the hand vacuum cleaner is oriented with the upper end of the hand vacuum cleaner above the lower end of the hand vacuum cleaner, the motor axis of rotation is positioned below the central longitudinal axis.

15. The hand vacuum cleaner of claim 9 further comprising a pre-motor filter, wherein a front end of the first plurality of energy storage members is positioned rearward of a front end of the pre-motor filter.

16. The hand vacuum cleaner of claim 9 wherein the first plurality of energy storage members are arranged vertically along the planar vertical wall of the first lateral energy storage member housing section.

17. A hand vacuum cleaner having a front end, a rear end, an upper end and a lower end, the hand vacuum cleaner comprising:

(a) a main body;

(b) an air flow path from an air inlet to a clean air outlet with an air treatment member provided in the air flow path, wherein the air treatment member comprises an air treatment chamber having a central longitudinal axis extending in a forward/rearward direction that is horizontal when the upper end is above the lower end;

(c) a fan and motor assembly provided in the main body, the fan and motor assembly is positioned in the air flow path downstream of the air treatment member, the fan and motor assembly having a motor axis of rotation, the fan and motor assembly having a first lateral side that is laterally spaced in a first direction from the motor axis of rotation and a second lateral side that is laterally spaced in a second direction from the motor axis of rotation wherein the second direction is opposite to the first direction;

(d) a handle;

(e) a first plurality of energy storage members is provided on the first lateral side of the fan and motor assembly, wherein the first plurality of energy storage members are provided in a first lateral energy storage member housing of a removeable energy storage member pack removable from the main body while the fan and motor assembly remains in the main body, the first plurality of energy storage members arranged in a vertical stack with each energy storage member vertically aligned with each other energy storage member and sandwiched between vertical and planar lateral walls of the first lateral energy storage member housing, and (f) a second plurality of energy storage members that is provided on the second lateral side of the fan and motor assembly, the second plurality of energy storage members is provided in a second lateral energy storage member housing of the removeable energy storage member pack, wherein the first and second lateral energy storage member housings are spaced apart from each other, separated by a laterally extending web of the removeable energy storage member pack, the web being an outer surface of the removable energy store, isolated from the air flow path and external to the first and second housings, and wherein, when the hand vacuum cleaner is oriented with the upper end of the hand vacuum cleaner above the lower end of the hand vacuum cleaner, the motor axis of rotation is positioned below the central longitudinal axis.

18. The hand vacuum cleaner of claim 17 wherein the first and second lateral energy storage member housings are separated by a laterally extending web of the removeable energy storage member pack.

19. The hand vacuum cleaner of claim 17 wherein, when the hand vacuum cleaner is oriented with the upper end of the hand vacuum cleaner above the lower end of the hand vacuum cleaner, an upper end of the first plurality of energy storage members is positioned at a vertical position lower than a vertical position of the central longitudinal axis.

* * * * *